US007347637B2

(12) United States Patent
Kubo et al.

(10) Patent No.: US 7,347,637 B2
(45) Date of Patent: Mar. 25, 2008

(54) HYBRID PAPER SUPPLY MODULE AND IMAGE FORMING APPARATUS EQUIPPED WITH SUCH HYBRID PAPER SUPPLY MODULE

(75) Inventors: Takashi Kubo, Kyoto (JP); Susumu Hashimoto, Nara (JP); Shigeru Yoshida, Nara (JP); Yoshiaki Hiramoto, Nara (JP); Yasuaki Fukada, Nara (JP); Yasushi Matsutomo, Nara (JP); Hideo Yoshikawa, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 453 days.

(21) Appl. No.: 10/932,062

(22) Filed: Sep. 2, 2004

(65) Prior Publication Data

US 2005/0051942 A1 Mar. 10, 2005

(30) Foreign Application Priority Data

Sep. 4, 2003 (JP) ..... 2003-312975
Oct. 17, 2003 (JP) ..... 2003-358115
Oct. 17, 2003 (JP) ..... 2003-358116

(51) Int. Cl.
*B41J 13/10* (2006.01)
*G03G 15/00* (2006.01)

(52) U.S. Cl. ..... 400/624; 399/381

(58) Field of Classification Search ..... 399/391, 399/390, 404, 45, 389; 400/605, 607, 624; 271/3.01, 3.08, 3.09, 9.04, 9.09
See application file for complete search history.

(56) References Cited

U.S. PATENT DOCUMENTS 5,418,606 A * 5/1995 Kikuchi et al. ..... 399/381
6,246,860 B1 * 6/2001 Ohmichi ..... 399/406
6,282,388 B1 * 8/2001 Obata ..... 399/82
6,474,884 B2 * 11/2002 Chiu ..... 400/624
6,902,161 B2 * 6/2005 Gordon et al. ..... 271/161

FOREIGN PATENT DOCUMENTS

| | | | |
|---|---|---|---|
| JP | 05-286593 | | 11/1993 |
| JP | 06-009085 | | 1/1994 |
| JP | 06-127711 | | 5/1994 |
| JP | 06-255817 | | 9/1994 |
| JP | 07-112848 | | 5/1995 |
| JP | 7-178984 | A | 7/1995 |
| JP | 09-012162 | | 1/1997 |
| JP | 11343037 | A * | 12/1999 |
| JP | 2000-281243 | | 10/2000 |
| JP | 2001-138576 | A | 5/2001 |
| JP | 2001-333249 | A | 11/2001 |
| JP | 2003-237990 | | 8/2003 |

* cited by examiner

*Primary Examiner*—Daniel J. Colilla
(74) *Attorney, Agent, or Firm*—Birch, Stewart, Kolasch & Birch, LLP

(57) ABSTRACT

Mechanism unit(s) 6 functioning as automatic-feed cassette(s) and mechanism unit(s) 7 functioning as manual-feed tray(s) together form a single integral module, constituting hybrid paper supply module 5. Manual-feed mechanism unit(s) 7 is or are arranged below transport paths 36, 37, which extend toward printing unit(s) 3. Furthermore, path(s) along which recording paper P taken up from automatic-feed cassette mechanism unit(s) 6 is transported and path(s) along which recording paper P taken up from manual-feed mechanism unit(s) 7 is transported are made to intersect within the module, decreasing length(s) of respective path(s).

26 Claims, 25 Drawing Sheets

1

4
43
44
44a
45
41
47a
47b
47c
46
B
42b
42a
47
47e
42
2
22
21
47f
47g
48
26
A
25
23
24
3
38
39a
37
39b
36
39
31e
31f
36e
31a
35
31
31c
31b
37a
31d
32
76
51
66
67
P
62
64
52
5
6
61
7
75
71
74
79
72
77
37b

HYBRID PAPER SUPPLY MODULE AND IMAGE FORMING APPARATUS EQUIPPED WITH SUCH HYBRID PAPER SUPPLY MODULE

CLAIM(S) IN CONNECTION WITH RELATED APPLICATION(S) AND/OR PRIORITY RIGHT(S)

This application claims priority under 35 USC 119(a) to Patent Application No. 2003-312975 filed in Japan on 4 Sep. 2003, Patent Application No. 2003-358115 filed in Japan on 17 Oct. 2003, and Patent Application No. 2003-358116 filed in Japan on 17 Oct. 2003, the content of all of which is incorporated herein by reference in their entireties.

BACKGROUND OF INVENTION

The present invention relates to a paper supply module with which a copier, printer, facsimile machine, or other such image forming apparatus might be equipped, and to an image forming apparatus equipped with such a paper supply module.

Copiers, printers, facsimile machines, and other such image forming apparatuses—as well as hybrid devices equipped with a plurality of such functions in combination—have conventionally been equipped with automatic-feed cassettes and manual-feed trays serving as containers for (platforms for placement of) recording paper to be fed to image forming units (printing units) equipped with photosensitive drums and the like. When several hundred sheets of recording paper are, for example, loaded into an automatic-feed cassette and image formation is carried out on this recording paper, the recording paper might be sequentially taken up from the automatic-feed cassette and fed to an image forming unit. On the other hand, when a user places recording paper (e.g., postcard stock or the like) on a manual-feed tray and causes initiation of image forming operations, recording paper on this manual-feed tray might be fed to an image forming unit.

Image forming apparatuses equipped with such automatic-feed cassette(s) and manual-feed tray(s) are, for example, disclosed at Japanese Patent Application Publication Kokai No. 2001-138576 and Japanese Patent Application Publication Kokai No. 2001-333249. As disclosed at these patent references, the automatic-feed cassette has heretofore typically been provided at the lowermost part of the apparatus, with the paper supply path extending from the discharge side of this automatic-feed cassette to the image forming unit. Furthermore, the manual-feed tray, being attached to a side wall of the image forming apparatus, has communicated with an intermediate location along the foregoing paper supply path by way of a paper pickup mechanism for taking up recording paper from this manual-feed tray.

FIG. 25 shows in schematic fashion the internal constitution of a typical conventional copier. At this FIG. 25, 251 is an automatic-feed cassette; 252 is a manual-feed tray; 253 is an image forming unit equipped with a photosensitive drum and so forth; 254 is a paper supply path extending from automatic-feed cassette 251; and 255 is a paper pickup mechanism for taking up recording paper from manual-feed tray 252.

As can be seen in FIG. 25, in the case of a paper supply system having layout as mentioned above in which automatic-feed cassettes 251 are provided at the lowermost part of an image forming apparatus and manual-feed tray 252 is provided at a side wall of the image forming apparatus, paper pickup mechanism 255 for manual-feed tray 252 is arranged to one side of paper supply path 254 (i.e., at the side thereof nearer to the apparatus side wall), and paper supply path 254 extends from automatic-feed cassette 251 so as to be directed toward image forming unit 253; meaning that manual-feed tray 252 will, moreover, be arranged to one side of paper pickup mechanism 255. In other words, the aforementioned paper pickup mechanism 255 and manual-feed tray 252 are arranged, in that order as one goes toward the exterior horizontally, to one side of paper supply path 254; the presence of these meaning that there has been a limit to the degree to which it has been possible to reduce the amount of space required for installation of the image forming apparatus. In the case of this image forming apparatus shown in FIG. 25, were it not for manual-feed tray 252 and paper pickup mechanism 255 the amount of space required for installation of the apparatus would only be dimension I shown in the drawing, but due to the fact that manual-feed tray 252 and paper pickup mechanism 255 are actually present the amount of space required for installation of the apparatus is dimension II.

At the same time, developments have in recent years been underway in efforts to achieve reduction in the amount of space required for installation of the apparatus by arranging the automatic-feed cassette at the lower portion of the apparatus and arranging the original capturing unit (scanning unit) at the upper portion of the apparatus, and by disposing the image forming unit and discharge unit (discharge tray) between this automatic-feed cassette and this original capturing unit so as to avoid situations in which the discharge tray protrudes from the side of the apparatus.

FIG. 26 shows in schematic fashion an image forming apparatus having such a layout. At this FIG. 26 as well, 251 is an automatic-feed cassette; 252 is a manual-feed tray; 253 is an image forming unit; 254 is a paper supply path; and 255 is a paper pickup mechanism. In the case of an image forming apparatus having such a layout, because the aforementioned paper pickup mechanism 255 and manual-feed tray 252 are arranged, in that order as one goes toward the exterior horizontally, at the peripheral region near the side wall of the apparatus, as was the case in the above situation there has here as well been a limit to the degree to which it has been possible to reduce the amount of space required for installation.

In particular, given such a layout, it will be necessary to arrange flipping transport path (switchback transport path) 256, for flipping of recording media when carrying out double-sided printing, to one side of paper supply path 254. And in the case of a layout in which the aforementioned paper pickup mechanism 255 and manual-feed tray 252 are arranged even further to the side than this flipping transport path 256, because the space required for installation of the apparatus will increase by an amount corresponding thereto, it has not been possible to take full advantage of the reduction in installation space that would otherwise be afforded by the aforementioned layout (i.e., layouts having the intention of avoiding situations in which the discharge tray protrudes from the side of the apparatus). At this FIG. 26 as well, the amount of space that would be required for installation were it not for manual-feed tray 252 and paper pickup mechanism 255 is indicated by I, and the amount of space required for installation of the apparatus due to the fact that manual-feed tray 252 and paper pickup mechanism 255 are present is indicated by II.

Furthermore, the paper supply path in heretofore-developed image forming apparatuses has been such that the transport path for recording paper supplied from the automatic-feed cassette and the transport path for recording paper supplied from the manual-feed tray have intersected at a location immediately upstream from the image forming unit, and the overall paper supply path of the image forming apparatus has been quite long, increasing by a corresponding amount the complexity of the internal constitution within the apparatus main body as well as the number of locations at which paper jams can occur, and making reduction in the frequency of occurrence of paper jams difficult.

Furthermore, in heretofore-developed image forming apparatuses outfitted with manual-feed tray(s), it has been possible for recording paper to remain on the manual-feed tray following termination of image forming operations, which has tended to cause deterioration in the quality of such recording paper due to accumulation of dust thereon, absorption of moisture content from air, and so forth. Furthermore, it has also been the case, when carrying out image formation with supply of paper from the manual-feed tray, that if the recording paper were to be accidentally placed on the manual-feed tray such that top and bottom (front and back) are reversed, this would tend to cause a situation in which the image could not be formed on the desired surface.

The present invention was conceived in light of the foregoing issues, it being a first object thereof, in order to eliminate such disadvantageous circumstances, to, firstly by improving the automatic-feed cassette, provide an automatic-feed cassette permitting reduction in the amount of space required for image forming apparatus installation as well as reduction in the frequency of occurrence of paper jams, and an image forming apparatus equipped with such automatic-feed cassette(s).

It is, next, a second object thereof to provide, in the context of a hybrid paper supply module equipped with a feed mechanism unit functioning as an automatic-feed cassette and a feed mechanism unit functioning as a manual-feed tray, a hybrid paper supply module permitting takeup of recording paper from either mechanism unit without necessitating provision of separate takeup mechanisms at each mechanism unit, and an image forming apparatus equipped with such hybrid paper supply module(s).

Moreover, the present invention has as third object the provision of an automatic-feed cassette making it possible to achieve mode(s) of transport of recording paper at the interior of the automatic-feed cassette that is/are new mode(s) which have not heretofore existed, and an image forming apparatus equipped with such automatic-feed cassette(s).

SUMMARY OF INVENTION

A hybrid paper supply module in accordance with one or more embodiments of the present invention may comprise one or more automatic-feed cassette mechanism units capable of containing one or more recording media for image formation to be carried out at one or more image forming units of one or more image forming apparatuses; and one or more manual-feed mechanism units permitting placement therein or thereon of one or more recording media by one or more users; wherein at least one of the automatic-feed cassette mechanism unit or units and at least one of the manual-feed mechanism unit or units constitute a single module.

In accordance with such constitution, when image formation is to be carried out on recording media previously loaded into an automatic-feed cassette mechanism unit, recording media might be sequentially taken up from this automatic-feed cassette mechanism unit and fed to an image forming unit, and prescribed image forming operations might be performed at this image forming unit. On the other hand, when a user places recording media (e.g., postcard stock or the like) on a manual-feed mechanism unit and causes initiation of image forming operations, recording media on this manual-feed mechanism unit might be fed to an image forming unit, where prescribed image forming operations might be performed.

Furthermore, constituting the automatic-feed cassette mechanism unit and the manual-feed mechanism unit as a single integral hybrid paper supply module makes it possible to arrange this automatic-feed cassette mechanism unit and this manual-feed mechanism unit in substantially the same plane. This being the case, where a hybrid paper supply module is, for example, arranged at the lowermost part of an image forming apparatus, it will be possible to locate the manual-feed mechanism unit beneath the transport path that extends toward the image forming unit. Conventionally, much space had been required for installation of the apparatus due to the fact that the transport path, manual-feed tray, and paper pickup mechanism for taking up recording medium or media from this manual-feed tray had been arranged horizontally (see FIG. 25). But the present solution means make it possible for the transport path and manual-feed mechanism unit to be arranged at locations such that one is stacked above the other vertically (see FIG. 1), as a result of which it is possible to shorten dimension(s) of the image forming apparatus and achieve reduction in the amount of space required for installation.

Furthermore, because it is possible to make the point at which the path for discharge of recording media taken up from the automatic-feed cassette mechanism unit intersects with the path for discharge of recording media taken up from the manual-feed mechanism unit be a location that is removed by some distance from the image forming unit (a location relatively far upstream from the upstream edge of the image forming unit; e.g., at the interior of the hybrid paper supply module), the lengths of these respective paths can be shortened. This being the case, the length of the overall transport path of the image forming apparatus can be shortened, the number of locations at which paper jams can occur can be reduced, and the frequency of occurrence of paper jams can be reduced.

In the foregoing constitution, as mechanism(s) for taking up recording medium or media from respective mechanism unit(s), at least one of the automatic-feed cassette mechanism unit or units and at least one of the manual-feed mechanism unit or units may respectively comprise one or more paper takeup mechanisms and one or more paper separator mechanisms permitting takeup of only a single recording medium sheet.

In accordance with such constitution, when recording medium or media is/are to be taken up from automatic-feed cassette mechanism unit(s), paper takeup mechanism(s) (e.g., takeup roller(s)) and paper separator mechanism(s) (comprising, e.g., separator roller(s) and separator plate(s)) provided at the automatic-feed cassette mechanism unit(s) might be driven such that only one recording medium sheet is taken up from the automatic-feed cassette mechanism unit(s). Similarly, when recording medium or media is/are to be taken up from manual-feed mechanism unit(s), paper takeup mechanism(s) and paper separator mechanism(s) provided at the manual-feed mechanism unit(s) might be driven such that only one recording medium sheet is taken up from the manual-feed mechanism unit(s). By thus providing each of the respective feed mechanism units with its own dedicated mechanism for takeup of recording media, it is possible to cause recording media takeup operations at respective mechanism units to take place in rapid and stable fashion.

In the foregoing constitution(s), the hybrid paper supply module may further comprise at the interior thereof one or more first paths transporting one or more recording media taken up from at least one of the automatic-feed cassette mechanism unit or units; one or more second paths transporting one or more recording media taken up from at least one of the manual-feed mechanism unit or units; and one or more common paths at which at least one of the first path or paths and at least one of the second paths are made to mutually intersect and which thereafter extend toward at least one of the image forming unit or units.

As a result adoption of such constitution, recording medium or media taken up from either automatic-feed cassette mechanism unit(s) or manual-feed mechanism unit(s) would, after passing through the aforementioned common path(s) provided at the interior of the hybrid paper supply module, be introduced into path(s) provided at the image forming apparatus main body and would arrive at image forming unit(s), where image formation would take place. In other words, there is only one path by which recording medium or media is/are discharged in going toward image forming unit(s) from the hybrid paper supply module, eliminating the need to have two paths at the image forming apparatus main body such as would be the case were there one path for the automatic-feed cassette and another path for the manual-feed tray. This being the case, not only is it possible to shorten the length of the overall transport path of the image forming apparatus and achieve simplification of the constitution within the apparatus main body, but it is also possible to reduce the number of locations at which paper jams can occur, and it is possible to reduce the frequency of occurrence of paper jams.

In the foregoing constitution, at least one of the manual-feed mechanism unit or units may comprise one or more manual-feed trays in which or on which one or more recording media can be placed by one or more users; at least one of the manual-feed tray or trays being constructed such that when at least one of the manual-feed mechanism unit or units is not in use it can be collapsed in multiple stages and stored at at least one side of the hybrid paper supply module. In such case, when manual-feed mechanism unit(s) is/are not in use, manual-feed tray(s) will no longer jut far out from apparatus side(s), improving apparatus appearance and also making it possible to prevent disadvantageous circumstances accompanying collection of dust on manual-feed tray(s) (e.g., entry of dust into transport path(s), with concomitant ill effect on image formation).

Furthermore, at least one of the manual-feed tray or trays, when stored, may constitute at least one side wall of the hybrid paper supply module; and when deployed so as to permit placement therein or thereon of one or more recording media, may cause access to be opened up to one or more recording medium transport paths. In other words, such a manual-feed tray would also function as a member making up the module side wall. As a result, it is possible to achieve reduction in parts count. Furthermore, because access to recording medium transport path(s) is opened up simultaneous with deployment of manual-feed tray(s) and access to recording medium transport path(s) is closed off simultaneous with storage of manual-feed tray(s), this makes for good ease of operations at time(s) when manual-feed tray(s) is/are put into use and at time(s) when manual-feed tray(s) is/are put away.

Moreover, at least one of the manual-feed tray or trays may be configured so as to permit extension in multiple stages when at least one of the manual-feed tray or trays is in one or more deployed states permitting one or more recording media to be placed therein or thereon. In other words, manual-feed tray(s) may be extended in correspondence to size(s) of recording medium or media placed therein or thereon, permitting manual-feed mechanism unit(s) to accommodate recording media of multiple sizes.

In addition, at least one of the manual-feed tray or trays may be provided with one or more guide members constraining one or more placement locations of one or more recording media placed therein or thereon by abutting against one or more side edges extending in one or more transport directions of at least one of the recording medium or media; and it is preferred that at least one of the guide member or members be supported so as to permit movement in sliding fashion in or on at least one of the manual-feed tray or trays. This will make it possible to prevent skew during transport of recording medium or media toward paper supply path(s), will make it possible to cause image(s) to be formed at proper location(s) on recording medium or media, and will make it possible to achieve improvement in image forming apparatus reliability.

Furthermore, as strategy to be applied in anticipation of paper jam(s), at least one of the manual-feed mechanism unit or units may be constructed such that it can move in sliding fashion so as to open up access to one or more recording medium transport paths within the hybrid paper supply module; and may be constructed such that, in the event that one or more recording media are involved in one or more jams (paper jams) in one or more recording medium transport paths within the hybrid paper supply module, sliding movement of at least one of the manual-feed mechanism unit or units causes access to be opened up to at least one of the recording medium transport path or paths so as to make it possible to remove at least one of the jammed recording medium or media therefrom.

In accordance with such constitution, in the event of occurrence of paperjam(s) in which recording medium or media become jammed at the interior of the hybrid paper supply module, by merely moving manual-feed mechanism unit(s) in sliding fashion (in operation(s) pulling same outward and to the side of the image forming apparatus), recording medium or media (jammed paper) jammed in recording medium transport path(s) may be made accessible from the apparatus exterior, making it possible to easily carry out procedure(s) for removal of such jammed paper and permitting quick return to image forming operations.

Furthermore, a hybrid paper supply module in accordance with one or more embodiments of the present invention may further comprise one or more common takeup mechanisms selectively permitting one or more recording media to be taken up from either at least one of the automatic-feed cassette mechanism unit or units or at least one of the manual-feed mechanism unit or units. Moreover, it is preferred that such a common takeup mechanism be constructed so as to permit switching among at least one first transport mode in which one or more recording media taken up from at least one of the automatic-feed cassette mechanism unit or units is transported toward at least one of the image forming unit or units, at least one second transport mode in which one or more recording media taken up from at least one of the manual-feed mechanism unit or units is transported toward at least one of the image forming unit or units, and at least one third transport mode in which one or more recording media taken up from at least one of the manual-feed mechanism unit or units is delivered to at least one of the automatic-feed cassette mechanism unit or units.

In accordance with such constitution, first, in the event that there is/are request(s) for image formation to be carried out on recording medium or media loaded into automatic-feed cassette mechanism unit(s), first transport mode(s) might be entered, recording medium or media taken up from automatic-feed cassette mechanism unit(s) being transported toward image forming unit(s), where image forming operations would be carried out. Furthermore, in the event that there is/are request(s) for image formation to be carried out on recording medium or media loaded into manual-feed mechanism unit(s), second transport mode(s) might be entered, recording medium or media taken up from manual-feed mechanism unit(s) being transported toward image forming unit(s), where image forming operations would be carried out. Moreover, if, for example, recording medium or media still remain in or on manual-feed mechanism unit(s) following termination of image forming operations in which media was supplied from manual-feed mechanism unit(s), third transport mode(s) might be entered, such remaining recording medium or media being taken up from manual-feed mechanism unit(s) and thereafter being delivered to automatic-feed cassette mechanism unit(s). This being the case, it will be possible to avoid situations in which recording medium or media remain in or on manual-feed mechanism unit(s) for long period(s) of time, and it will be possible to avoid circumstances tending to cause deterioration in the quality of such recording medium or media due to accumulation of dust thereon, absorption of moisture content from air, and so forth. Furthermore, in the event that there is/are request(s) for image formation to be carried out on recording medium or media placed in or on manual-feed mechanism unit(s), if recording medium or media were accidentally placed thereon such that top and bottom (front and back) are reversed, by carrying out transport operations (e.g., slew transport, described below) in accordance with the aforementioned third transport mode(s), it would be possible to reverse recording medium image formation surface(s), permitting image(s) to be formed on desired surface(s).

The aforementioned common takeup mechanism may comprise one or more takeup rollers capable of moving between one or more automatic-feed-shifted positions for taking up one or more recording media from at least one of the automatic-feed cassette mechanism unit or units and one or more manual-feed-shifted positions for taking up one or more recording media from at least one of the manual-feed mechanism unit or units; one or more separator mechanisms separating one or more recording media taken up by at least one of the takeup roller or rollers; and one or more transport paths guiding at least one of the recording medium or media toward at least one of the image forming unit or units.

In accordance with such constitution, first, when recording medium or media loaded into automatic-feed cassette mechanism unit(s) is/are to be taken up therefrom and image formation is to be carried out, takeup roller(s) might move to automatic-feed-shifted position(s) and might take up recording medium or media from automatic-feed cassette mechanism unit(s), and after recording medium or media has been separated by separator mechanism(s), recording medium or media might be guided by way of transport path(s) toward image forming unit(s). Similarly, when recording medium or media placed in or on manual-feed mechanism unit(s) is/are to be taken up therefrom and image formation is to be carried out, takeup roller(s) might move to manual-feed-shifted position(s) and might take up recording medium or media from manual-feed mechanism unit(s), and after recording medium or media has been separated by separator mechanism(s), recording medium or media would be guided by way of transport path(s) toward image forming unit(s). Thus, because it is possible by means of a single common takeup mechanism to selectively take up recording medium or media from either automatic-feed cassette mechanism unit(s) or manual-feed mechanism unit(s), it will no longer be necessary to provide separate takeup mechanisms at each mechanism unit, and by reducing parts count it will be possible to achieve reduction in the amount of space required for installation of the image forming apparatus.

Furthermore, it is preferred that recording medium transport operations during the aforementioned third transport mode(s) are performed when no image forming operations are taking place. By so doing, it will be possible to deliver recording medium or media remaining in or on manual-feed mechanism unit(s) to automatic-feed cassette mechanism unit(s) and avoid tendency to cause ill effect on image forming operations.

Furthermore, a constitution may be adopted which is such that recording medium transport operations during the aforementioned third transport mode(s) are performed only if size(s) of recording medium or media placed in or on manual-feed mechanism unit(s) is/are the same as size(s) of recording medium or media contained within automatic-feed cassette mechanism unit(s). More specifically, paper size sensors might, for example, be respectively provided at manual-feed mechanism unit(s) and automatic-feed cassette mechanism unit(s), and it might be that recording medium transport operations in accordance with third transport mode(s) (delivery of recording medium or media remaining in or on manual-feed mechanism unit(s) to automatic-feed cassette mechanism unit(s)) are performed only if paper size(s) detected by these sensors are identical. By so doing, it is possible to avoid situations in which multiple sizes of recording media become mixed within automatic-feed cassette mechanism unit(s), and it is possible to avoid situations in which image formation is carried out on recording medium or media of size(s) other than desired size(s) such as might occur if image formation operations were to be carried out following occurrence of the former sort of situation.

Furthermore, at least one of the automatic-feed cassette mechanism unit or units and at least one of the manual-feed mechanism unit or units may be arranged so as to be mutually adjacent horizontally. Moreover, a constitution may be adopted which is such that recording medium transport operations during third transport mode(s) are such that slew transport is carried out in which one or more recording media taken up from at least one of the manual-feed mechanism unit or units is or are transported horizontally, without flipping, toward at least one of the automatic-feed cassette mechanism unit or units.

In such case, a constitution may be adopted which is such that at least one of the separator mechanism or mechanisms comprises one or more separator rollers and one or more separator plates, at least one of the separator plate or plates coming in contact with at least one of the separator roller or rollers; and during slew transport, at least one of the separator plate or plates being oriented so as to be substantially parallel to an imaginary line drawn so as to connect at least one of the manual-feed mechanism unit or units and at least one of the automatic-feed cassette mechanism unit or units, one or more recording media taken up from at least one of the manual-feed mechanism unit or units is or are transported horizontally to at least one of the automatic-feed cassette mechanism unit or units.

Such a constitution will permit implementation of specific example(s) of transport operations in accordance with third transport mode(s); and moreover, will make it possible, as has been described above, to avoid situations in which recording medium or media remain in or on manual-feed mechanism unit(s) for long period(s) of time, and to avoid deterioration in the quality of recording medium or media due to accumulation of dust thereon, absorption of moisture content from air, and so forth. Moreover, as a result of such slew transport, when recording medium or media delivered to automatic-feed cassette mechanism unit(s) is or are transported to image forming unit(s), recording medium image formation surface(s) at such time will be surface(s) on side(s) (back side(s)) opposite what would have been image formation surface(s) had recording medium or media placed in or on manual-feed mechanism unit(s) been transported toward image forming unit(s) pursuant to second transport mode(s) (whereas image formation is carried out on bottom surface(s) of recording paper during second transport mode(s) in embodiment(s) described below, if the recording paper had been subjected to slew transport and image formation had thereafter been carried out pursuant to first transport mode(s) image formation would have been carried out on what was/were top surface(s) of recording paper when recording paper was in or on manual-feed mechanism unit(s)). This being the case, it is preferred that recording medium or media on which such slew transport is performed be recording medium or media permitting printing on both sides thereof (recording medium or media for which both the front and back surfaces are white). Furthermore, because such slew transport causes image formation surface(s) to be opposite surface(s), in the event that recording medium or media is/are mistakenly placed upside-down (such that front and back are reversed) in or on manual-feed mechanism unit(s), it will be possible by carrying out such slew transport to cause image formation to be carried out on desired surface(s). For example, sensor(s) detecting which way paper is facing might be provided at manual-feed mechanism unit(s), slew transport being carried out in the event that such sensor(s) detect that recording medium or media has been placed upside-down in or on manual-feed mechanism unit(s).

As another constitution in the context of which transport operations might be carried out in accordance with the aforementioned third transport mode(s), a constitution may be adopted in which at least one of the automatic-feed cassette mechanism unit or units and at least one of the manual-feed mechanism unit or units are arranged so as to be mutually adjacent horizontally; and recording medium transport operations during at least one of the third transport mode or modes are such that switchback transport is carried out in which one or more recording media taken up from at least one of the manual-feed mechanism unit or units is or are delivered, with flipping, to at least one of the automatic-feed cassette mechanism unit or units.

In such case, it is preferred that a constitution be adopted which is such that at least one of the separator mechanism or mechanisms comprises one or more separator rollers and one or more separator plates, at least one of the separator plate or plates coming in contact with at least one of the separator roller or rollers; and during switchback transport, first, with at least one of the separator plate or plates oriented so as to guide, to one or more transport paths directed toward at least one of the image forming unit or units, one or more recording media taken up from at least one of the manual-feed mechanism unit or units, one or more recording media is or are taken up from at least one of the manual-feed mechanism unit or units and is or are guided to at least one of the transport path or paths, and thereafter, with at least one of the separator plate or plates oriented so as to guide one or more recording media present in at least one of the transport path or paths to at least one of the automatic-feed cassette mechanism unit or units, one or more recording media is or are delivered from at least one of the transport path or paths to at least one of the automatic-feed cassette mechanism unit or units.

In more specific terms, it is preferred that a constitution be adopted which is such that during switchback transport, first, with at least one of the takeup roller or rollers in at least one of the manual-feed-shifted position or positions for taking up one or more recording media from at least one of the manual-feed mechanism unit or units, and with at least one of the separator plate or plates in one or more manual-feed-inclined orientations for guiding one or more recording media toward one or more transport paths from at least one of the manual-feed mechanism unit or units, one or more recording media taken up from at least one of the manual-feed mechanism unit or units is or are guided to at least one of the transport path or paths, and thereafter, with at least one of the separator roller or rollers rotating in reverse fashion, and with at least one of the separator plate or plates in one or more automatic-feed-inclined orientations for guiding one or more recording media toward at least one of the automatic-feed cassette mechanism unit or units from at least one of the transport path or paths, one or more recording media is or are delivered from at least one of the transport path or paths to at least one of the automatic-feed cassette mechanism unit or units.

Furthermore, a constitution may be adopted which is such that during switchback transport, when at least one recording medium is or are delivered from at least one of the transport path or paths to at least one of the automatic-feed cassette mechanism unit or units, movement of at least one recording medium upstream edge as it carried along with at least one outside circumferential surface of at least one of the separator roller or rollers while at least one of the separator roller or rollers is rotating causes at least one of the recording medium or media to be introduced into at least one region between at least one of the separator roller or rollers and at least one of the separator plate or plates and to be transported toward at least one of the automatic-feed cassette mechanism unit or units from at least one of the transport path or paths.

Here as well, such constitutions will permit implementation of specific example(s) of transport operations in accordance with third transport mode(s); and moreover, will make it possible, as has been described above, to avoid situations in which recording medium or media remain in or on manual-feed mechanism unit(s) for long period(s) of time. It will consequently be possible to avoid deterioration in the quality of recording medium or media due to accumulation of dust thereon, absorption of moisture content from air, and so forth. Moreover, as a result of such switchback transport, when recording medium or media delivered to automatic-feed cassette mechanism unit(s) is or are transported to image forming unit(s), recording medium image formation surface(s) at such time will be surface(s) on same side(s) as what would have been image formation surface(s) had recording medium or media placed in or on manual-feed mechanism unit(s) been transported toward image forming unit(s) pursuant to second transport mode(s) (image formation is carried out on bottom surface(s) of recording paper during second transport mode(s) in embodiment(s) described below, and it is also the case that if the recording paper had been subjected to switchback transport and image formation had thereafter been carried out pursuant to first transport mode(s) image formation would have been carried out on what was/were bottom surface(s) of recording paper when recording paper was in or on manual-feed mechanism unit(s)). This being the case, recording medium or media on which such switchback transport is performed is/are not limited to recording medium or media permitting printing on both sides thereof (recording medium or media for which both the front and back surfaces are white) but may also be recording medium or media permitting printing on only one side thereof (paper coated on one side, stock employing "backing paper," etc.).

A hybrid paper supply module capable of carrying out both the aforementioned slew transport and switchback transport may have the following constitution. That is, it is preferred that recording medium transport operations during at least one of the third transport mode or modes be such that slew transport, in which one or more recording media taken up from at least one of the manual-feed mechanism unit or units is or are delivered, without flipping, to at least one of the automatic-feed cassette mechanism unit or units, or switchback transport, in which one or more recording media taken up from at least one of the manual-feed mechanism unit or units is or are delivered, with flipping, to at least one of the automatic-feed cassette mechanism unit or units, is selectively carried out. Moreover, during execution of recording medium transport operations in accordance with third transport mode(s), if it is the case that surface(s) at which image formation would be carried out would be surface(s) at which it is desired that image formation should be carried out were recording medium or media placed in or on manual-feed mechanism unit(s) to be transported toward image forming unit(s) if transported pursuant to second transport mode(s), then recording medium or media is or are delivered by means of switchback transport from manual-feed mechanism unit(s) to automatic-feed cassette mechanism unit(s). But if it is the case that surface(s) at which image formation would be carried out would not be surface(s) at which it is desired that image formation should be carried out were recording medium or media placed in or on manual-feed mechanism unit(s) to be transported toward image forming unit(s) if transported pursuant to second transport mode(s), then recording medium or media is or are delivered by means of slew transport from manual-feed mechanism unit(s) to automatic-feed cassette mechanism unit(s).

By so doing, it is possible to cause image formation to be carried out on desired surface(s), permitting satisfactory image forming operations to be carried out even where recording medium or media has or have mistakenly been placed upside-down (such that front and back are reversed) in or on manual-feed mechanism unit(s).

Moreover, a hybrid paper supply module in accordance with one or more embodiments of the present invention may further comprise one or more common takeup mechanisms selectively permitting one or more recording media to be taken up from either at least one of the automatic-feed cassette mechanism unit or units or at least one of the manual-feed mechanism unit or units; at least one of the common takeup mechanism or mechanisms being provided with one or more takeup rollers capable of moving between one or more automatic-feed-shifted positions for taking up one or more recording media from at least one of the automatic-feed cassette mechanism unit or units and one or more manual-feed-shifted positions for taking up one or more recording media from at least one of the manual-feed mechanism unit or units; one or more separator mechanisms separating one or more recording media taken up by at least one of the takeup roller or rollers; and one or more transport paths guiding at least one of the recording medium or media toward at least one of the image forming unit or units.

In accordance with such constitution, first, when recording medium or media loaded into automatic-feed cassette mechanism unit(s) is/are to be taken up therefrom and image formation is to be carried out, takeup roller(s) might move to automatic-feed-shifted position(s) and might take up recording medium or media from automatic-feed cassette mechanism unit(s), and after recording medium or media has been separated by separator mechanism(s), recording medium or media might be guided by way of transport path(s) toward image forming unit(s). Similarly, when recording medium or media placed in or on manual-feed mechanism unit(s) is/are to be taken up therefrom and image formation is to be carried out, takeup roller(s) might move to manual-feed-shifted position(s) and might take up recording medium or media from manual-feed mechanism unit(s), and after recording medium or media has been separated by separator mechanism(s), recording medium or media would be guided by way of transport path(s) toward image forming unit(s). Thus, because it is possible by means of a single common takeup mechanism to selectively take up recording medium or media from either automatic-feed cassette mechanism unit(s) or manual-feed mechanism unit(s), it will no longer be necessary to provide separate takeup mechanisms at each mechanism unit, and by reducing parts count it will be possible to achieve reduction in the amount of space required for installation of the image forming apparatus.

Furthermore, in the context of the foregoing constitution, it is preferred that a constitution be adopted which is such that at least one of the takeup roller or rollers and at least one of the separator or mechanism or mechanisms receive driving power from one or more common drive sources to carry out recording medium takeup operations and recording medium separation operations. Moreover, a constitution may be adopted which is such that at least one direction of drive of at least one of the drive source or sources is changed, permitting switching between or among the mechanism units from which one or more recording media is taken up, depending upon whether one or more recording media is to be taken up from at least one of the automatic-feed cassette mechanism unit or units or whether one or more recording media is to be taken up from at least one of the manual-feed mechanism unit or units.

As a result of adoption of such constitution, it will be possible merely by changing direction of drive of a single drive source (e.g., by changing direction of driving rotation of a drive motor) to switch between takeup of recording medium or media from automatic-feed cassette mechanism unit(s) and takeup of recording medium or media from manual-feed mechanism unit(s), making it possible by means of a simple constitution and simple operation to select the mechanism unit(s) from which recording medium or media is to be taken up.

It is furthermore preferred that at least one of the separator mechanism or mechanisms comprise one or more separator rollers and one or more separator plates, at least one of the separator plate or plates coming in contact with at least one of the separator roller or rollers. And it is preferred that at least one of the takeup roller or rollers and at least one of the separator roller or rollers be mutually connected so as to permit transmission of motive force by means of one or more belts. Moreover, it is preferred that when image forming is not taking place, at least one of the takeup roller or rollers be made to stay in one or more neutral positions between at least one of the automatic-feed-shifted position or positions and at least one of the manual-feed-shifted position or positions. And it is preferred that a constitution be adopted which is such that when image forming is taking place, at least one of the takeup roller or rollers moves from at least one of the neutral position or positions to at least one of the automatic-feed-shifted position or positions in the event that at least one of the separator roller or rollers is driven in rotational fashion in one direction, but at least one of the takeup roller or rollers moves from at least one of the neutral position or positions to at least one of the manual-feed-shifted position or positions in the event that at least one of the separator roller or rollers is driven in rotational fashion in the other direction.

With respect to separator plate operations in such case, it is preferred that at least one of the separator plate or plates be constituted so as to permit one or more angles of inclination to be changed so as to, when taking up one or more recording media from at least one of the automatic-feed cassette mechanism unit or units, assume one or more automatic-feed-inclined orientations for guiding one or more recording media toward one or more transport paths from at least one of the automatic-feed cassette mechanism unit or units; but when taking up one or more recording media from at least one of the manual-feed mechanism unit or units, assume one or more manual-feed-inclined orientations for guiding one or more recording media toward one or more transport paths from at least one of the manual-feed mechanism unit or units.

Such movement and/or altered orientation of takeup roller(s) and separator plate(s) makes it possible for takeup of recording medium or media to be performed smoothly regardless of whether such takeup is from automatic-feed cassette mechanism unit(s) or manual-feed mechanism unit(s), permitting suppression of occurrence of paper jams in transport path(s) and making it possible to obtain common takeup mechanism(s) having high reliability.

As constitution for obtaining appropriate separator plate orientation, it is preferred that there further be provided one or more stopper components, present at or near at least one of the separator plate or plates, for maintaining at least one of the separator plate or plates in either at least one of the automatic-feed-inclined orientation or orientations or at least one of the manual-feed-inclined orientation or orientations. This being the case, it will be possible for separator plate(s) when in either inclined orientation to be positionally constrained by stopper component(s) and for orientation(s) thereof to be maintained at inclinational angle(s) suitable for transport of recording medium or media, permitting recording medium takeup operations to be carried out in stable fashion.

Specific examples of operations that may be carried out following termination of image forming operations include the following. It is preferred that a constitution be adopted which is such that in order to cause at least one of the takeup roller or rollers to move and return to at least one of the neutral position or positions, one or more drive sources causing motion of at least one of the takeup roller or rollers is, following termination of image forming operations, driven in at least one direction opposite to at least one direction in which at least one of the takeup roller or rollers was driven during initiation of image forming operations. By thus always causing takeup roller(s) to return to neutral position(s) following termination of image forming operations, it will be possible to maintain constant time(s) required before takeup of recording medium or media can begin despite any change in the feed mechanism unit(s) from which recording medium or media is/are to be taken up when image forming operations are next initiated. For example, where-feed mechanism unit(s) from which recording medium or media was/were taken up was/were previously automatic-feed cassette mechanism unit(s), if takeup roller(s) is/are not returned to neutral position(s) following termination of image forming operations, then in the event that the feed mechanism unit(s) from which recording medium or media is/are to be taken up next is/are manual-feed mechanism unit(s), takeup roller(s) will have to be moved from automatic-feed-shifted position(s), past neutral position(s), and on to manual-feed-shifted position(s), and a great deal of time will have been required before recording medium takeup can be initiated. But in the case of the present solution means, such a situation will not occur and it will be possible to maintain constant time(s) required therefor, because takeup roller(s) is/are always made to return to neutral position(s) following termination of image forming operations.

As a more specific example of the foregoing operations which might be carried out following termination of image forming operations, it is preferred that in accompaniment to movement and return of at least one of the takeup roller or rollers to at least one of the neutral position or positions, at least one of the separator plate or plates be made to return to at least one neutral orientation between at least one automatic-feed-inclined orientation for guiding one or more recording media toward one or more transport paths from at least one of the automatic-feed cassette mechanism unit or units and at least one manual-feed-inclined orientation for guiding one or more recording media toward one or more transport paths from at least one of the manual-feed mechanism unit or units. And it is preferred that a constitution be adopted which is such that following termination of image forming operations, at least one of the separator plate or plates returns to at least one of the neutral orientation or orientations before at least one belt spanning at least one of the takeup roller or rollers and at least one of the separator roller or rollers completes one full circuit. This will make it possible to reduce the time it takes for separator plate(s) to return to neutral orientation(s); and in accompaniment to reduction in the time during which separator roller(s) is/are in sliding contact with separator plate(s), it will be possible to suppress deterioration of separator plate surface(s) and it will be possible to achieve increased separator plate life.

Moreover, also within the purview of the technical idea of the present invention are image forming apparatus(es) equipped with hybrid paper supply module(s) in accordance with any one embodiment of the present invention.

More specifically, such an image forming apparatus may be such that image formation is carried out on one or more recording media taken up by at least one of the common takeup mechanism or mechanisms from either at least one of the automatic-feed cassette mechanism unit or units or at least one of the manual-feed mechanism unit or units and supplied to at least one of the image forming unit or units.

BEST MODE OF CARRYING OUT INVENTION

Below, embodiments of the present invention are described with reference to the drawings. At the present embodiment, description is carried out in terms of an example in which the present invention is applied to a hybrid device equipped with copier function, printer function, and facsimile function.

First Embodiment

Description of Overall Constitution of Hybrid Device

Figure 1:
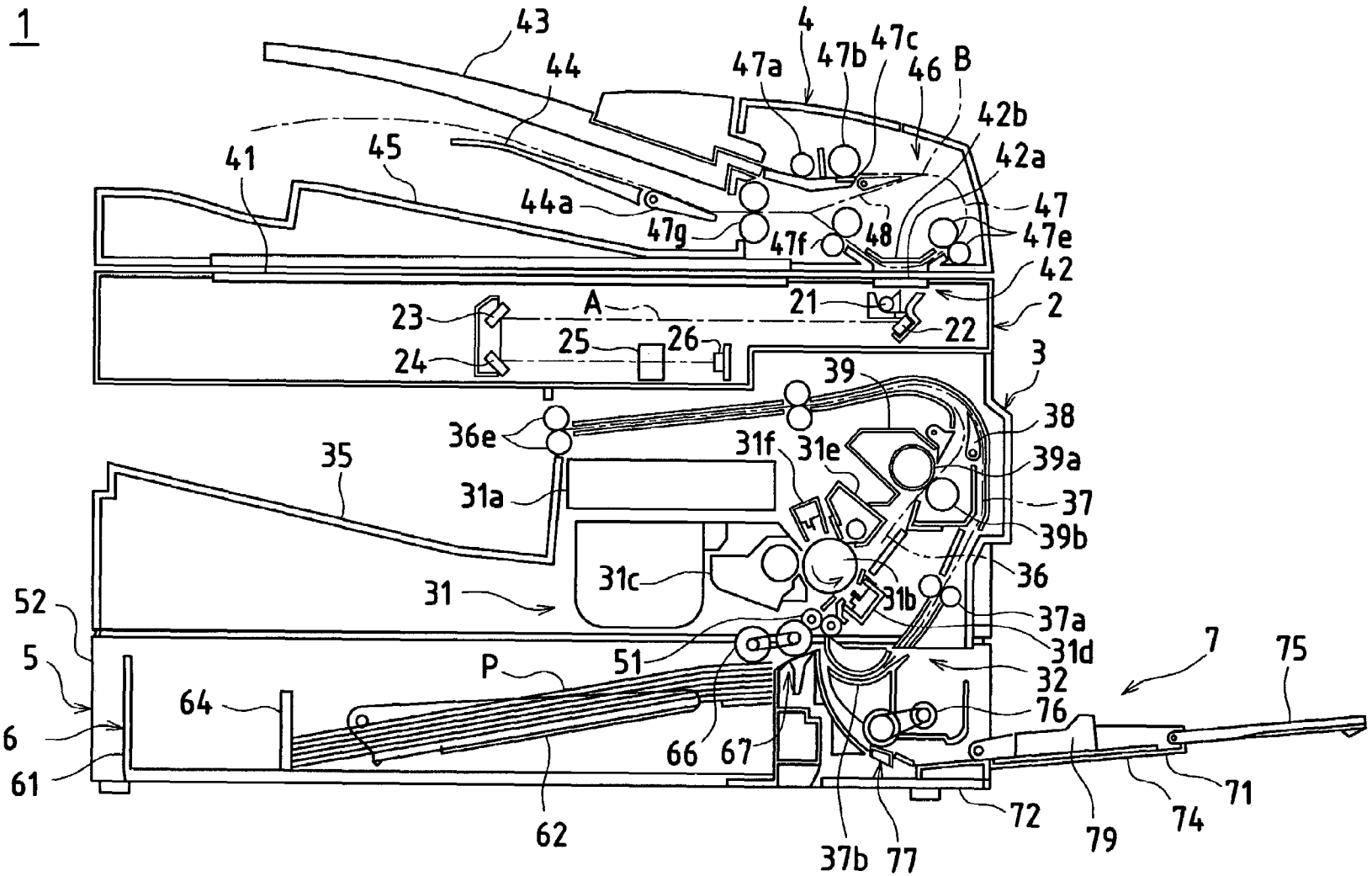
FIG. 1 is a drawing showing in schematic fashion the internal constitution of a hybrid device associated with a first embodiment of the present invention.

FIG. 1 shows in schematic fashion the internal constitution of hybrid device 1 which serves as image forming apparatus associated with the present embodiment. As shown in this FIG. 1, hybrid device 1 is provided with scanning unit 2, printing unit 3 serving as image forming unit, and automatic original feed unit 4. Description of the respective units follows below.

Description of Scanning Unit 2

At the subassembly represented by scanning unit 2, images of originals placed on original stage 41 comprising transparent glass or the like and/or images of originals fed one at a time from automatic original feed unit 4 are captured and image data is created. This scanning unit 2 is provided with exposing light source 21; plurality of reflecting mirrors 22, 23, 24; imaging lens 25; and photoelectric conversion element (CCD=charge coupled device) 26.

The aforementioned exposing light source 21 causes light to be irradiated onto originals placed on original stage 41 of automatic original feed unit 4 and/or originals transported thereto by automatic original feed unit 4. As indicated by the optical axis depicted using alternating long and short chain line A at FIG. 1, respective reflecting mirrors 22, 23, 24 cause light reflected from the original to first be reflected to the left as viewed in the drawing, to thereafter be reflected downward, and to thereafter be reflected to the right as viewed in the drawing so as to be directed toward imaging lens 25.

Operations for capturing an original image are such that, in the situation where the original is placed on the aforementioned original stage 41 (i.e., during stationary sheet operation), exposing light source 21 and respective reflecting mirrors 22, 23, 24 scan horizontally in parallel fashion with respect to original stage 41 so as to capture an image of the entire original.

On the other hand, in the situation where the original is transported by automatic original feed unit 4 (i.e., during moving sheet operation), exposing light source 21 and respective reflecting mirrors 22, 23, 24 remain stationary at the position indicated at FIG. 1, and original capturing unit 42 of automatic original feed unit 4, described below, is made to capture an image of the original when the original passes therethrough.

Light reflected by the aforementioned respective reflecting mirrors 22, 23, 24 and passing through imaging lens 25 is guided to photoelectric conversion element 26, the reflected light being converted into electrical signal(s) (original image data) at this photoelectric conversion element 26.

Description of Printing Unit 3

Printing unit 3 is provided with image forming system 31 and paper transport system 32.

Image forming system 31 is provided with laser scanning unit 31*a* and photosensitive drum 31*b* serving as drum-type image carrier. Laser scanning unit 31*a* irradiates the surface of photosensitive drum 31*b* with laser light based on original image data produced by conversion at the aforementioned photoelectric conversion element 26. Photosensitive drum 31*b* rotates in the direction indicated by the arrow in FIG. 1, and a latent electrostatic image is formed on the surface thereof as a result of irradiation thereof by laser light from laser scanning unit 31*a*.

Furthermore, at the outside periphery of photosensitive drum 31*b*, there are arranged in order circumferentially about photosensitive drum 31*b*—in addition to the aforementioned laser scanning unit 31*a*—developer apparatus (developer mechanism) 31*c*, transfer unit 31*d* constituting a transfer mechanism, cleaning apparatus (cleaning mechanism) 31*e*, a charge-removing unit (not shown), and charging unit 31*f*. Developer apparatus 31*c* uses toner (i.e., a substance for making the latent image manifest) to develop the latent electrostatic image formed on the surface of photosensitive drum 31*b* and produce a visible image. Transfer unit 31*d* transfers the toner image formed on the surface of photosensitive drum 31*b* onto recording paper P, which serves as recording medium. Cleaning apparatus 31*e* removes toner residue from the surface of photosensitive drum 31*b* following toner transfer. The charge-removing unit removes any charge remaining on the surface of photosensitive drum 31*b*. Charging unit 31*f* charges the surface of photosensitive drum 31*b* to a prescribed electric potential prior to formation of the latent electrostatic image.

When forming an image on recording paper P, therefore, charging unit 31*f* causes the surface of photosensitive drum 31*b* to be charged to a prescribed electric potential, and laser scanning unit 31*a* irradiates the surface of photosensitive drum 31*b* with laser light based on original image data. Developer apparatus 31*c* then develops a visible toner image on the surface of photosensitive drum 31*b*, and transfer unit 31*d* causes the toner image to be transferred to recording paper P. In addition, cleaning apparatus 31*e* then removes toner residue from the surface of photosensitive drum 31*b*, and the charge-removing unit removes any charge remaining on the surface of photosensitive drum 31*b*. This concludes one cycle of image forming operations (printing operations) carried out on recording paper P. By repeating this cycle, it is possible to continuously carry out image formation on a plurality of sheets of recording paper P.

Furthermore, paper transport system 32 transports recording paper P one sheet at a time from automatic-feed cassette mechanism unit 6 or manual-feed mechanism unit 7 which are provided at hybrid paper supply module 5, described below, so as to permit image formation by the aforementioned image forming system 31, and also discharges recording paper P to discharge tray 35 serving as paper discharge unit after image(s) have been formed thereon.

This paper transport system 32 is provided with main transport path 36 and flipping transport path 37. One end of main transport path 36 opposes the discharge side of hybrid paper supply module 5, and the other end thereof opposes discharge tray 35. One end of flipping transport path 37 is connected to main transport path 36 at a point upstream from (below, in the drawing) the location at which transfer unit 31*d* is installed, and the other end thereof is connected to main transport path 36 at a point downstream from (above, in the drawing) the location at which transfer unit 31*d* is installed. Moreover, in the present embodiment, a portion of flipping transport path 37 passes through the interior of hybrid paper supply module 5. For this reason, guide member 37*b*, for forming flipping transport path 37, is provided at the interior of this hybrid paper supply module 5.

In addition, by driving the aforementioned automatic-feed cassette mechanism unit 6 or manual-feed mechanism unit 7, it is possible to cause recording paper P to be fed in intermittent fashion, one sheet at a time, toward printing unit 3 from either mechanism unit 6, 7.

Registration roller(s) 51, provided at hybrid paper supply module 5, is/are arranged at a point upstream from the location at which transfer unit 31*d* is installed in the aforementioned main transport path 36. These registration rollers 51 transport recording paper P while aligning recording paper P with the toner image on the surface of photosensitive drum 31*b*. That is, when recording paper P is fed thereto, these registration rollers 51 temporarily stop transport of the recording paper P, adjusting the timing with which recording paper P is supplied to the region between photosensitive drum 31*b* and transfer unit 31*d* such that the toner image on the surface of photosensitive drum 31*b* is aligned with recording paper P. Note that these registration rollers 51 may be installed at the hybrid device 1 main body instead of at hybrid paper supply module 5. Installed at a point downstream from the location at which transfer unit 31*d* is installed in this main transport path 36 is fuser apparatus 39, which is provided with a pair of fuser rollers 39*a*, 39*b*. Moreover, installed at the downstream end of main transport path 36 is/are discharge roller(s) 36*e* for discharging recording paper P into discharge tray 35.

Arranged at a location at the top end of flipping transport path 37, where flipping transport path 37 joins main transport path 36, is diverter paddle 38. This diverter paddle 38 is capable of being rotated about a horizontal axis between a first position indicated by the solid line in FIG. 1 and a second position which is arrived at as a result of counterclockwise rotation as viewed in the drawing from the first position and which causes access to be opened up to flipping transport path 37. When this diverter paddle 38 is in its first position, recording paper P is transported toward discharge tray 35; and when it is in its second position, it permits recording paper P to be supplied to flipping transport path 37. Transport roller(s) 37*a* is/are arranged in flipping transport path 37; and when recording paper P is supplied to flipping transport path 37 (i.e., when recording paper P is supplied to flipping transport path 37 pursuant to "switchback transport"), recording paper P is transported by these transport rollers 37*a*, recording paper P being flipped at a location upstream of registration rollers 51, and being again transported along main transport path 36 toward transfer unit 31*d*. That is, arrangements are made to permit image formation to be carried out on the back of recording paper P.

Description of Automatic Original Feed Unit 4

Automatic original feed unit 4 will next be described. This automatic original feed unit 4 is constructed so as to permit it to serve as "automatic double-sided original transport apparatus." This automatic original feed unit 4 is capable of being used for moving sheet operation, and is provided with original loading unit(s) comprising original tray 43 and intermediate tray 44 and original discharge tray 45 serving as original discharge unit, and original transport system 46 for transporting originals between respective trays 43, 44, 45.

The aforementioned original transport system 46 is provided with main transport path 47 for transporting original(s) placed in or on original tray 43 to intermediate tray 44 and/or original discharge tray 45 by way of original capturing unit 42; and auxiliary transport path 48 for supplying original(s) to main transport path 47 from intermediate tray 44.

Arranged at the upstream end of main transport path 47 (at a region opposing the discharge side of original tray 43) are original takeup roller(s) 47*a* and separator roller(s) 47*b*. Arranged below separator roller(s) 47*b* is/are separator plate(s) 47*c*, and in accompaniment to rotation of takeup roller 47*a*, one sheet from among the original(s) in original tray 43 is made to pass between this separator roller 47*b* and this separator plate 47*c*, and is supplied to main transport path 47. Arranged at a location downstream of the intersection (region B in the drawing) of main transport path 47 and auxiliary transport path 48 are PS rollers 47*e*, 47*e*. These PS rollers 47*e*, 47*e* supply originals to original capturing unit 42 such that the leading edge of the original is coordinated with the timing with which image capture occurs at scanning unit 2. That is, upon supply of an original thereto, these PS rollers 47*e*, 47*e* temporarily stop transport of the original so as to permit adjustment of the aforementioned timing before supplying the original to original capturing unit 42.

Original capturing unit 42 is provided with glass platen 42*a* and original backpressure plate 42*b*, and when an original supplied thereto by PS rollers 47*e*, 47*e* passes between glass platen 42*a* and original backpressure plate 42*b*, light from the aforementioned exposing light source 21 passes through glass platen 42*a* and irradiates the original. At this time, acquisition of original image data by the aforementioned scanning unit 2 occurs. A restoring force from a coil spring, not shown, is imparted to the back (top) of the aforementioned original backpressure plate 42*b*. This causes original backpressure plate 42*b* to press against and contact glass platen 42*a* with a prescribed force so as to discourage the original from lifting up off of glass platen 42*a* as the original passes through original capturing unit 42.

Provided downstream from glass platen 42*a* are transport rollers 47*f* and original discharge rollers 47*g*. The constitution is such that upon passing over glass platen 42*a*, original(s) is/are discharged to intermediate tray 44 and/or original discharge tray 45 by way of transport rollers 47*f* and original discharge rollers 47*g*.

Arranged between original discharge rollers 47*g* and intermediate tray 44 is intermediate tray pivot plate 44*a*. The pivoting motion of this intermediate tray pivot plate 44*a* being centered on the end thereof which is nearer to intermediate tray 44, intermediate tray pivot plate 44*a* is capable of pivoting between a first position indicated by the solid line in the drawing and a second position arrived at when swung upward from the first position. When intermediate tray pivot plate 44*a* is in its second position, originals discharged by original discharge rollers 47*g* are recovered into original discharge tray 45. On the other hand, when intermediate tray pivot plate 44*a* is in its first position, originals discharged by original discharge rollers 47*g* are discharged into intermediate tray 44. When an original is discharged to this intermediate tray 44, the edge of the original is held in the nip between original discharge rollers 47*g*, 47*g*; and with the original in this state, original discharge rollers 47*g* then rotate in reverse fashion, causing the original to be supplied to auxiliary transport path 48, and after traveling through this auxiliary transport path 48, the original is again delivered to main transport path 47. Operations whereby these original discharge rollers 47*g* are made to rotate in reverse fashion are carried out such that delivery of the original to main transport path 47 is coordinated with the timing with which image capture occurs. This make it possible for original capturing unit 42 to capture an image of the back of the original.

Description of Basic Operation of Hybrid Device

Operation of a hybrid device 1 having the foregoing constitution will now be described. First, when functioning as a printer, hybrid device 1 receives print data (image data and/or text data) sent thereto from a personal computer or other such host device, and temporarily stores this received print data in buffer(s) (memory or memories), not shown. Along with such storage of print data to buffer, print data is sequentially read from buffer; and based on the print data read therefrom, image formation is carried out on recording paper P by virtue of image forming operations taking place at the aforementioned printing unit 3.

Furthermore, when functioning as a scanner, hybrid device 1 temporarily stores, in buffer(s), scan image data of original(s) captured by the aforementioned scanning unit 2. Along with such storage of scan image data to buffer, scan image data is sequentially sent from buffer to host apparatus, image(s) thereof being displayed on a display or the like at this host apparatus. Note that when hybrid device 1 functions as a facsimile device, this scan image data would be sent to a regular public line.

Moreover, when functioning as a copier, hybrid device 1 temporarily stores, in buffer(s), image formation is carried out on recording paper P by virtue of image forming operations taking place at printing unit 3 based on original image data captured by means of the foregoing scanner function.

Description of Hybrid Paper Supply Module 5

Figure 2:
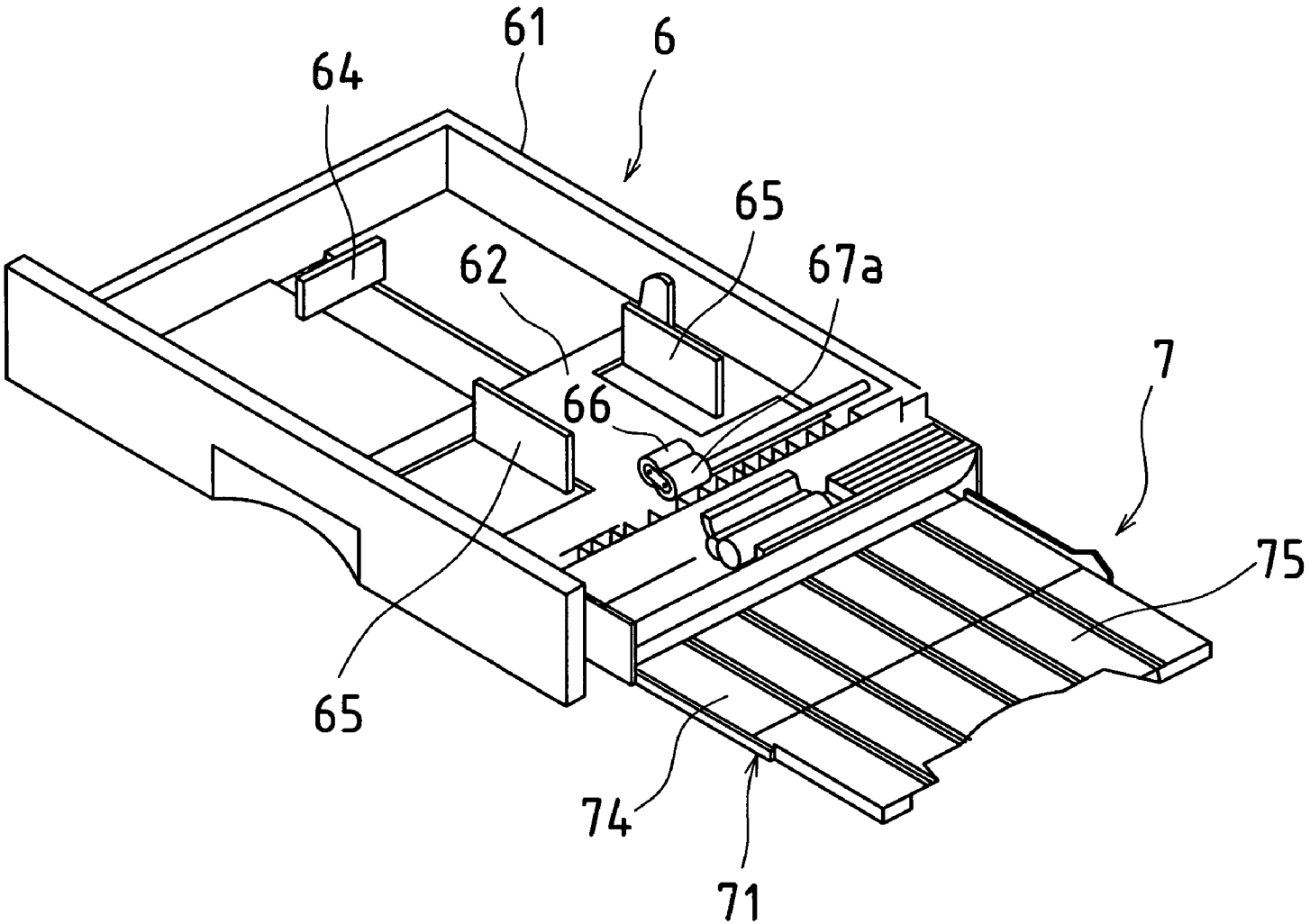
FIG. 2 is an oblique partial cutaway view of a hybrid paper supply module associated with the first embodiment.

The aforementioned hybrid paper supply module 5, being a characteristic feature of the present embodiment, will next be described. FIG. 2 is an oblique partial cutaway view of automatic-feed cassette mechanism unit 6 and manual-feed mechanism unit 7 of hybrid paper supply module 5 provided at the present hybrid device 1. Furthermore, FIG. 3 is a drawing showing in schematic fashion a simplified rendering of the constitution at the interior of this hybrid paper supply module 5.

As shown in the respective drawings, hybrid paper supply module 5 is constructed such that the foregoing automatic-feed cassette mechanism unit 6 and manual-feed mechanism unit 7 are contained within module casing 52, which constitutes the housing of the present module 5. Moreover, whereas automatic-feed cassette mechanism unit 6 is provided with automatic-feed cassette 61 which is capable of storing a multiplicity of sheets (e.g., 500 sheets) of recording paper, manual-feed mechanism unit 7 is provided with manual-feed tray 71 which is such as to permit one or a small number of sheets of recording paper to be placed therein or thereon in a manual operation carried out by the user. In other words, this automatic-feed cassette 61 and this manual-feed tray 71 are contained within module casing 52, forming a single module and constituting the present hybrid paper supply module 5. Description of the respective mechanism units 6, 7 follows below.

Description of Automatic-Feed Cassette Mechanism Unit 6

Figure 3:
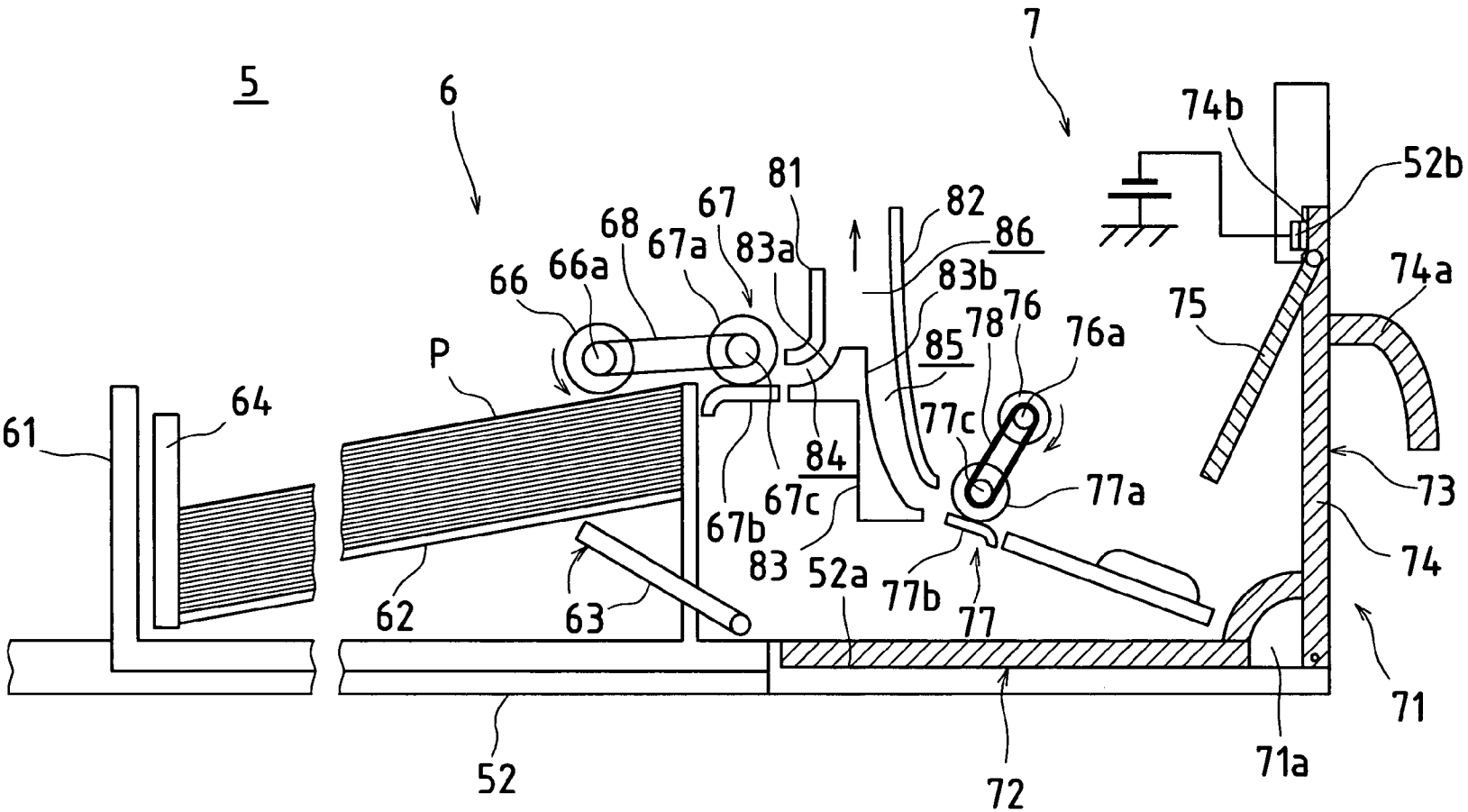
FIG. 3 is a drawing showing in schematic fashion a simplified rendering of the constitution at the interior of a hybrid paper supply module associated with the first embodiment.

As shown in FIGS. 2 and 3, automatic-feed cassette mechanism unit 6 is provided with the aforementioned automatic-feed cassette 61 constructed in the form of a container which is open at the top; and pivotably supported at the interior of this automatic-feed cassette 61 is pivot plate 62, which is made of metal and serves as paper storage plate. In addition, this automatic-feed cassette 61 is capable of being pulled outward from the aforementioned module casing 52 and toward the front side (the near side at FIG. 1) of hybrid device 1, procedures for replenishing this automatic-feed cassette 61 with recording paper being made possible when this automatic-feed cassette 61 has been pulled outward therefrom.

The aforementioned pivot plate 62 is supported so as to permit it to pivot in a vertical direction about a pivot shaft extending in the direction of the width (i.e., perpendicular to the plane of the paper in FIG. 3) of automatic-feed cassette 61, and the bottom thereof is abutted by lift plate 63 which is imparted with an upward torque. In other words, as a result of the restoring force from lift plate 63, this pivot plate 62 is constantly acted upon by an upward restoring force. Note that a coil spring may be provided instead of this lift plate 63, in which case it would be the restoring force from the coil spring that would cause this pivot plate 62 to constantly be acted upon by an upward restoring force.

Furthermore, provided at one end (the right end in FIG. 3) within automatic-feed cassette 61 are paper lead edge alignment tabs, not shown, for pressing against the lead edge of recording paper P and aligning this recording paper P, and the corners of the lead edge of recording paper P are pressed downward from above by these paper lead edge alignment tabs. For this reason, when recording paper P is loaded within automatic-feed cassette 61, pivot plate 62 pivots upward due to the restoring force from lift plate 63, the rotational position thereof being constrained at the position at which the corners of the lead edge of recording paper P abut the paper lead edge alignment tabs. With automatic-feed cassette 61 in this state it is pushed into module casing 52; and as a result, a multiplicity of sheets of recording paper are loaded into automatic-feed cassette mechanism unit 6.

Furthermore, paper trail edge guide member 64, which positions the trail edge of recording paper P in the feed direction, is provided at the interior of the aforementioned automatic-feed cassette 61 in such manner as to permit sliding motion in parallel fashion with respect to the feed direction of recording paper P. Furthermore, paper side edge guide members 65, 65, for positioning the two edges of recording paper P at sides perpendicular to the feed direction, are also provided in such manner as to permit sliding motion (or so as to permit repositioning as a result of removal and reinstallation). Note that hybrid paper supply module 5 associated with the present embodiment stores recording paper P such that it is centered in the paper width direction. For this reason, respective paper side edge guide members 65, 65 are supported by a sliding mechanism, not shown, causing them to slide so as to mutually approach or recede in synchronous fashion.

Respectively provided at the paper discharge side of automatic-feed cassette mechanism unit 6 are paper separator mechanism 67 and takeup roller(s) 66 constituting a paper takeup mechanism.

The aforementioned paper separator mechanism 67 is equipped with separator roller(s) 67*a* and separator plate(s) 67*b*. Separator plate 67*b* is such that the force of friction between the top surface thereof (the surface coming in contact with recording paper P) and recording paper P is set so as to be greater than the force of friction between sheets of recording paper P, P. Furthermore, at separator roller 67*a*, the force of friction between this separator roller 67*a* and recording paper P is set so as to be greater than the force of friction between the top surface of separator plate 67*b* and recording paper P and greater than the force of friction between respective sheets of recording paper P, P. For this reason, even if multiple sheets of recording paper P, P, . . . are taken up from automatic-feed cassette 61 and are fed to paper separator mechanism 67, separator roller 67*a* will be able to separate these multiple sheets of recording paper P, P, . . . and feed only the topmost sheet of recording paper P to transport path(s).

Pulleys 67*c*, 66*a* are respectively provided on the shafts of the aforementioned separator roller 67*a* and takeup roller 66, belt 68 spanning these pulleys 67*c*, 66*a*. In addition, drive force from a drive motor, not shown, is transmitted to separator roller 67*a*, and the motor drive force transmitted to this separator roller 67*a* is transmitted to takeup roller 66 by way of belt 68. Furthermore, the shafts of this separator roller 67*a* and this takeup roller 66 are supported by the same support plate (depiction of which is omitted in FIG. 3); and in accompaniment to transmission of drive force from the aforementioned motor to separator roller 67*a*, this support plate pivots (rotating in counterclockwise fashion as viewed in FIG. 3) about the shaft of separator roller 67*a*, causing takeup roller 66 to press against the top surface of recording paper P within automatic-feed cassette 61 (the situation existing following conclusion of such pivoting being shown in FIG. 3). In other words, the constitution is such that in accompaniment to driving of the aforementioned motor, takeup roller 66 presses against recording paper P within automatic-feed cassette 61 and takes up recording paper P from this automatic-feed cassette 61; and separation of recording paper P being carried out by paper separator mechanism 67, only one sheet of recording paper P is fed from automatic-feed cassette 61 to the paper transport path.

Description of Manual-Feed Mechanism Unit 7

As shown in FIGS. 2 and 3, manual-feed mechanism unit 7 is provided with the aforementioned manual-feed tray 71 which is capable of being pulled outward from the aforementioned module casing 52 and toward the side (the right side at FIG. 1) of hybrid device 1. As shown in FIG. 3, this manual-feed tray 71 is equipped with tray base 72, which is supported so as to permit movement in parallel fashion with respect to groove 52*a* formed in module casing 52; and manual-feed tray main body 73, which is supported so as to permit it to pivot relative to this tray base 72 by means of pivot shaft(s) extending horizontally.

Moreover, this manual-feed tray main body 73 is equipped with first tray 74, which is supported so as to permit it to pivot relative to tray base 72 by means of pivot shaft(s) extending horizontally; and second tray 75, which is supported so as to permit it to pivot relative to the tip (the top end when in its stored state as shown in FIG. 3) of this first tray 74.

Figure 4:
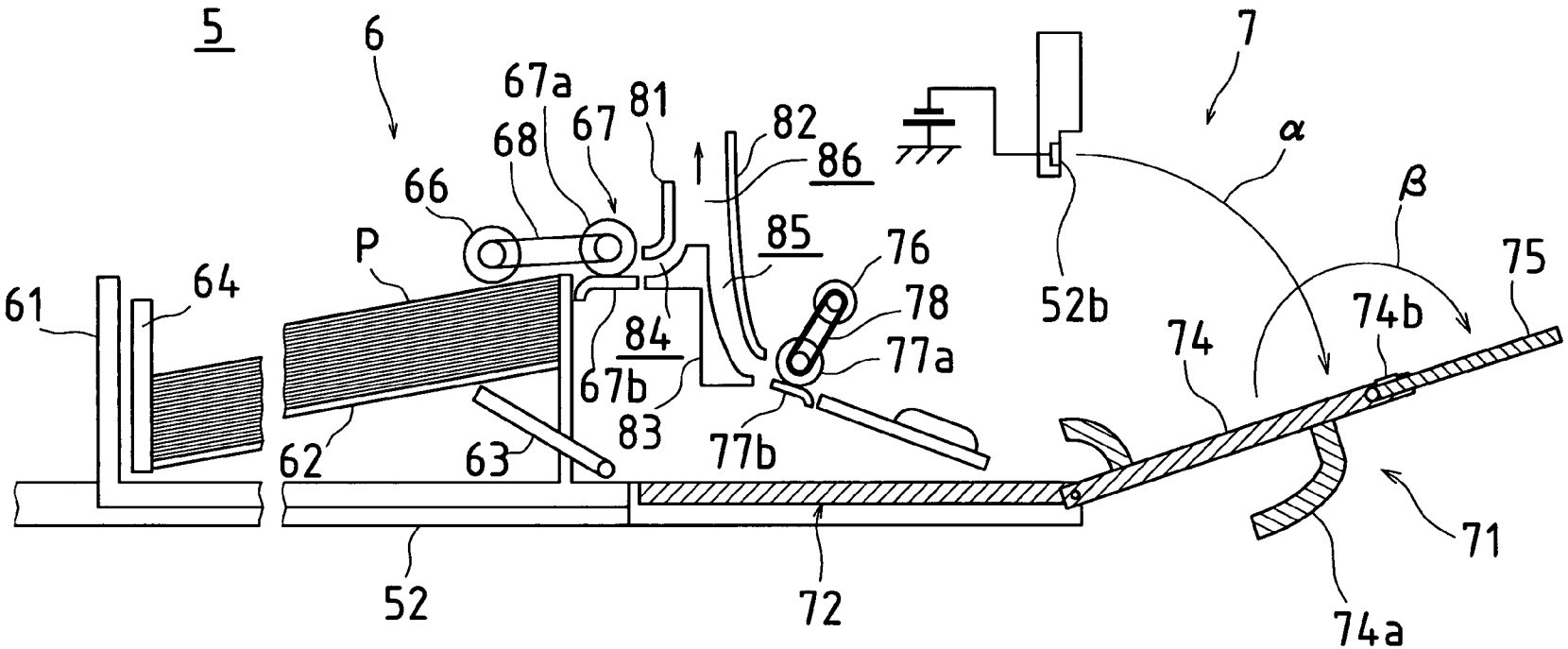
FIG. 4 is a drawing corresponding to FIG. 3 and showing a manual-feed tray in its opened state.

This being the case, in the event that paper is to be supplied from the present manual-feed mechanism unit 7, first tray 74 is rotated (a in FIG. 4) toward one side of the apparatus relative to tray base 72, and furthermore, second tray 75 is made to pivot (β in FIG. 4) toward one side of the apparatus relative to first tray 74. As a result, as shown in FIG. 4, the respective inside surfaces of first tray 74 and second tray 75 are made to lie in a single plane and face upward, permitting placement (manual loading) of recording paper P thereon over a region extending from first tray 74 to second tray 75. Moreover, the aforementioned first tray 74 is provided with grip region 74*a* which is located on the side of the outside surface of the apparatus when first tray 74 is in its stored state as shown in FIG. 3, and by grabbing this grip region 74*a* and causing first tray 74 to swing downward and to the side of the apparatus, a user can cause this first tray 74 to assume its opened state.

This grip region 74*a* is formed by a small projection formed in the central region of the outside surface of first tray 74, and by grabbing this grip region 74*a* with his or her finger and pivoting first tray 74 downward, a user can cause deployment (pivoting) of only first tray 74 without causing sliding motion of manual-feed mechanism unit 7.

Furthermore, the aforementioned manual-feed tray 71 is provided with a pair of guide members 79, 79 (see FIG. 1; not shown in FIG. 2) constraining placement location(s) of recording paper P placed therein or thereon by abutting against respective edges of recording paper P in the width direction (i.e., the edges extending in the direction of transport of the recording paper P placed therein or thereon), these guide members 79, 79 being supported so as to permit movement in sliding fashion in or on manual-feed tray 71. At this manual-feed tray 71 as well, placement of recording paper P is such that it is centered in the paper width direction. For this reason, respective guide members 79, 79 are supported by a sliding mechanism, not shown, causing them to slide so as to mutually approach or recede in synchronous fashion.

Furthermore, manual-feed mechanism unit 7 of the present embodiment is such that it permits operations for opening of first tray 74 to be carried out automatically. More specifically, small metal piece 74*b* is attached to the tip region of the inside surface of first tray 74 (i.e., the top surface when in its opened state as shown in FIG. 4), and electromagnet 52*b* is provided at a location which is on the side surface of module casing 52 and which opposes the aforementioned metal piece 74*b* when first tray 74 is in its stored state. A DC power supply is connected to this electromagnet 52*b*, the electromagnet being energized when electricity flows therethrough, electromagnetic attraction for the aforementioned metal piece 74*b* causing first tray 74 to be maintained in its stored state. Furthermore, when the user operates a control panel of hybrid device 1 or there is otherwise a request for supply of paper from manual-feed mechanism unit 7, electromagnet 52*b* is deenergized, eliminating its electromagnetic attraction for the aforementioned 74*b* and causing first tray 74 to pivot under its own weight so as to cause it to go from its stored state to its opened state.

Furthermore, formed at the bottom end of the aforementioned manual-feed tray 71 is second grip region 71*a* serving as opening grip region. This grip region 71*a* is formed by a concave region which is such that the concavity is thereabove when first tray 74 is in its closed state as shown in FIG. 3, and by inserting his or her finger in this grip region 71*a* and pulling outward and to the side of the apparatus (toward the right in FIG. 3), a user can cause the entirety of manual-feed mechanism unit 7 to be pulled outward, opening up the interior of hybrid paper supply module 5 to the exterior (see FIG. 5). More specifically, this second grip region 71*a* comprises a small projection provided at the bottom end of the inside surface of first tray 74, a space for insertion of the user's finger being formed between first tray 74 and second grip region 71*a*. In addition, by inserting his or her finger in this insertion space and pulling first tray 74 to one side of the apparatus, a user can cause the entirety of manual-feed mechanism unit 7 to be pulled outward (moving it in sliding fashion), opening up the interior of hybrid paper supply module 5 to the exterior. Note that this opened state is described below.

Respectively provided at the paper discharge side of the present manual-feed mechanism unit 7 are paper separator mechanism 77 and paper pickup roller(s) 76 constituting a paper takeup mechanism.

The aforementioned paper separator mechanism 77 is equipped with separator roller(s) 77*a* and separator plate(s) 77*b*. As the constitution of these is similar to that at the aforementioned paper separator mechanism 67 provided at automatic-feed cassette mechanism unit 6, description is omitted here.

In addition, pulleys 77*c*, 76*a* are respectively provided on the shafts of the aforementioned separator roller 77*a* and paper pickup roller 76, belt 78 spanning these pulleys 77*c*, 76*a*. In addition, drive force from a drive motor, not shown, is transmitted to separator roller 77*a*, and the motor drive force transmitted to this separator roller 77*a* is transmitted to paper pickup roller 76 by way of belt 78. Furthermore, the shafts of this separator roller 77*a* and this paper pickup roller 76 are supported by the same support plate (not shown); and in accompaniment to transmission of drive force from the aforementioned motor to separator roller 77*a*, this support plate pivots about the shaft of separator roller 77*a*, causing paper pickup roller 76 to press against the top surface of recording paper P lying on manual-feed tray 71. In other words, the constitution is such that in accompaniment to driving of the aforementioned motor, paper pickup roller 76 presses against recording paper P lying on manual-feed tray 71 and takes up recording paper P from this manual-feed tray 71; and separation of recording paper P being carried out by paper separator mechanism 77, only one sheet of recording paper P is fed from manual-feed tray 71 to the paper transport path.

Paper Supply Path

Next, the paper supply path (the path internal to hybrid paper supply module 5) for transporting toward main transport path 36 recording paper P that has been taken up by automatic-feed cassette mechanism unit 6 or manual-feed mechanism unit 7, having constitutions as described above, will be described.

This paper supply path is made up of first through third guide members 81, 82, 83. First guide member 81 is made up of a plate which is curved so as to be directed vertically upward from a point immediately downstream from separator roller 67*a* of the aforementioned automatic-feed cassette mechanism unit 6. Furthermore, second guide member 82 is made up of a plate which is curved so as to be directed vertically upward from a point immediately downstream from separator roller 77*a* of the aforementioned manual-feed mechanism unit 7. Moreover, third guide member 83, located between the aforementioned first guide member 81 and second guide member 82, is provided with first curved surface 83*a*, which opposes the lower portion of first guide member 81; and second curved surface 83*b*, which opposes the lower portion of second guide member 82.

As a result of the foregoing constitution, first path 84, by means of which the direction of transport of recording paper P taken up from automatic-feed cassette mechanism unit 6 is directed upward, is formed between first guide member 81 and first curved surface 83*a* of third guide member 83; and furthermore, second path 85, by means of which the direction of transport of recording paper P taken up from manual-feed mechanism unit 7 is directed upward, is formed between second guide member 82 and second curved surface 83*b* of third guide member 83. In addition, common path 86, extending vertically upward, is formed between the aforementioned first guide member 81 and second guide member 82; the aforementioned first path 84 and second path 85 being such that the downstream ends thereof are mutually connected and intersect at common path 86. That is, recording paper P, whether taken up from automatic-feed cassette mechanism unit 6 or manual-feed mechanism unit 7, after passing through the aforementioned common path 86 provided at the interior of hybrid paper supply module 5, is introduced into main transport path 36 and arrives at printing unit 3, where prescribed image forming operation take place. Accordingly, there is only one path (main transport path 36) by which recording paper P is discharged in going toward printing unit 3 from hybrid paper supply module 5, eliminating the need to have two paths at the hybrid device 1 main body such as would be the case were there one path for the automatic-feed cassette and another path for the manual-feed tray. This being the case, not only is it possible to shorten the length of the overall transport path of hybrid device 1 and achieve simplification of the constitution at the interior of hybrid device 1, but it is also possible to reduce the number of locations at which paper jams can occur, and it is possible to reduce the frequency of occurrence of paperjams.

Figure 5:
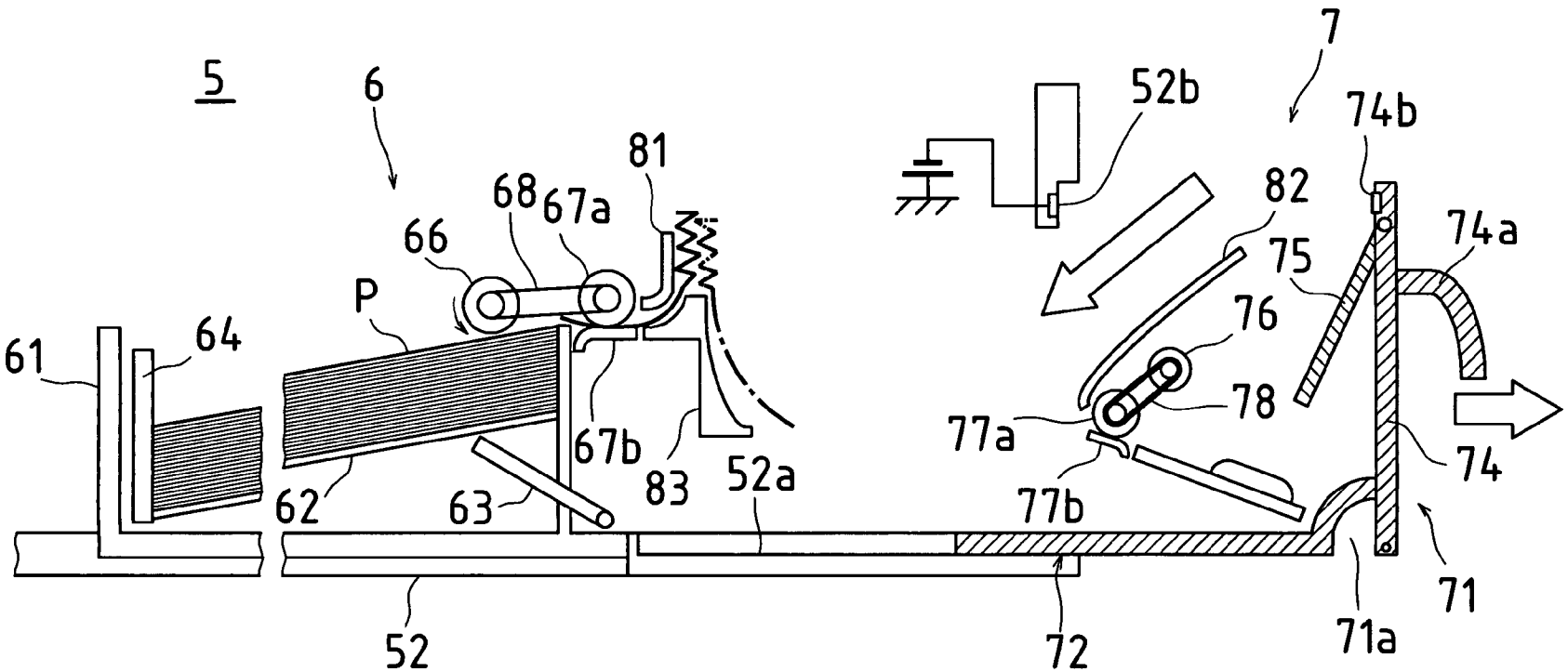
FIG. 5 is a drawing corresponding to FIG. 3 and showing a manual-feed mechanism unit that has been pulled outward at a time when a paper jam has occurred.

Furthermore, whereas the aforementioned first guide member 81 and third guide member 83 are supported by the aforementioned module casing 52, second guide member 82 is provided in such fashion that it is integral with the aforementioned manual-feed mechanism unit 7. In other words, when manual-feed mechanism unit 7 is pulled outward as indicated at FIG. 5, this second guide member 82 is pulled away from module casing 52 together with manual-feed mechanism unit 7. This being the case, access is opened up to common path 86 constituted by the space between same and first guide member 81, and to second path 85 constituted by the space between same and third guide member 83; making it possible to easily carry out procedure(s) for removal of paper in the event of occurrence of paper jam(s) at such paths. Of the recording paper P involved in jams in FIG. 5, that shown with a solid line indicates jamming of recording paper P transported thereto from automatic-feed cassette mechanism unit 6, and that shown with an alternating long and short chain line indicates jamming of recording paper P transported thereto from manual-feed mechanism unit 7.

Furthermore, the aforementioned second guide member 82 is provided with a pivot mechanism, not shown, such that second guide member 82 extends vertically so as to form the aforementioned respective paths when, as shown in FIGS. 3 and 4, manual-feed mechanism unit 7 is not pulled outward therefrom; but such that second guide member 82 leans toward manual-feed tray 71, thus enlarging the space within which the user can insert his or her hand during removal of jammed paper (the direction in which the user's hand is inserted being indicated by an arrow at FIG. 5), when, as shown in FIG. 5, manual-feed mechanism unit 7 is pulled outward therefrom.

Paper Feed Operations

Figure 6:
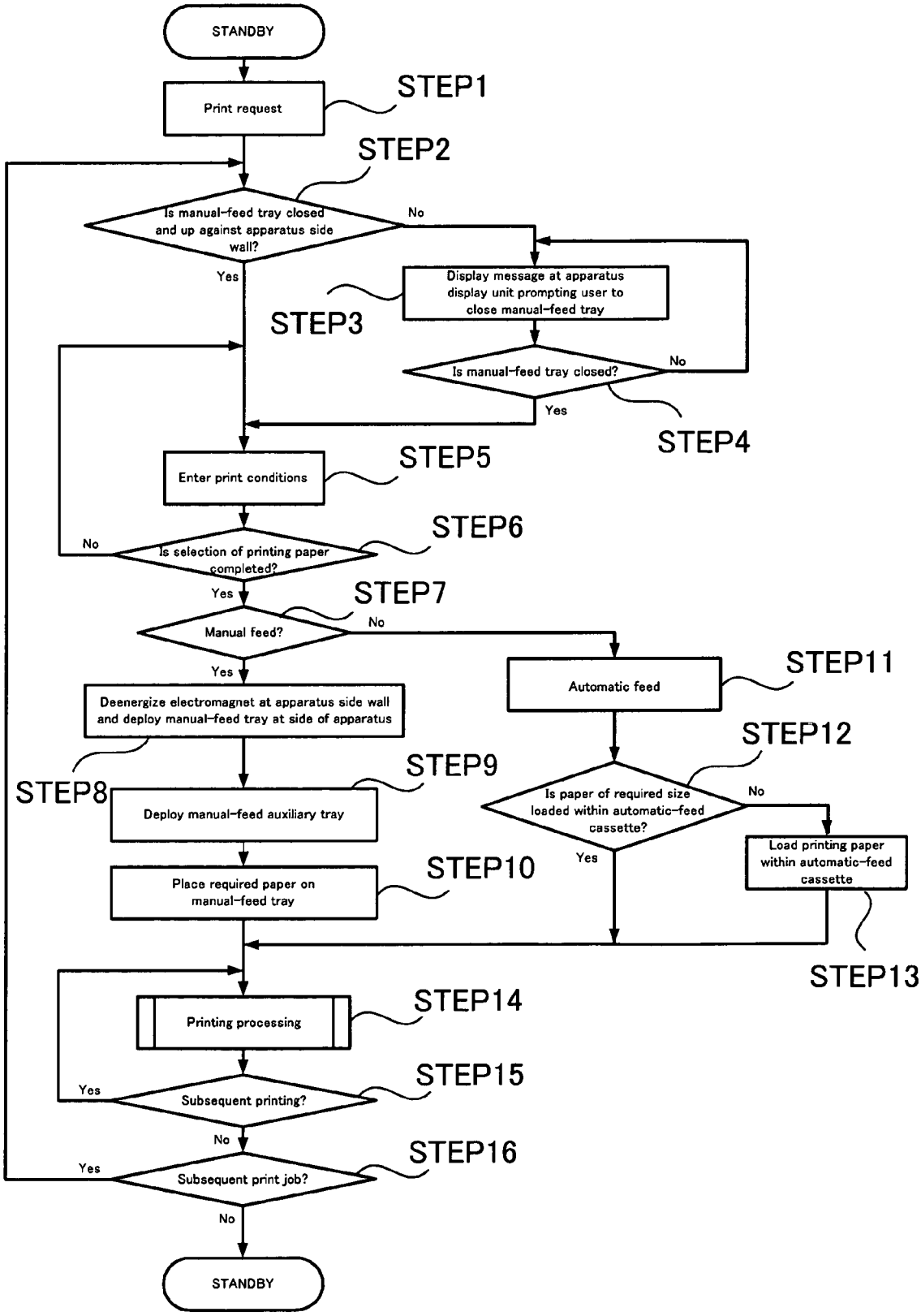
FIG. 6 is a flowchart for explaining paper feed operations carried out by a hybrid paper supply module associated with the first embodiment.

Following the flowchart of FIG. 6, paper feed operations carried out by hybrid paper supply module 5 having the foregoing constitution will next be described.

First, if at STEP1 the user operates a control panel of hybrid device 1 (or operates a host device connected thereto) or there is otherwise a request to carry out printing, then at STEP2 determination is made as to whether manual-feed tray 71 of manual-feed mechanism unit 7 is in its stored state; i.e., whether manual-feed mechanism unit 7 is closed off by the side wall of hybrid paper supply module 5. If manual-feed tray 71 is not in its stored state, i.e., if manual-feed tray 71 is in its opened state, then processing proceeds to STEP3, at which notice is given at a display unit (display panel) of the apparatus that manual-feed tray 71 should be put into its stored state (i.e., that manual-feed mechanism unit 7 should be closed). Furthermore, if at STEP4 it is detected that manual-feed tray 71 has been stored (manual-feed mechanism unit 7 has been closed), then processing proceeds to STEP5.

The user enters print conditions (STEP5); and upon selection of printing paper (i.e., the type of recording paper P to be used for image formation), the value at STEP6 goes to YES, and processing proceeds to STEP7. Here, determination is carried out as to whether the selected print conditions are such that the paper supply source is manual-feed mechanism unit 7. If this is determined to be YES, then processing proceeds to STEP8, at which the aforementioned electromagnet 52*b* is turned OFF, opening manual-feed tray 71 of manual-feed mechanism unit 7 (i.e., manual-feed tray 71 swings down from the side of hybrid paper supply module 5: arrow α in FIG. 4). Furthermore, after, where necessary, carrying out (at STEP9) a procedure (arrow β in FIG. 4) in which second tray 75 serving as auxiliary tray is made to pivot (i.e., is opened), recording paper P is placed on manual-feed tray 71 (STEP10), and processing proceeds to STEP14.

Conversely, if the answer as determined at STEP7 is NO, then it is determined (STEP11) that the paper supply source pursuant to the selected print conditions is automatic-feed cassette mechanism unit 6; and at STEP12, determination is carried out as to whether recording paper P of the required size (recording paper P consistent with the foregoing print conditions) is present within automatic-feed cassette 61 of automatic-feed cassette mechanism unit 6. If the result of this determination is YES, then processing proceeds to STEP14; but if the result of this determination is NO, then at STEP13 the user carries out operations for loading of recording paper P consistent with print conditions, following which processing proceeds to STEP14. As examples of this determination as to whether recording paper P consistent with print conditions is loaded therein, paper sensor(s) might be provided at automatic-feed cassette 61, and type(s) (size(s) and/or orientation(s)) of loaded recording paper P might be detected by such sensor(s) and displayed at display panel(s), with determination being carried out pursuant to confirmation of such display by the user; or a warning might be issued to the user in the event that type(s) of recording paper P loaded in automatic-feed cassette 61 as confirmed by hybrid device 1 is/are different from type(s) of recording paper P at the foregoing print conditions, prompting the user to carry out operations for loading of recording paper P consistent with print conditions; and so forth.

Moreover, printing processing is carried out at STEP14; and after paper has been supplied from the desired mechanism unit and image forming has at printing unit 3 been carried out on that recording paper P, operations are carried out for discharge thereof to discharge tray 35.

After printing operations have been carried out on this single sheet of recording paper P, determination is made at STEP 15 as to whether there is subsequent printing to be carried out (i.e., whether subsequent print information exists); the operations at STEPS 14 and 15 being carried out in repeated fashion until subsequent print information does not exist. Moreover, when subsequent print information no longer exists, determination is carried out at STEP16 as to whether subsequent print job(s) exist; and in the event that there is/are subsequent print job(s), processing returns to STEP2; the foregoing operations being carried out in repeated fashion until subsequent print job(s) no longer exist.

Benefits of Embodiment

As has been described above, in the present embodiment, automatic-feed cassette mechanism unit 6 and manual-feed mechanism unit 7 together constitute a single integral hybrid paper supply module 5. This being the case, it is possible for manual-feed mechanism unit 7 to be arranged such that it is stacked vertically with respect to main transport path 36 and flipping transport path 37 which extend so as to be directed toward printing unit 3 of hybrid device 1, as a result of which it is possible to shorten dimension(s) of hybrid device 1 and achieve reduction in the amount of space required for installation.

Furthermore, this hybrid paper supply module 5 makes it possible to cause the path along which recording paper P taken up from automatic-feed cassette mechanism unit 6 is transported and the path along which recording paper P taken up from manual-feed mechanism unit 7 is transported to intersect at the interior of module 5, and makes it possible to decrease the lengths of the respective paths. This being the case, the length of the overall paper transport path of the apparatus can be shortened, the number of locations at which paper jams can occur can be reduced, and image forming operations at the apparatus can be carried out in stable fashion.

Second Embodiment

Figure 7:
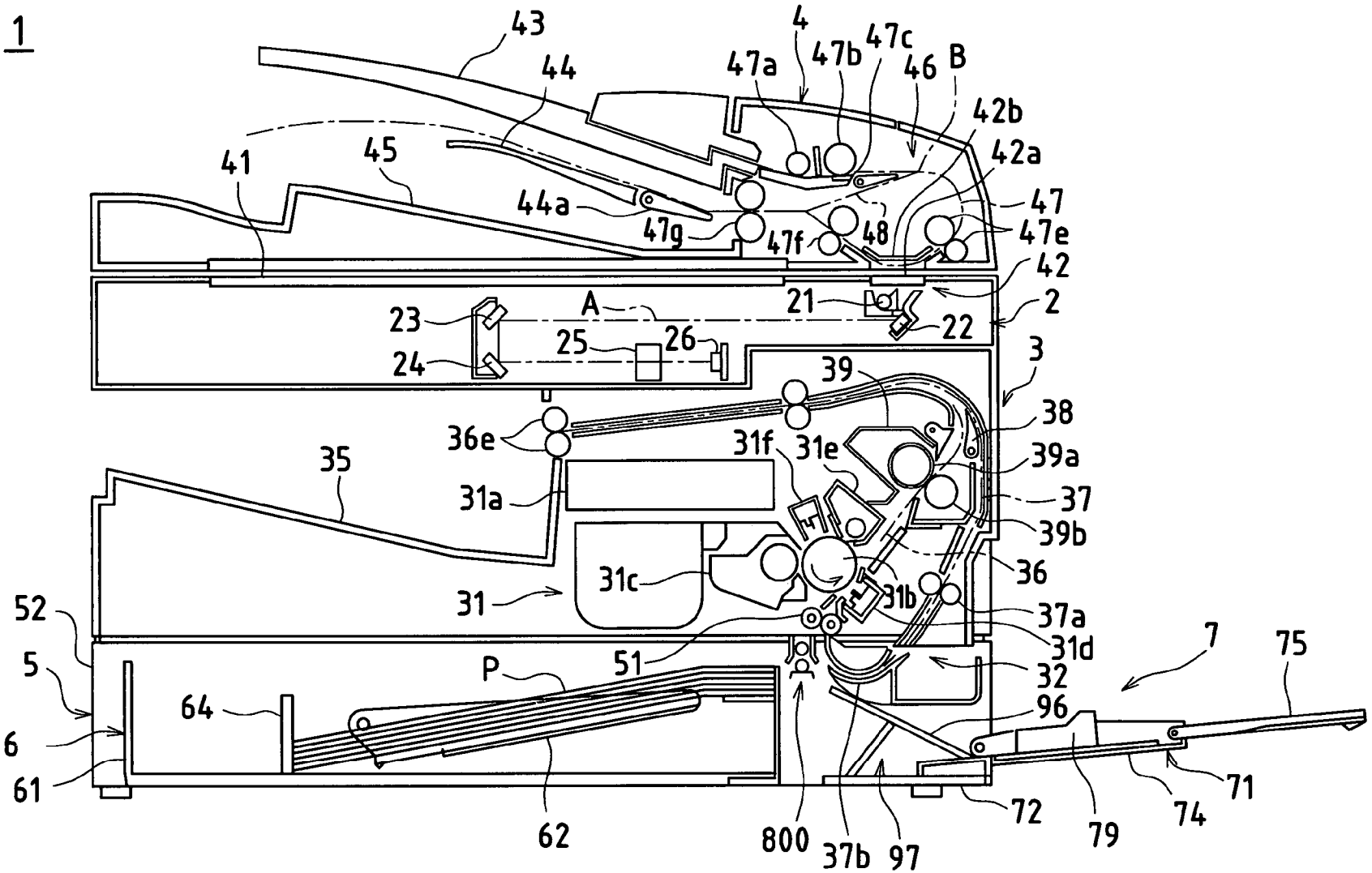
FIG. 7 is a drawing showing in schematic fashion the internal constitution of a hybrid device associated with a second embodiment of the present invention.
Figure 8:
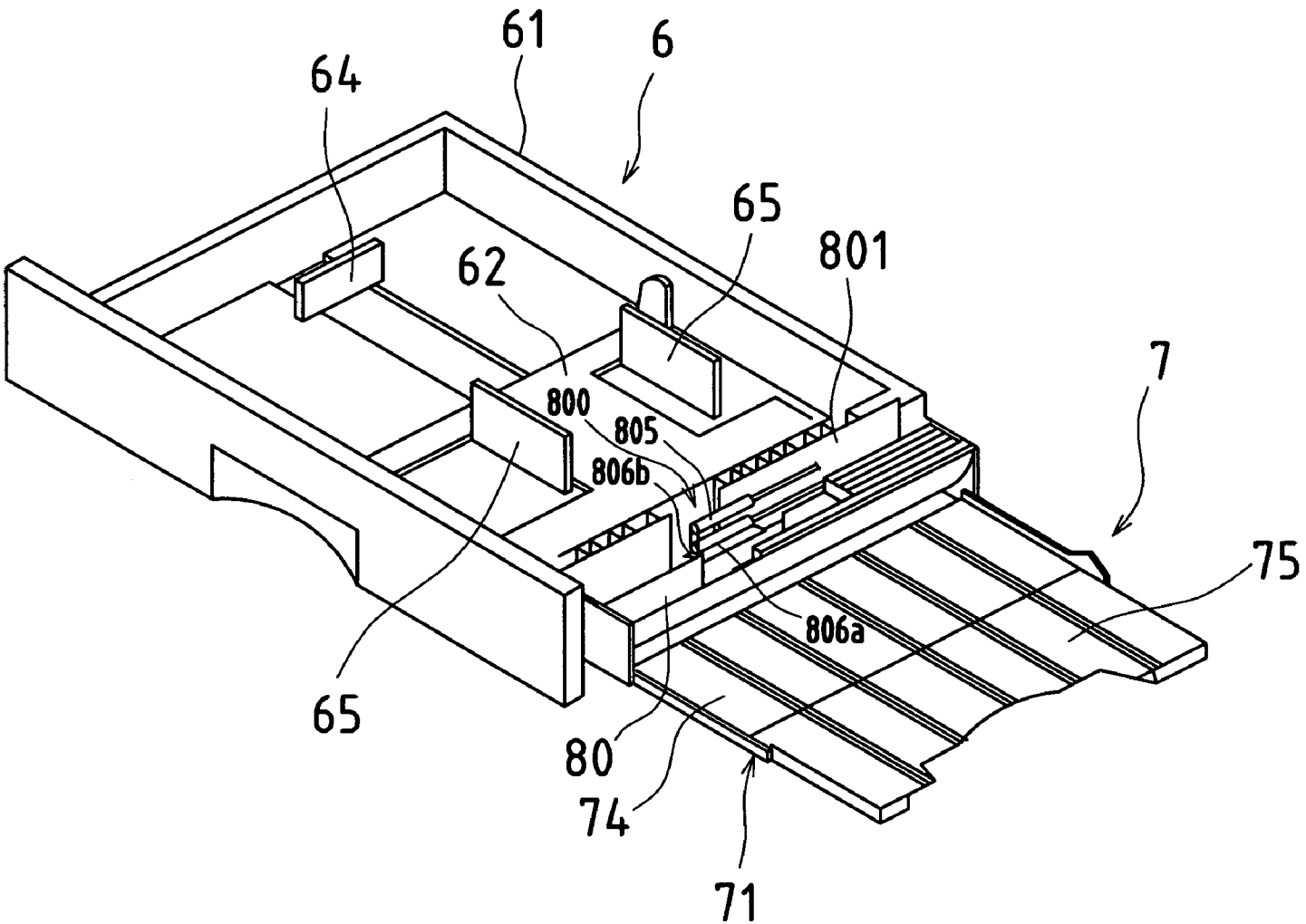
FIG. 8 is an oblique partial cutaway view of a hybrid paper supply module associated with the second embodiment.

FIG. 7 is a drawing showing in schematic fashion the internal constitution of a hybrid device associated with a second embodiment of the present invention. At the sections entitled "Description of Overall Constitution of Hybrid Device" and "Description of Basic Operation of Hybrid Device," where the constitution of the present embodiment is similar to that of the first embodiment, like reference numerals will be used and description will be omitted. Below, detailed description is carried out with respect to characteristic aspects of the second embodiment.

Figure 10:
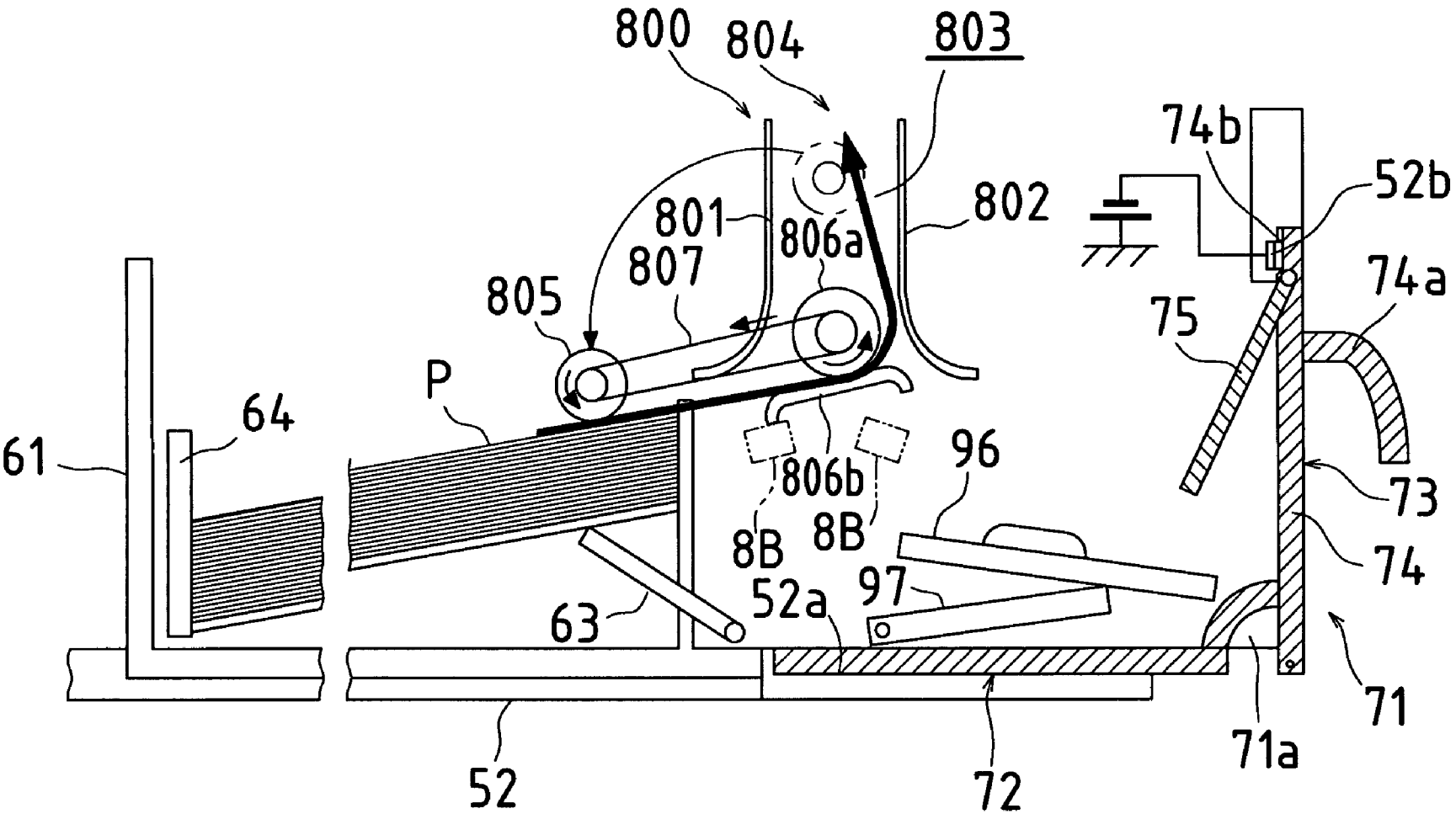
FIG. 10 is a drawing corresponding to FIG. 9 and showing supply of paper from an automatic-feed cassette.
Figure 11:
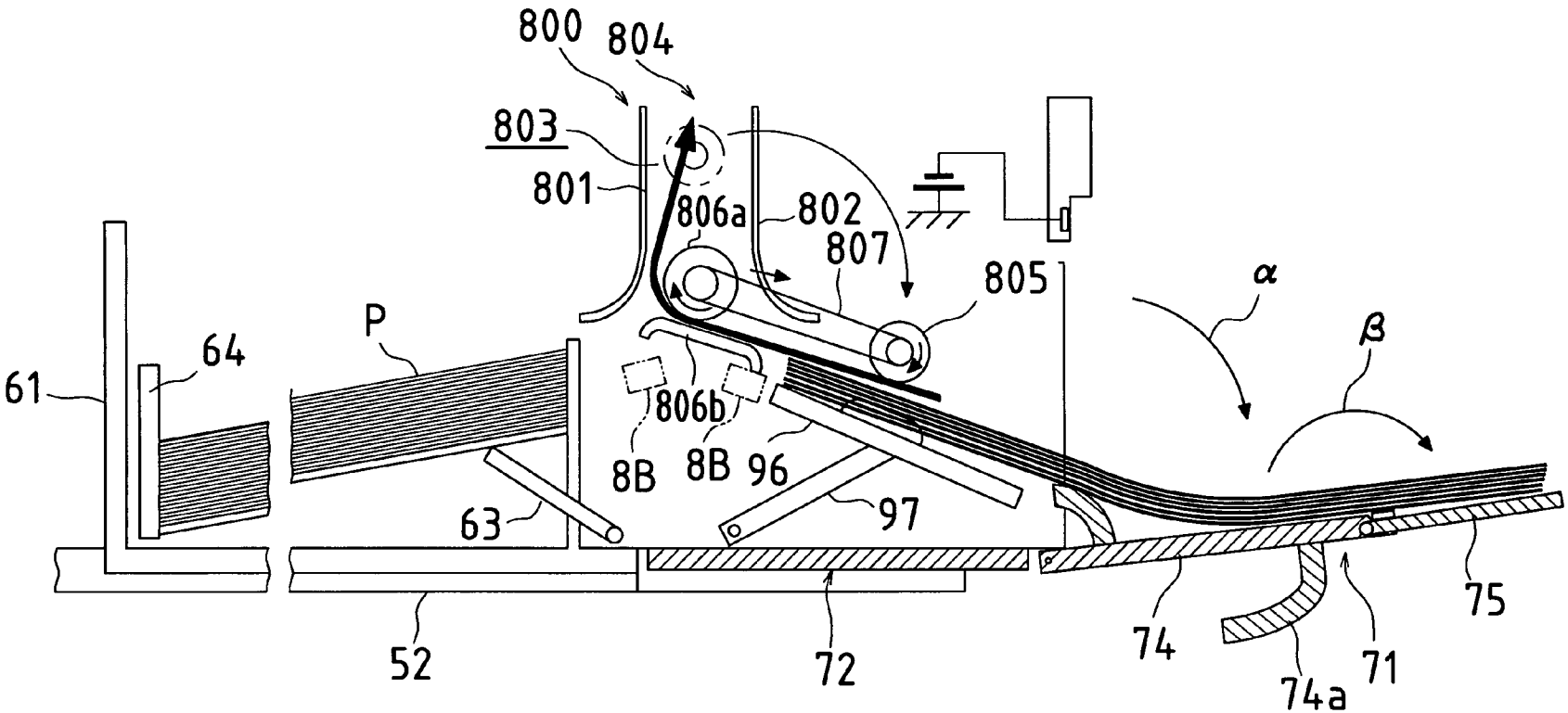
FIG. 11 is a drawing corresponding to FIG. 9 and showing supply of paper from a manual-feed tray.

Pivotably supported above the aforementioned tray base 72 is guide plate 96 for guiding recording paper P placed on manual-feed tray 71 to feed mechanism 800, described below. This guide plate 96 is supported so as to permit it to pivot in a vertical direction about a pivot shaft extending in the direction of the width (i.e., perpendicular to the plane of the paper in FIG. 9) of tray base 72, and the bottom thereof is abutted by lift plate 97 which is constituted so as to permit delivery of an upward torque (e.g., a torque produced through use of an electromagnetic solenoid or other such drive source). Whereas during supply of paper from automatic-feed cassette mechanism unit 6 as shown in FIG. 10 this lift plate 97 lies at an angle such that no upward torque is imparted to guide plate 96, during supply of paper from manual-feed mechanism unit 7 as shown in FIG. 11 this lift plate 97 pivots upward so as to impart an upward torque to guide plate 96. Thus, as a result of being acted upon by an upward torque, guide plate 96 assumes a state in which it is capable of guiding recording paper P placed on manual-feed tray 71 to feed mechanism 800.

Feed Mechanism

Only one feed mechanism 800 is provided, the fact that there is a common takeup mechanism being a characteristic feature of the second embodiment. Regardless of whether paper is being supplied from automatic-feed cassette mechanism unit 6 or from manual-feed mechanism unit 7, this feed mechanism 800 is driven so as to deliver to the aforementioned main transport path 36 the recording paper P that has been taken up. Below, detailed description is carried out with respect to the constitution and feed mode(s) of this feed mechanism 800.

(Constitution of Feed Mechanism 800)

At this feed mechanism 800, feed path (transport path) 803 is formed from first and second guide members 801, 802. First guide member 801 is made up of a plate which is curved so as to be directed vertically upward from a location at the discharge side of the aforementioned automatic-feed cassette mechanism unit 6. Furthermore, second guide member 802 is made up of a plate which is curved so as to be directed vertically upward from a location at the discharge side of the aforementioned manual-feed mechanism unit 7. As a result of such constitution, feed path 803, by means of which the direction of transport of recording paper P taken up from either automatic-feed cassette mechanism unit 6 or manual-feed mechanism unit 7 is directed upward, is formed between first guide member 801 and second guide member 802. That is, recording paper P, whether taken up from automatic-feed cassette mechanism unit 6 or manual-feed mechanism unit 7, after passing through this feed path 803, is introduced into main transport path 36 and arrives at printing unit 3, where prescribed image forming operation take place.

Accordingly, there is only one path (feed path 803) by which recording paper P is discharged in going toward printing unit 3 from hybrid paper supply module 5, eliminating the need to have two paths at the hybrid device 1 main body such as would be the case were there one path for the automatic-feed cassette and another path for the manual-feed tray. This being the case, not only is it possible to shorten the length of the overall transport path of hybrid device 1 and achieve simplification of the constitution at the interior of hybrid device 1, but it is also possible to reduce the number of locations at which paper jams can occur, and it is possible to reduce the frequency of occurrence of paper jams.

In addition, provided at the interior of the aforementioned feed path 803 is paper transport module 804, which is constructed so as to permit takeup of recording paper P from either automatic-feed cassette 61 or manual-feed tray 71. Description of paper transport module 804 follows.

Provided at this paper transport module 804 are takeup roller(s) 805 and paper separator mechanism 806.

The aforementioned paper separator mechanism 806 is equipped with separator roller(s) 806*a* and separator plate(s) 806*b* installed below and coming in contact with the separator roller(s) 806*a*. Separator plate 806*b* is such that the force of friction between the top surface thereof (the surface coming in contact with recording paper P) and recording paper P is set so as to be greater than the force of friction between sheets of recording paper P, P. Furthermore, at separator roller 806*a*, the force of friction between this separator roller 806*a* and recording paper P is set so as to be greater than the force of friction between the top surface of separator plate 806*b* and recording paper P and greater than the force of friction between respective sheets of recording paper P, P. For this reason, even if multiple sheets of recording paper P, P, . . . are taken up from automatic-feed cassette 61 or manual-feed tray 71 and are fed to paper separator mechanism 806, separator roller 806*a* will be able to separate these multiple sheets of recording paper P, P, . . . and feed only the topmost sheet of recording paper P to transport path 803.

Pulleys 806*c*, 805*a* are respectively provided on the shafts of the aforementioned separator roller 806*a* and takeup roller 805, belt 807 spanning these pulleys 806*c*, 805*a*. Moreover, linked to the drive shaft of this separator roller 806*a* so as to permit transmission of motive force thereto is a reversible drive motor, not shown; drive force from this drive motor being transmitted to separator roller 806*a* so as to cause this separator roller 806*a* to rotate (rotating in forward or reverse fashion in correspondence to driving by the drive motor). This being the case, drive force from the motor which is transmitted to separator roller 806*a* is transmitted by way of belt 807 to takeup roller 805, and this takeup roller 805 is also made to rotate (rotating in forward or reverse fashion in correspondence to driving by the drive motor) in synchronous fashion with respect to separator roller 806*a*.

Figure 9:
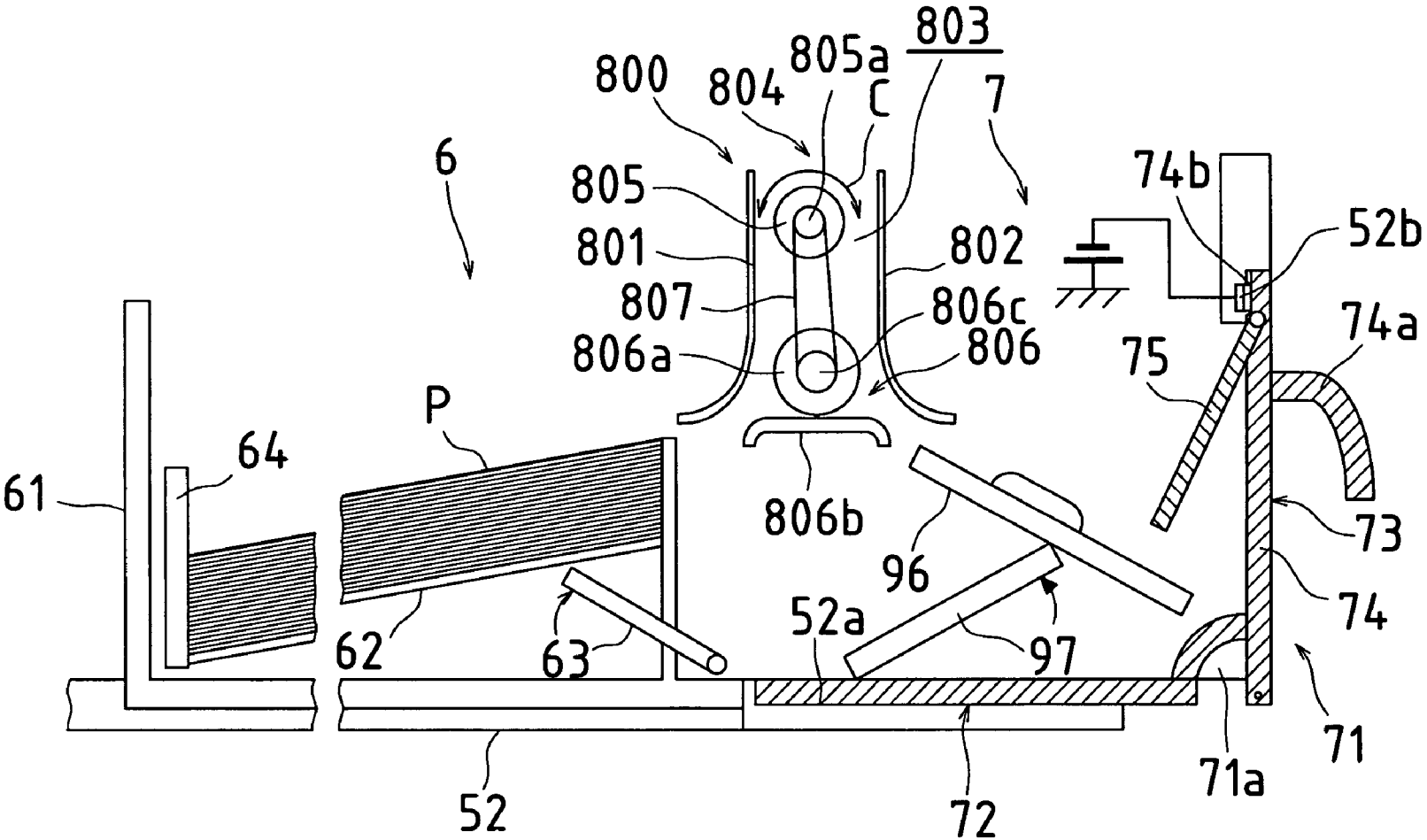
FIG. 9 is a drawing showing in schematic fashion a simplified rendering of the constitution at the interior of a hybrid paper supply module associated with the second embodiment.

Furthermore, the shafts of this separator roller 806*a* and this takeup roller 805 are supported by the same support plate (not shown); and in accompaniment to transmission of drive force from the aforementioned drive motor to separator roller 806*a*, this support plate is made to pivot about the shaft of separator roller 806*a* (see arrow C in FIG. 9). As drive force for causing pivoting of this support plate, drive force from the drive motor for driving the aforementioned separator roller 806*a* in rotational fashion may be utilized (e.g., through use of a mechanism employing gear(s) to link the pivot shaft of the support plate to the drive shaft of this drive motor, etc.), or a dedicated drive source may be provided. Description of the present embodiment is carried out in terms of a situation in which the support plate pivots as a result of being acted upon by drive force from the aforementioned drive motor.

The aforementioned drive motor being reversible as described above, when it is driven in rotational fashion in one direction, the support plate is made to rotate in one direction (e.g., counterclockwise as viewed in FIG. 9) about the shaft of separator roller 806*a* such that takeup roller 805 is made to press against the top surface of recording paper P within automatic-feed cassette 61 (the situation existing following conclusion of such rotation being shown in FIG. 10; this being what is referred to in the context of the present invention as the automatic-feed-shifted position thereof). At such time, both takeup roller 805 and separator roller 806*a* rotate in counterclockwise fashion as viewed in FIG. 10 (i.e., in the direction causing takeup and transport of recording paper P). In other words, in accompaniment to driving in rotational fashion in one direction by the aforementioned drive motor, takeup roller 805 presses against recording paper P within automatic-feed cassette 61 and takes up recording paper P from this automatic-feed cassette 61; and separation of recording paper P being carried out by paper separator mechanism 806, only one sheet of recording paper P is fed from automatic-feed cassette 61 to feed path 803.

Conversely, when the drive motor is driven in rotational fashion in the other direction, the support plate is made to rotate in the other direction (e.g., clockwise as viewed in FIG. 9) about the shaft of separator roller 806*a* such that takeup roller 805 is made to press against the top surface of recording paper P lying on manual-feed tray 71 (the situation existing following conclusion of such rotation being shown in FIG. 11; this being what is referred to in the context of the present invention as the manual-feed-shifted position thereof). At such time, both takeup roller 805 and separator roller 806*a* rotate in clockwise fashion as viewed in FIG. 11 (i.e., in the direction causing takeup and transport of recording paper P). In other words, in accompaniment to driving in rotational fashion in the other direction by the aforementioned drive motor, takeup roller 805 presses against recording paper P lying on manual-feed tray 71 and takes up recording paper P from this manual-feed tray 71; and separation of recording paper P being carried out by paper separator mechanism 806, only one sheet of recording paper P is fed from manual-feed tray 71 to feed path 803, or depending upon the situation, to automatic-feed cassette 61 (such feeding to automatic-feed cassette 61 will be described below).

Furthermore, the aforementioned separator plate 806*b* pivots in correspondence to recording paper P transport mode. Description of the constitution in this regard follows.

The central region of separator plate 806*b* is supported by pivot shaft(s) (not shown) extending in parallel fashion with respect to the drive shaft of the aforementioned separator roller 806*a*, separator plate 806*b* being supported so as to permit it to pivot about this pivot shaft. Furthermore, coupled to this separator plate 806*b* is a drive source, e.g., an electromagnetic solenoid; and the inclinational orientation of separator plate 806*b* is capable of being altered in accompaniment to driving by this drive source. More specifically, orientation can be altered so as to be a neutral orientation in which the top surface of separator plate 806*b* is horizontal as shown in FIG. 9; an automatic-feed-inclined orientation in which it is inclined such that the end of separator plate 806*b* nearer to automatic-feed cassette 61 is directed downward as shown in FIG. 10; or a manual-feed-inclined orientation in which it is inclined such that the end of separator plate 806*b* nearer to manual-feed tray 71 is directed downward as shown in FIG. 11.

Note, moreover, that it is possible to provide a pair of stopper components 8B, 8B (indicated in imaginary-line fashion at FIGS. 10 and 11) for constraining maximum inclinational angle(s) of separator plate 806*b*. That is, when separator plate 806*b* pivots as described above, upon either tip region thereof's abutting one of the stopper components 8B (i.e., upon reaching either the aforementioned automatic-feed-inclined orientation or the aforementioned manual-feed-inclined orientation), separator plate 806*b* would be prevented from pivoting therebeyond. Furthermore, the position of the aforementioned stopper component 8B is set such that the inclinational angle of separator plate 806*b* when the tip region of separator plate 806*b* is abutting stopper component 8B will be substantially the same as the inclinational angle of an imaginary line drawn at such time from the axis of takeup roller 805 to the axis of separator roller 806*a*. That is, the position thereof is set such that the direction of transport during takeup of recording paper P coincides with an imaginary line drawn extending from the top surface of separator plate 806*b*. This being the case, it is possible to cause recording paper P which has been taken up to be smoothly guided to feed path 803 in parallel fashion with respect to the top surface of separator plate 806*b*. But note that even where such stopper component(s) 8B is/are not provided, it is possible through appropriate setting of the drive stroke of the electromagnetic solenoid or other such drive source causing pivoting of separator plate 806*b* to obtain optimal inclinational angles for the automatic-feed-inclined orientation and the manual-feed-inclined orientation.

Figure 12:
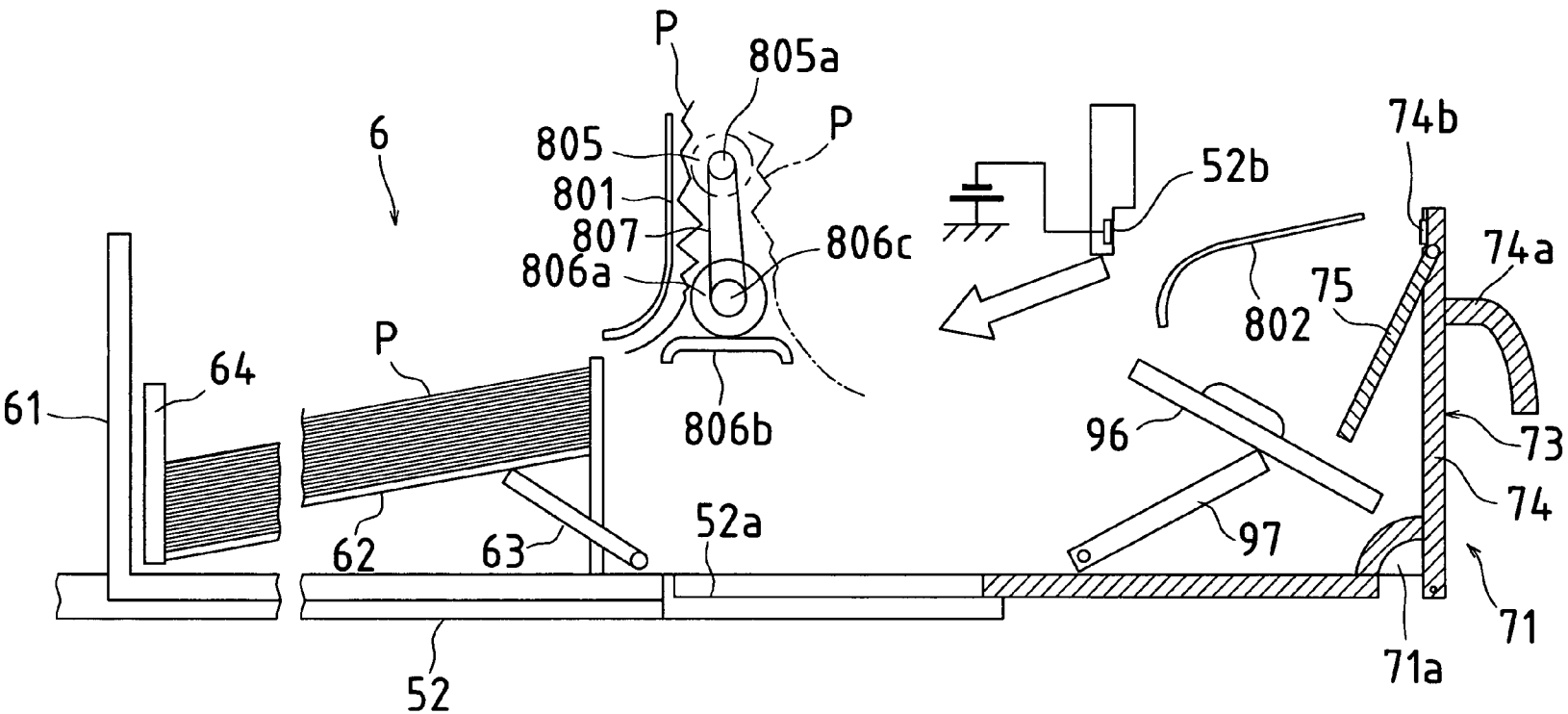
FIG. 12 is a drawing corresponding to FIG. 9 and showing a manual-feed mechanism unit that has been pulled outward at a time when a paper jam has occurred.

Furthermore, whereas the aforementioned first guide member 801 is supported by the aforementioned module casing 52, second guide member 802 is provided in such fashion that it is integral with the aforementioned manual-feed mechanism unit 7. In other words, when manual-feed mechanism unit 7 is pulled outward as indicated at FIG. 12, this second guide member 802 is pulled away from module casing 52 together with manual-feed mechanism unit 7. This being the case, access is opened up to feed path 803 constituted by the space between same and first guide member 801; making it possible to easily carry out procedure(s) for removal of paper in the event of occurrence of paper jam(s) at this feed path 803. Of the recording paper P involved in jams in FIG. 12, that shown with a solid line indicates jamming of recording paper P transported thereto from automatic-feed cassette mechanism unit 6, and that shown with an alternating long and short chain line indicates jamming of recording paper P transported thereto from manual-feed mechanism unit 7.

Furthermore, the aforementioned second guide member 802 is provided with a pivot mechanism, not shown, such that second guide member 802 extends vertically so as to form the aforementioned feed path 803 when, as shown in FIGS. 10 and 11, manual-feed mechanism unit 7 is not pulled outward therefrom; but such that second guide member 802 leans toward manual-feed tray 71, thus enlarging the space within which the user can insert his or her hand during removal of jammed paper (the direction in which the user's hand is inserted being indicated by an arrow at FIG. 12), when, as shown in FIG. 12, manual-feed mechanism unit 7 is pulled outward therefrom.

(Operation of Feed Mechanism 800)

Feed modes (recording paper P transport modes) of feed mechanism 800 having the foregoing constitution will next be described. Such feed modes include a first transport mode in which recording paper P is taken up from automatic-feed cassette 61 and is transported by way of feed path 803 to main transport path 36; a second transport mode in which recording paper P is taken up from manual-feed tray 71 and is transported by way of feed path 803 to main transport path 36; and a third transport mode in which recording paper P is taken up from manual-feed tray 71 and is delivered to automatic-feed cassette 61. Furthermore, this third transport mode includes a slew transport mode in which recording paper P taken up from manual-feed tray 71 is transported directly to automatic-feed cassette 61 without first being delivered to feed path 803; and a switchback transport mode in which recording paper P taken up from manual-feed tray 71 is first delivered to feed path 803 and is thereafter transported to automatic-feed cassette 61 (recording paper P being flipped when recording paper P is delivered from feed path 803 to automatic-feed cassette 61). Description of the respective transport modes follows below.

[First Transport Mode]

First, with respect to the first transport mode in which recording paper P is taken up from automatic-feed cassette 61 and is transported by way of feed path 803 to main transport path 36; as shown in FIG. 10, the drive motor is driven so as to cause takeup roller 805 to press against the top surface of recording paper P within automatic-feed cassette 61 (this being the automatic-feed-shifted position), and separator plate 806*b* pivots so as to cause the end of separator plate 806*b* which is nearer to automatic-feed cassette 61 to be inclined such that it is directed downward (this being the automatic-feed-inclined orientation). This being the case, recording paper P taken up from automatic-feed cassette 61 by takeup roller 805, being guided by the top surface of separator plate 806*b* and second guide member 802, is led to feed path 803 and is delivered to main transport path 36.

[Second Transport Mode]

Furthermore, with respect to the second transport mode in which recording paper P is taken up from manual-feed tray 71 and is transported by way of feed path 803 to main transport path 36; as shown in FIG. 11, the drive motor is driven so as to cause takeup roller 805 to press against the top surface of recording paper P lying on manual-feed tray 71 (this being the manual-feed-shifted position), and separator plate 806*b* pivots so as to cause the end of separator plate 806*b* which is nearer to manual-feed tray 71 to be inclined such that it is directed downward (this being the manual-feed-inclined orientation). This being the case, recording paper P taken up from manual-feed tray 71 by takeup roller 805, being guided by the top surface of separator plate 806*b* and first guide member 801, is led to feed path 803 and is delivered to main transport path 36.

[Slew Transport Mode]

Figure 13:
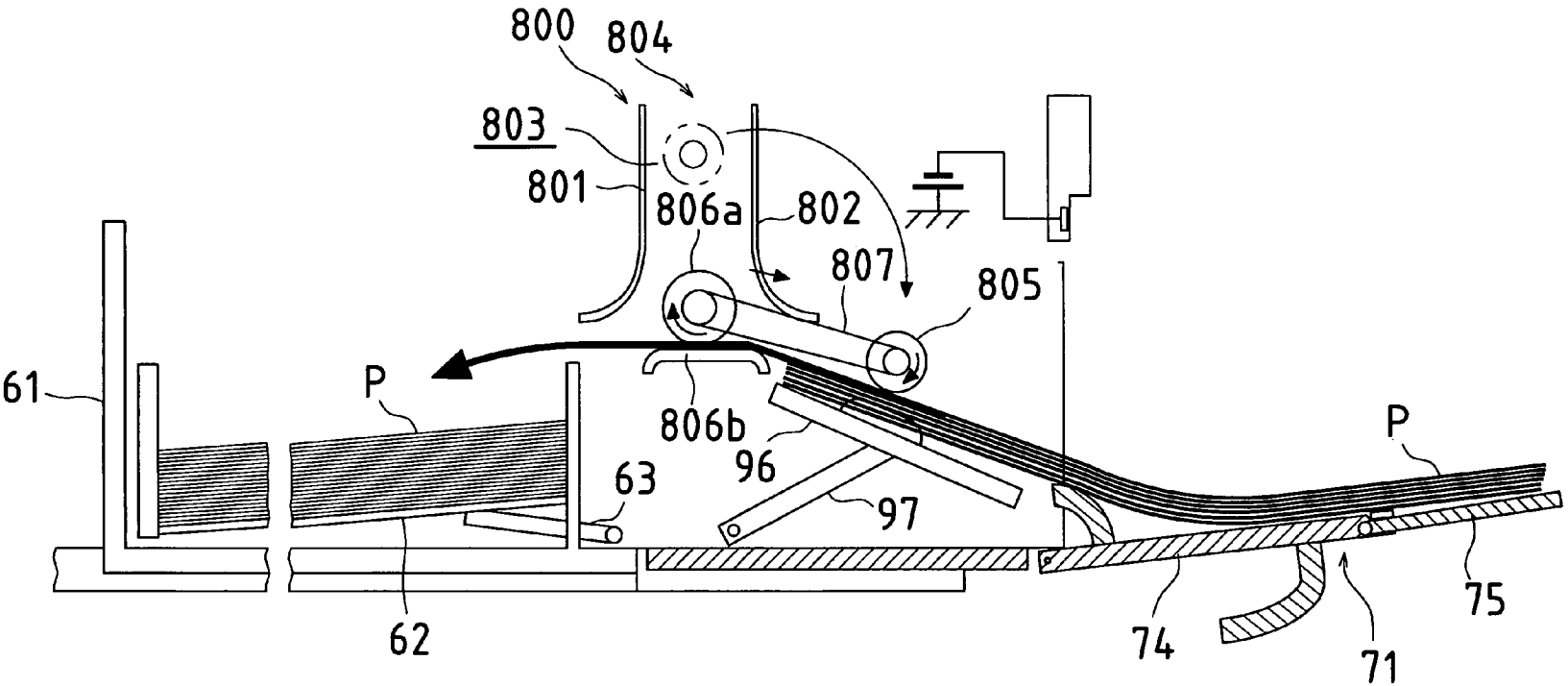
FIG. 13 is a drawing corresponding to FIG. 9 and is for explaining a slew transport mode.

Moreover, with respect to the slew transport mode in which recording paper P taken up from manual-feed tray 71 is transported to automatic-feed cassette 61 without first being delivered to feed path 803; as shown in FIG. 13, the drive motor is driven so as to cause takeup roller 805 to press against the top surface of recording paper P lying on manual-feed tray 71 (this being the manual-feed-shifted position), and separator plate 806*b* remains in its horizontal state (neutral orientation). This being the case, recording paper P taken up from manual-feed tray 71 by takeup roller 805 is transported horizontally in parallel fashion with respect to the top surface of separator plate 806*b* so as to be directed toward automatic-feed cassette 61, and continues on to be delivered to automatic-feed cassette 61. At this time, in order to facilitate smooth delivery of recording paper P to automatic-feed cassette 61, lift plate 63 is angled downward, in accompaniment to which pivot plate 62 descends so as to make room for delivery of recording paper P thereinto. Following conclusion of this operation, in the event that there is a request for supply of paper from automatic-feed cassette 61, recording paper P within automatic-feed cassette 61 is delivered to main transport path 36 by means of operations similar to those carried out in the aforementioned first transport mode.

[Switchback Transport Mode]

Figure 14:
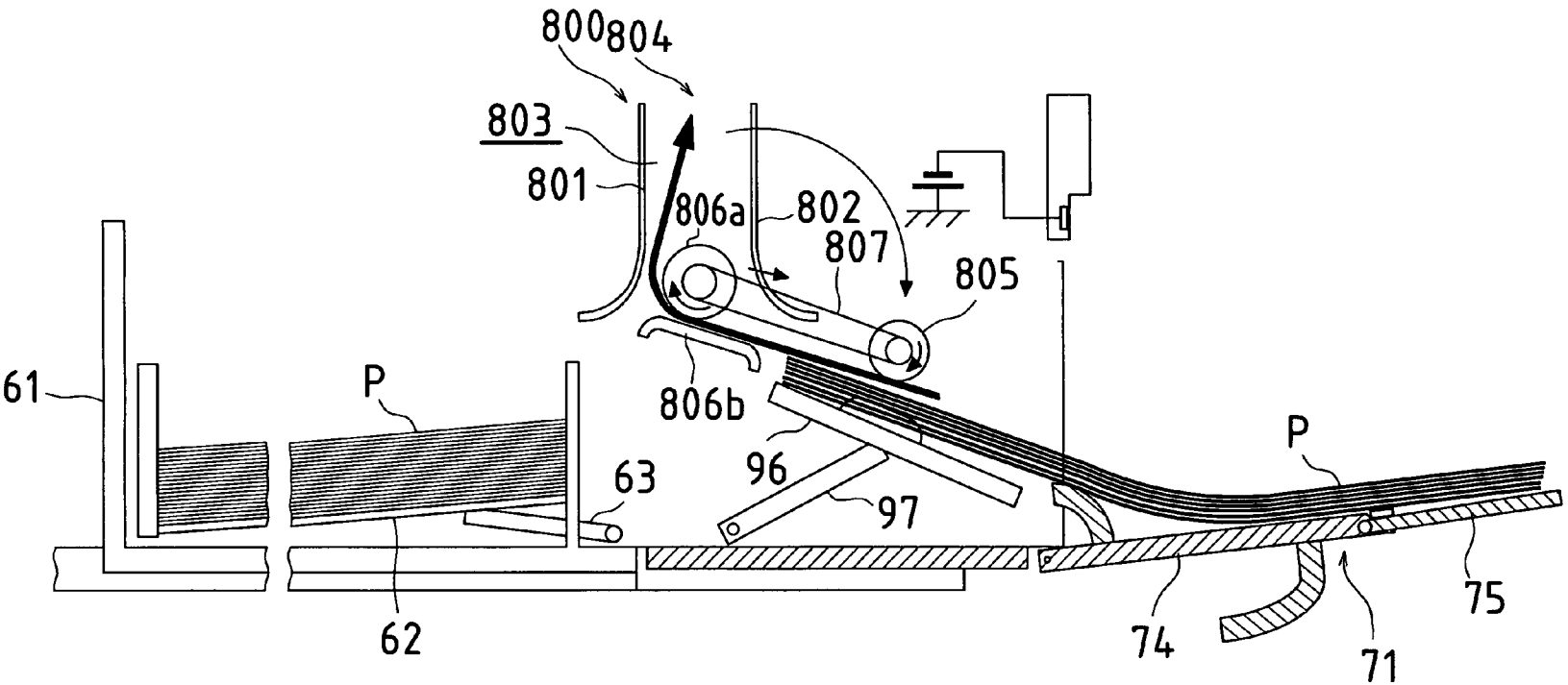
FIG. 14 is a drawing corresponding to FIG. 9 and is for explaining a first step in a switchback transport mode.
Figure 15:
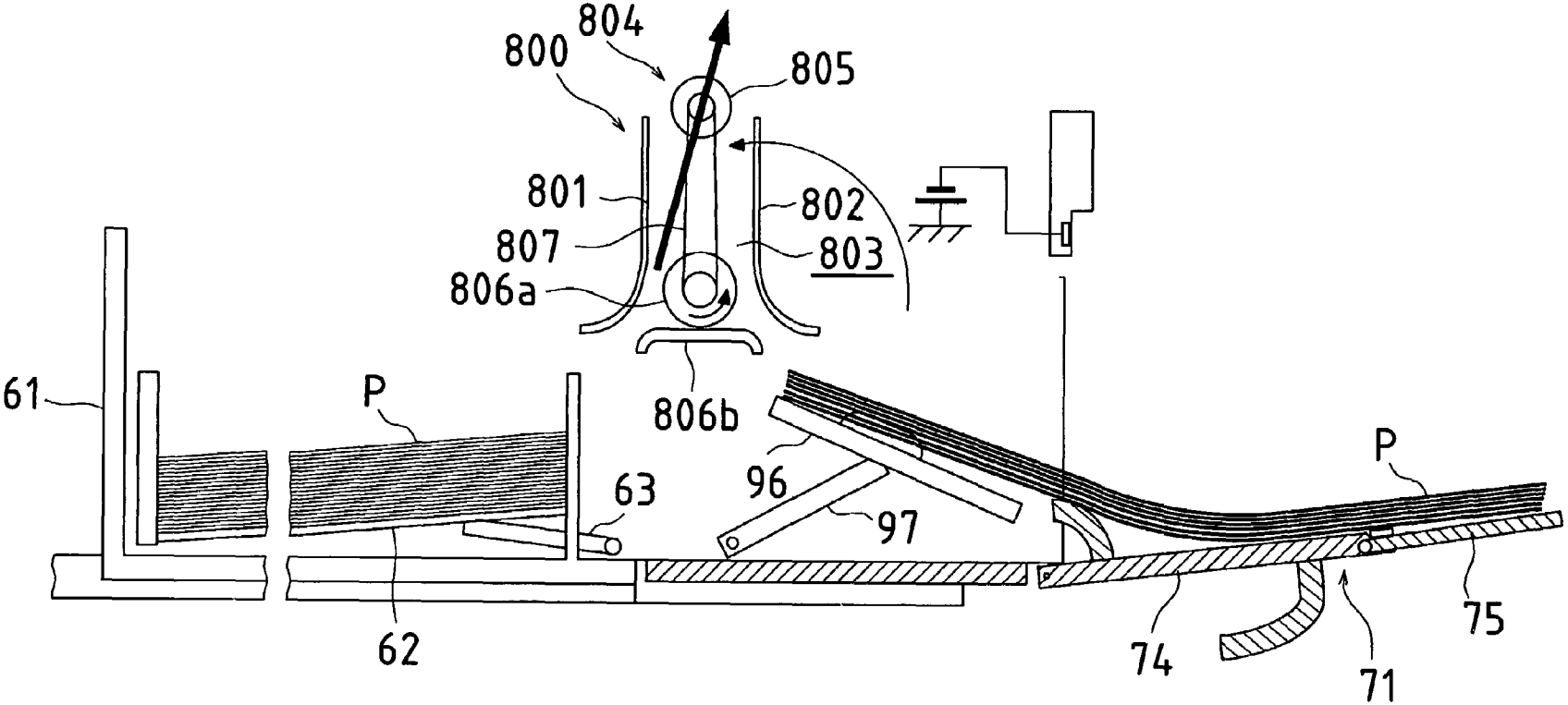
FIG. 15 is a drawing corresponding to FIG. 9 and is for explaining a second step in a switchback transport mode.

On the other hand, with respect to the switchback transport mode in which recording paper P taken up from manual-feed tray 71 is first delivered to feed path 803 and is thereafter transported to automatic-feed cassette 61; first, as shown in FIG. 14, the drive motor is driven so as to cause takeup roller 805 to press against the top surface of recording paper P lying on manual-feed tray 71 (this being the manual-feed-shifted position), and separator plate 806*b* pivots so as to cause the end of separator plate 806*b* which is nearer to manual-feed tray 71 to be inclined such that it is directed downward (this being the manual-feed-inclined orientation). This being the case, recording paper P taken up from manual-feed tray 71 by takeup roller 805, being guided by the top surface of separator plate 806*b* and first guide member 801, is led to feed path 803. Thereafter, the drive motor is driven in reverse fashion, causing separator roller 806*a* to rotate in reverse fashion, and causing takeup roller 805 to move so as to return to its initial position as shown in FIG. 9. As a result, a state is assumed such that takeup of a second sheet of recording paper P from manual-feed tray 71 is prevented, and such that only a single sheet of recording paper P is present within feed path 803.

Figure 16:
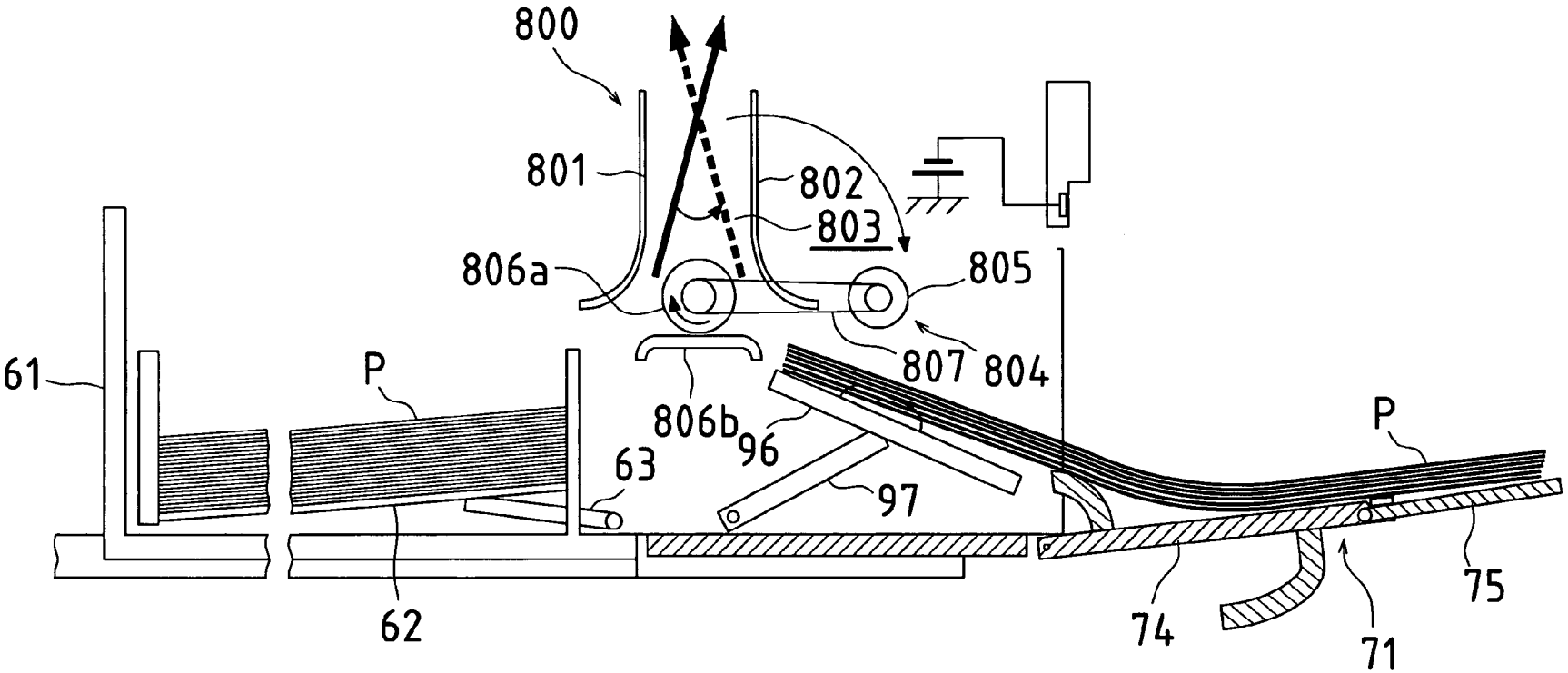
FIG. 16 is a drawing corresponding to FIG. 9 and is for explaining a third step in a switchback transport mode.
Figure 17:
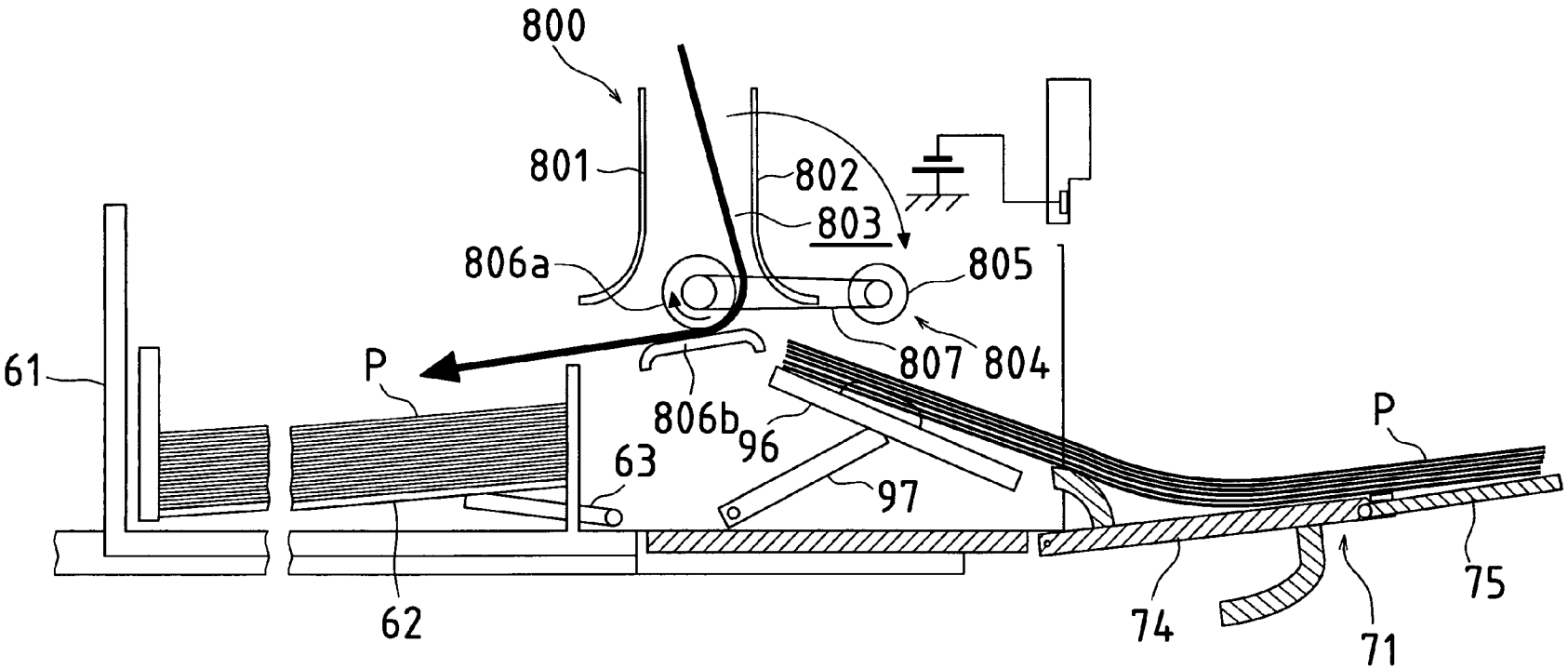
FIG. 17 is a drawing corresponding to FIG. 9 and is for explaining a fourth step in a switchback transport mode.

Next, as shown in FIG. 16, separator roller 806*a* is again rotated in forward fashion (i.e., is rotated in the same direction as at FIG. 14), causing the bottom edge (upstream edge) of recording paper P within feed path 803 to be carried along with the outside circumferential surface of separator roller 806*a* and causing the bottom edge of the recording paper P to move from the left side to the right side of this separator roller 806*a* as viewed in the drawing. That is, recording paper P goes from the orientation indicated by the arrow drawn with solid line in FIG. 16 to the orientation indicated by the arrow drawn with broken line therein. As a result, the bottom end of recording paper P is delivered from the left side of separator plate 806*b* as viewed in the drawing (the side thereof toward automatic-feed cassette 61) to a region between this separator plate 806*b* and separator plate 806*b*. At this time, as shown in FIG. 11, separator plate 806*b* pivots so as to cause the end thereof which is nearer to manual-feed tray 71 to be inclined such that it is directed downward. This being the case, recording paper P present within feed path 803 is transported by way of the top surface of separator plate 806*b* to automatic-feed cassette 61. Here as well, in order to facilitate smooth delivery of recording paper P to automatic-feed cassette 61, lift plate 63 is angled downward, in accompaniment to which pivot plate 62 descends so as to make room for delivery of recording paper P thereinto.

The present feed mechanism 800 is thus capable of operating in four different transport modes. In particular, whereas front and back are not reversed during the course of transport of recording paper P from manual-feed tray 71 to automatic-feed cassette 61 when in the aforementioned slew transport mode, front and back are reversed during the course of transport of recording paper P from manual-feed tray 71 to automatic-feed cassette 61 when in the aforementioned switchback transport mode.

Addressing the question of which side of recording paper P it is on which printing will be carried out as a result of employment of each of the foregoing transport modes, in the first transport mode in which recording paper P is taken up from automatic-feed cassette 61 and is transported by way of feed path 803 to main transport path 36, image formation will be carried out on what is the top surface of the recording paper P as it sits within automatic-feed cassette 61. Furthermore, in the second transport mode in which recording paper P is taken up from manual-feed tray 71 and is transported by way of feed path 803 to main transport path 36, image formation will be carried out on what is the bottom surface of the recording paper P as it lies on manual-feed tray 71. Furthermore, in the slew transport mode in which recording paper P taken up from manual-feed tray 71 is transported to automatic-feed cassette 61 without first being delivered to feed path 803, image formation will be carried out on what is the top surface of the recording paper P as it lies on manual-feed tray 71. Moreover, in the switchback transport mode in which recording paper P taken up from manual-feed tray 71 is first delivered to feed path 803 and is thereafter transported to automatic-feed cassette 61, image formation will be carried out on what is the bottom surface of the recording paper P as it lies on manual-feed tray 71.

Feed Operations

Figure 18:
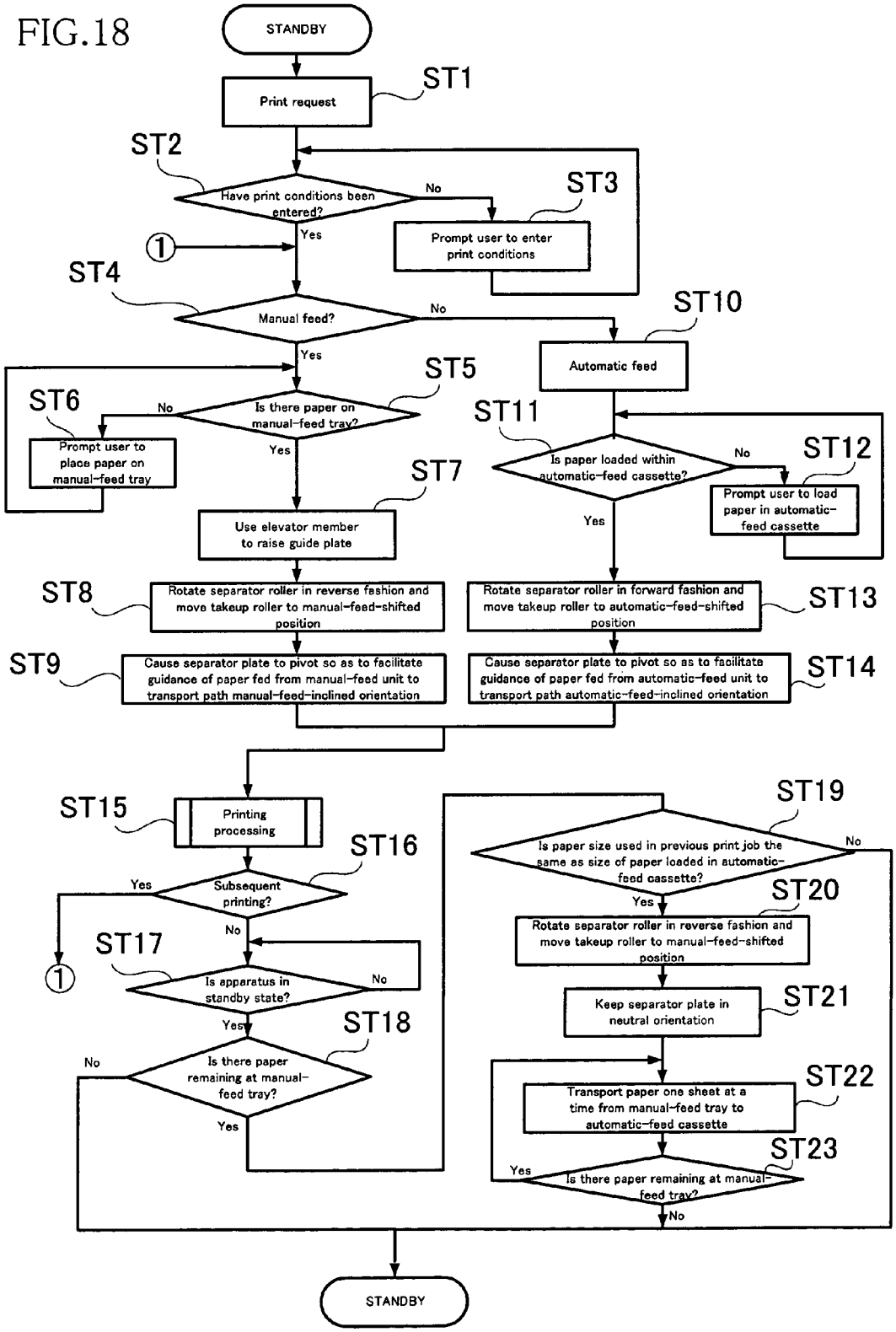
FIG. 18 is a flowchart for explaining paper feed operations carried out by a hybrid paper supply module associated with the second embodiment.

Following the flowchart of FIG. 18, paper feed operations carried out by hybrid paper supply module 5 having the foregoing constitution will next be described.

First, if at step ST1 the user operates a control panel of hybrid device 1 (or operates a host device connected thereto) or there is otherwise a request to carry out printing, then at step ST2 determination is made as to whether print conditions (selection of recording paper P supply source, etc.) have been entered. If such print conditions have not yet been entered (the answer as determined at step ST2 is NO), then processing proceeds to step ST3, at which a message for prompting entry of print conditions is displayed at the control panel.

Furthermore, upon entry of print conditions (i.e., in the event that the answer as determined at step ST2 is YES), processing proceeds to step ST4, at which determination is made as to whether the paper supply source at the foregoing print conditions is manual-feed mechanism unit 7. If the result of this determination is YES, then processing proceeds to step ST5, at which determination is made as to whether the foregoing manual-feed tray 71 is open and recording paper P has been placed on manual-feed tray 71. If the result of this determination is NO, then processing proceeds to step ST6, at which a message for prompting placement of recording paper P on manual-feed tray 71 (i.e., replenishment of paper) is displayed at the control panel.

If the answer as determined at the foregoing step ST5 is YES, then processing proceeds to step ST7, at which lift plate (elevator member) 97 is actuated, causing guide plate 96 to pivot upward. Thereafter, at step ST8, drive motor 808 is driven, as a result of which separator roller 806*a* and takeup roller 805 are made to rotate; and furthermore, pivoting action of support plate 809 causes takeup roller 805 to press against recording paper P lying on manual-feed tray 71 (i.e., takeup roller 805 moves to the manual-feed-shifted position thereof). In accompaniment to this action, as shown in FIG. 11, separator plate 806*b* pivots (step ST9) so as to cause the end thereof which is nearer to manual-feed tray 71 to be inclined such that it is directed downward (i.e., it assumes what is referred to in the context of the present invention as the manual-feed-inclined orientation thereof). With the apparatus in this state, recording paper P is taken up from manual-feed tray 71; and separation of recording paper P being carried out by paper separator mechanism 806, only one sheet of recording paper P is fed from manual-feed tray 71 to feed path 803, and processing proceeds to the printing processing operations at step ST15 and therebelow.

Conversely, if the answer as determined at step ST4 is NO, then at step ST10 it is determined that the paper supply source selected pursuant to the print conditions is automatic-feed cassette mechanism unit 6, and processing proceeds to the operations at step ST11 and therebelow.

First, at step ST11, determination is made as to whether recording paper P is loaded within automatic-feed cassette 61. If the result of this determination is NO, then processing proceeds to step ST12, at which a message for prompting loading of recording paper P within automatic-feed cassette 61 (i.e., replenishment of paper) is displayed at the control panel.

If the answer as determined at the foregoing step ST11 is YES, then processing proceeds to step ST13, at which the aforementioned drive motor is driven, as a result of which separator roller 806*a* and takeup roller 805 are made to rotate; and furthermore, pivoting action of support plate 809 causes takeup roller 805 to press against recording paper P within automatic-feed cassette 61 (i.e., takeup roller 805 moves to the automatic-feed-shifted position thereof). In accompaniment to this action, as shown in FIG. 10, separator plate 806*b* pivots (step ST14) so as to cause the end thereof which is nearer to automatic-feed cassette 61 to be inclined such that it is directed downward (i.e., it assumes what is referred to in the context of the present invention as the automatic-feed-inclined orientation thereof). With the apparatus in this state, recording paper P is taken up from automatic-feed cassette 61; and separation of recording paper P being carried out by paper separator mechanism 806, only one sheet of recording paper P is fed from automatic-feed cassette 61 to feed path 803, and processing proceeds to the printing processing operations at step ST15 and therebelow.

Printing processing is carried out at step ST15; and after image forming has at printing unit 3 been carried out on recording paper P, operations are carried out for discharge thereof to discharge tray 35.

After printing operations have thus been carried out on a single sheet of recording paper P, determination is made at step ST16 as to whether there is subsequent printing to be carried out (i.e., whether subsequent print information exists); the operations at steps ST4 through ST16 being carried out in repeated fashion until subsequent print information does not exist. In addition, when subsequent print information no longer exists, hybrid device 1 enters a standby state. Upon entering this standby state, at step ST18 determination is made as to whether there is any recording paper P remaining at manual-feed mechanism unit 7. This determination is made by means of optical sensor(s) capable of determining whether recording paper P is present at manual-feed tray 71.

If the answer as determined at step ST18 is NO (i.e., if it is determined that no recording paper P remains at manual-feed mechanism unit 7), then the apparatus remains in this standby state. Conversely, if the answer as determined at step ST18 is YES (i.e., if it is determined that there is recording paper P remaining at manual-feed mechanism unit 7), then processing proceeds to step ST19, at which determination is made as to whether the paper size used in the previous print job is the same as the size of the recording paper P loaded in automatic-feed cassette 61. Means for determining paper size as a result of detection of guide member position(s) and/or optical paper size sensor(s) may be employed for detection of such paper sizes. If the answer as determined at step ST19 is NO (i.e., if it is determined that the size of recording paper P lying on the manual-feed tray is different from the size of recording paper P loaded within automatic-feed cassette 61), then the apparatus remains in this standby state. Conversely, if the answer as determined at step ST19 is YES (i.e., if it is determined that the size of recording paper P lying on manual-feed tray 71 is the same as the size of recording paper P loaded within automatic-feed cassette 61), then paper transport operations in accordance with the aforementioned slew transport mode are carried out. That is, at step ST20, separator roller 806*a* is driven in reverse fashion, causing takeup roller 805 to press against recording paper P lying on manual-feed tray 71 (i.e., takeup roller 805 moves to the manual-feed-shifted position thereof). Furthermore, at step ST21, separator plate 806*b* is kept in a horizontal state (its neutral orientation), as a result of which recording paper P taken up from manual-feed tray 71 by takeup roller 805 is transported horizontally in parallel fashion with respect to the top surface of separator plate 806*b* so as to be directed toward automatic-feed cassette 61, and continues on to be delivered to automatic-feed cassette 61 (step ST22).

All recording paper P remaining at manual-feed tray 71 is thus delivered to automatic-feed cassette 61; and at step ST23, upon its being determined that no recording paper P remains at manual-feed tray 71, hybrid device 1 is returned to its standby state. Upon entering this standby state, the drive motor is driven in a direction opposite to the direction in which it was driven during the operation at the foregoing step ST20, and support plate 809 is returned to its initial position such that it assumes the state indicated in FIG. 9 (i.e., takeup roller 805 stands straight up such that it does not contact recording paper P).

The foregoing flowchart describes paper transport operations carried out in accordance with slew transport mode. These operations are appropriate to the situation in which recording paper P remaining on manual-feed tray 71 permits printing on both sides thereof (e.g., both the front and back surfaces thereof are white). In contrast, where recording paper P remaining on manual-feed tray 71 permits printing on only one side thereof (e.g., only the top or the bottom), the aforementioned slew transport mode and/or switchback transport mode should be selected as appropriate. That is, where recording paper P remaining on manual-feed tray 71 permits printing on only the top side thereof, recording paper P should be delivered to automatic-feed cassette 61 by means of the slew transport mode; but where recording paper P remaining on manual-feed tray 71 permits printing on only the bottom side thereof, recording paper P should be delivered to automatic-feed cassette 61 by means of the switchback transport mode. By so doing, when there is thereafter a request to carry out image formation, it will be possible to cause printing to be carried out on the desired surface, which is capable of being printed, of recording paper P taken up from automatic-feed cassette 61.

Benefits of Embodiment

As has been described above, in the present embodiment, with hybrid paper supply module 5 equipped with feed mechanism 800 permitting takeup of recording paper P from either automatic-feed cassette mechanism unit 6 or manual-feed mechanism unit 7, it is possible to carry out transport operations (the aforementioned slew transport and switchback transport) such as will cause recording medium or media to go from manual-feed mechanism unit 7 to automatic-feed cassette mechanism unit 6. For this reason, it is possible to avoid situations in which recording paper P remains at manual-feed mechanism unit 7 for long periods of time following termination of image forming operations. It will consequently be possible to avoid deterioration in the quality of recording paper P due to accumulation of dust thereon, absorption of moisture content from air, and so forth; it will thereafter be possible to carry out image forming operations in stable fashion; and it will be possible to ensure good image quality.

Furthermore, in the present embodiment, automatic-feed cassette mechanism unit 6 and manual-feed mechanism unit 7 together constitute a single integral hybrid paper supply module 5. This being the case, it is possible for manual-feed mechanism unit 7 to be arranged such that it is stacked vertically with respect to main transport path 36 and flipping transport path 37 which extend so as to be directed toward printing unit 3 of hybrid device 1, as a result of which it is possible to shorten dimension(s) of hybrid device 1—also making it possible to achieve reduction in the amount of space required for installation.

Furthermore, because this hybrid paper supply module 5 makes it possible to cause the path along which recording paper P taken up from automatic-feed cassette mechanism unit 6 is transported and the path along which recording paper P taken up from manual-feed mechanism unit 7 is transported to be shared at the interior of module 5, it is possible to decrease overall path length. This being the case, the length of the overall paper transport path of the apparatus can be shortened, the number of locations at which paper jams can occur can be reduced, and image forming operations at the apparatus can be carried out in stable fashion.

Furthermore, the foregoing embodiment has been described in terms of an example in which slew transport, in which recording paper P taken up from manual-feed mechanism unit 7 is delivered, without flipping, to automatic-feed cassette mechanism unit 6, or switchback transport, in which recording paper P taken up from manual-feed mechanism unit 7 is delivered, with flipping, to automatic-feed cassette mechanism unit 6, is selectively carried out. But the invention is not limited thereto, it also being possible for hybrid paper supply module 5 to only be capable of carrying out one or the other of the transport modes.

Furthermore, in the case of a constitution employing a plurality of paper supply modules stacked together, hybrid paper supply module 5 associated with the present invention may be applied to all of the stacked plurality of paper supply modules, or may be applied to only a portion of the paper supply modules.

Third Embodiment

Figure 19:
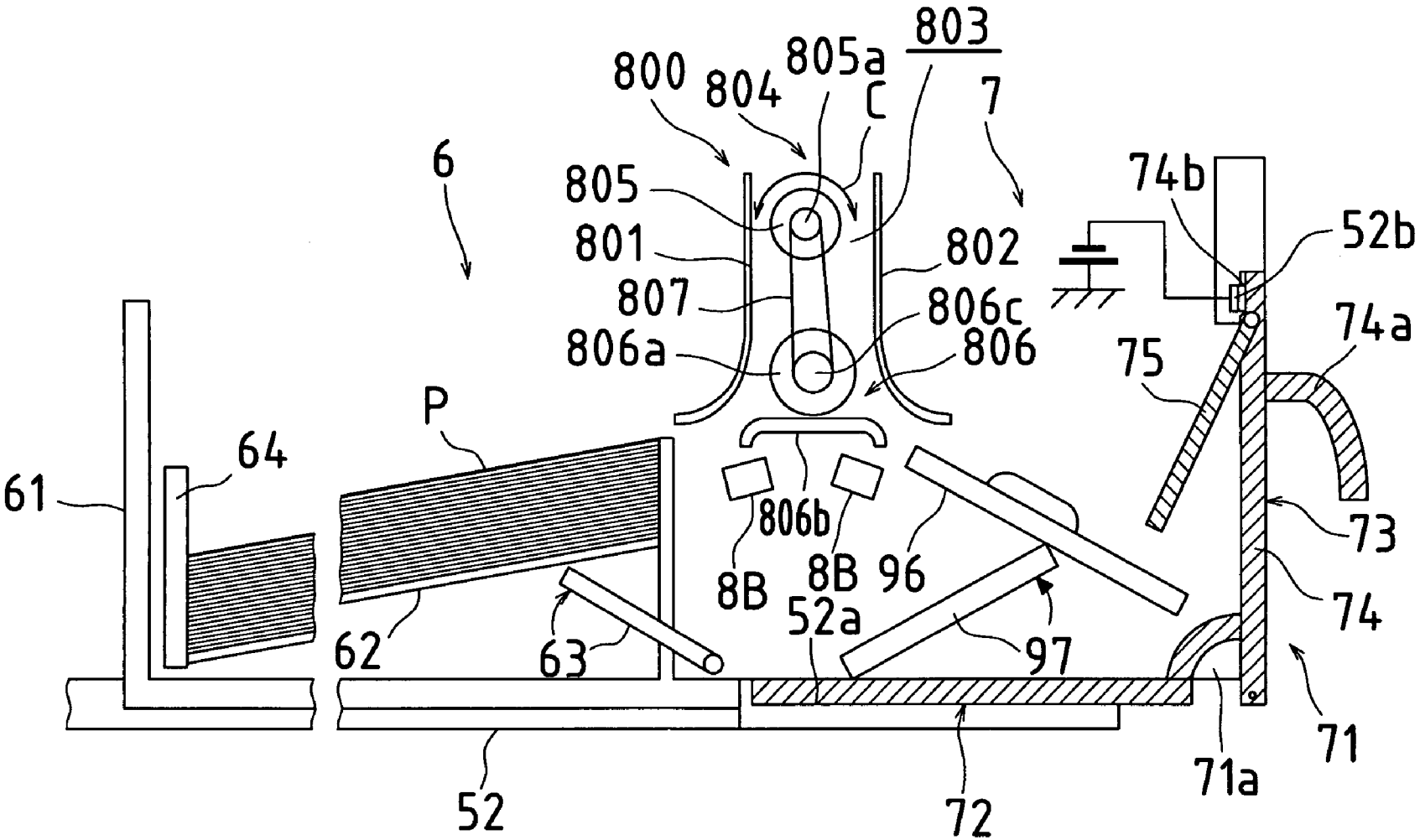
FIG. 19 is a drawing showing in schematic fashion a simplified rendering of the constitution at the interior of a hybrid paper supply module associated with a third embodiment of the present invention.

FIG. 19 is a drawing showing in schematic fashion the internal constitution of a hybrid device associated with a second embodiment of the present invention. At the sections entitled "Description of Overall Constitution of Hybrid Device" and "Description of Basic Operation of Hybrid Device," where the constitution of the present embodiment is similar to that of the first and second embodiments, like reference numerals will be used and description will be omitted. Below, detailed description is carried out with respect to characteristic aspects of the third embodiment.

Figure 20:
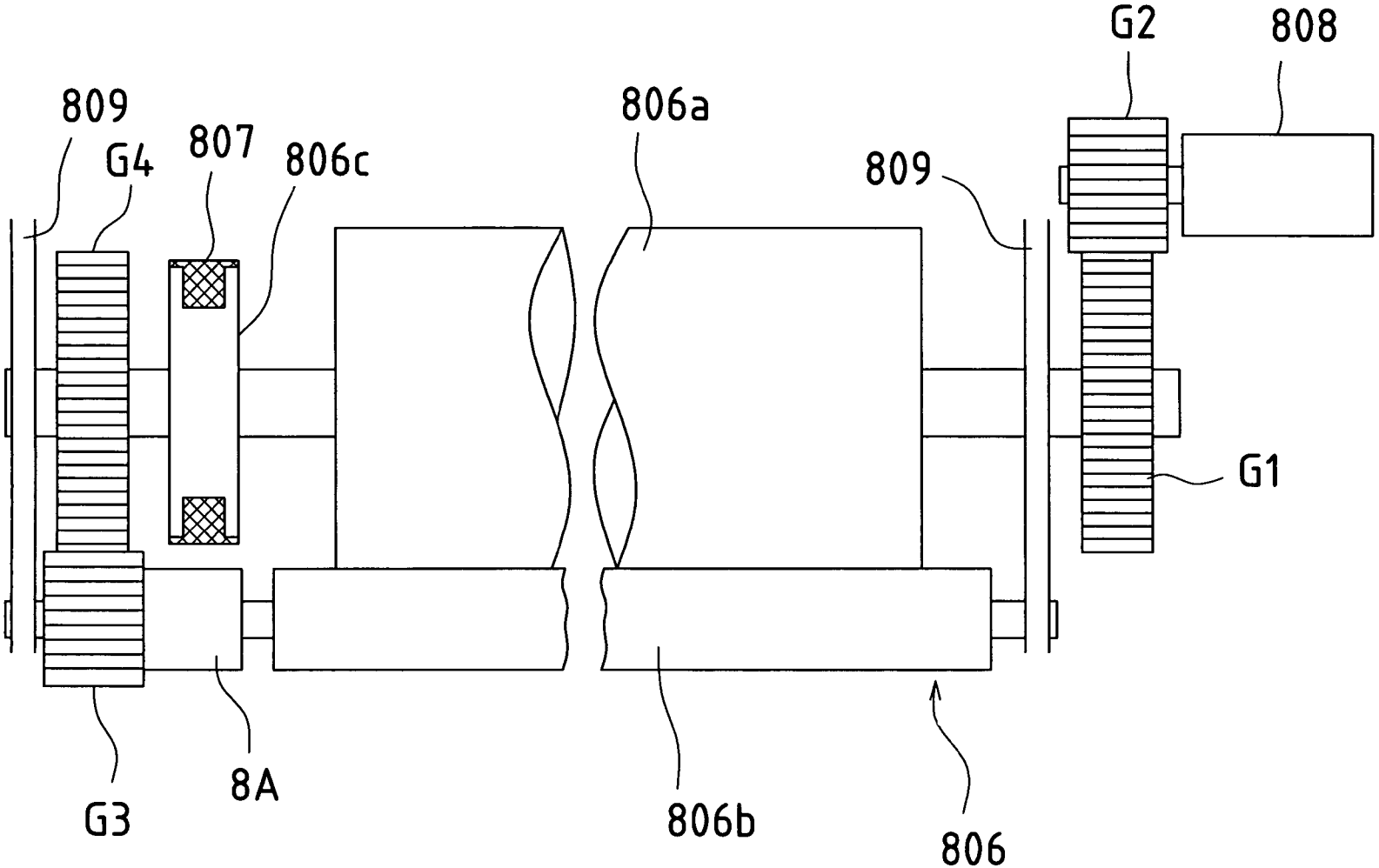
FIG. 20 is a drawing showing a portion of a paper transport module associated with the third embodiment as viewed from a direction perpendicular to the axis of rotation of a separator roller.

In the third embodiment, a single feed mechanism 800 is arranged between automatic-feed cassette mechanism unit 6 and manual-feed mechanism unit 7. Feed operations can be carried out in selective fashion by causing the location of takeup roller 805 to move between a location at which it comes in contact with recording paper P within automatic-feed cassette mechanism unit 6 and a location at which it comes in contact with recording paper P lying on manual-feed mechanism unit 7. The specific details of such constitution in the third embodiment differ from same in the second embodiment. FIG. 20 is a drawing showing a portion of paper transport module 804 as viewed from a direction perpendicular to the axis of rotation of separator roller 806*a*. Below, paper transport module 804 is described with reference to FIGS. 19 and 20.

Provided at this paper transport module 804 are takeup roller(s) 805 and paper separator mechanism 806.

The aforementioned paper separator mechanism 806 is equipped with separator roller(s) 806*a* and separator plate(s) 806*b* installed below and coming in contact with the separator roller(s) 806*a*. Separator plate 806*b* is such that the force of friction between the top surface thereof (the surface coming in contact with recording paper P) and recording paper P is set so as to be greater than the force of friction between sheets of recording paper P, P. Furthermore, at separator roller 806*a*, the force of friction between this separator roller 806*a* and recording paper P is set so as to be greater than the force of friction between the top surface of separator plate 806*b* and recording paper P and greater than the force of friction between respective sheets of recording paper P, P. For this reason, even if multiple sheets of recording paper P, P, . . . are taken up from automatic-feed cassette 61 or manual-feed tray 71 and are fed to paper separator mechanism 806, separator roller 806*a* will be able to separate these multiple sheets of recording paper P, P, . . . and feed only the topmost sheet of recording paper P to transport path 803.

Pulleys 806*c*, 805*a* are respectively provided on the shafts of the aforementioned separator roller 806*a* and takeup roller 805, belt 807 spanning these pulleys 806*c*, 805*a*. Moreover, linked to the drive shaft of this separator roller 806*a* so as to permit transmission of motive force thereto by way of gears G1, G2 is reversible drive motor 808; drive force from this drive motor 808 being transmitted to separator roller 806*a* so as to cause this separator roller 806*a* to rotate (rotating in forward or reverse fashion in correspondence to driving by drive motor 808). This being the case, drive force from the motor which is transmitted to separator roller 806*a* is transmitted by way of belt 807 to takeup roller 805, and this takeup roller 805 is also made to rotate (rotating in forward or reverse fashion in correspondence to driving by drive motor 808) in synchronous fashion with respect to separator roller 806*a*.

Furthermore, the shafts of this separator roller 806*a* and this takeup roller 805 are supported by the same support plate 809 (not shown in FIG. 19); and in accompaniment to transmission of drive force from the aforementioned drive motor 808 to separator roller 806*a*, this support plate 809 is made to pivot about the shaft of separator roller 806*a* (see arrow C in FIG. 19).

Figure 21:
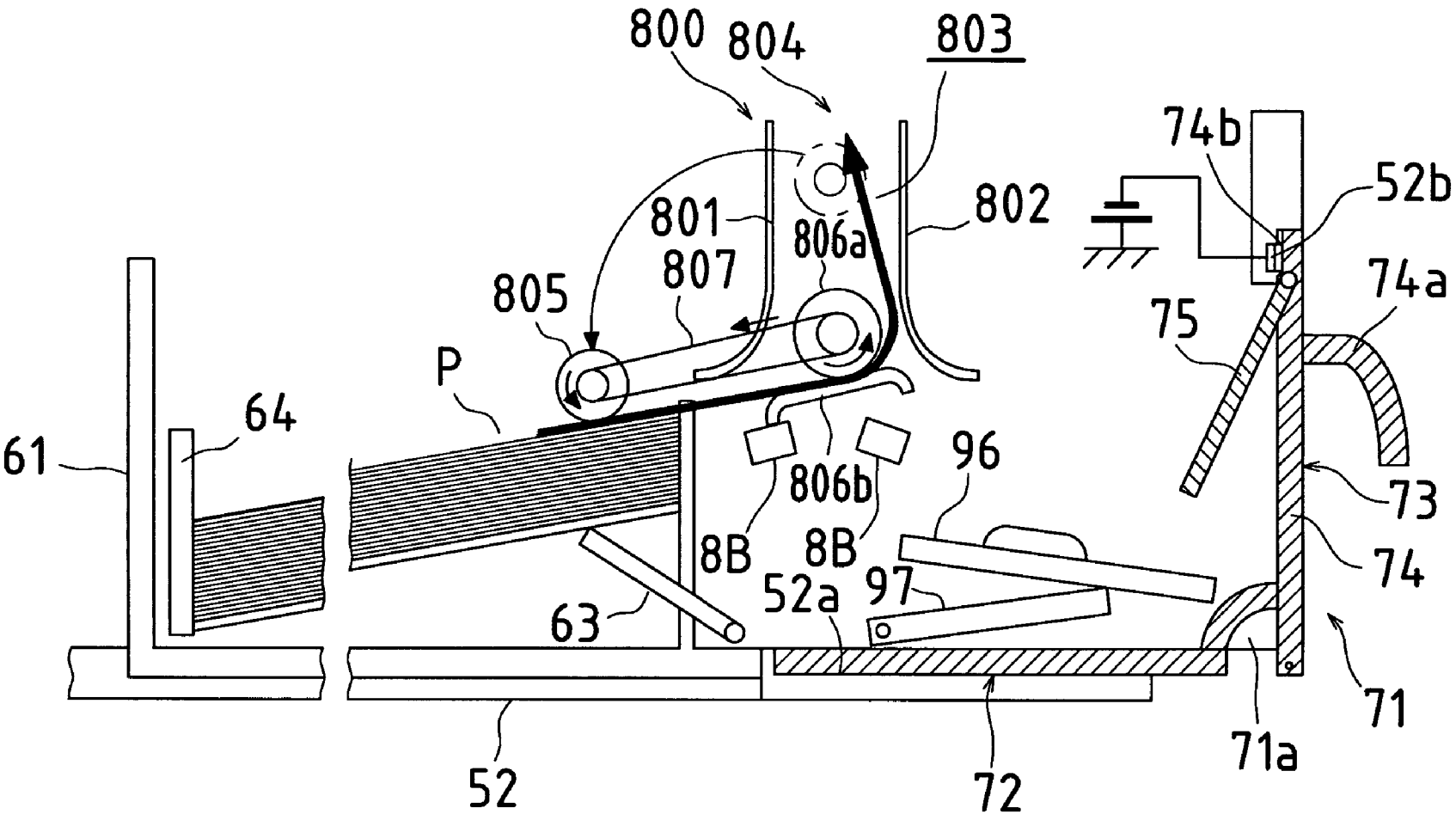
FIG. 21 is a drawing corresponding to FIG. 19 and showing supply of paper from an automatic-feed cassette.

The aforementioned drive motor 808 being reversible as described above, when it is driven in rotational fashion in one direction, support plate 809 is made to rotate in one direction (e.g., counterclockwise as viewed in FIG. 19) about the shaft of separator roller 806*a* such that takeup roller 805 is made to press against the top surface of recording paper P within automatic-feed cassette 61 (the situation existing following conclusion of such rotation being shown in FIG. 21; this being what is referred to in the context of the present invention as the automatic-feed-shifted position thereof). At such time, both takeup roller 805 and separator roller 806*a* rotate in counterclockwise fashion as viewed in FIG. 21 (i.e., in the direction causing takeup and transport of recording paper P). In other words, in accompaniment to driving in rotational fashion in one direction by the aforementioned drive motor 808, takeup roller 805 presses against recording paper P within automatic-feed cassette 61 and takes up recording paper P from this automatic-feed cassette 61; and separation of recording paper P being carried out by paper separator mechanism 806, only one sheet of recording paper P is fed from automatic-feed cassette 61 to feed path 803.

Figure 22:
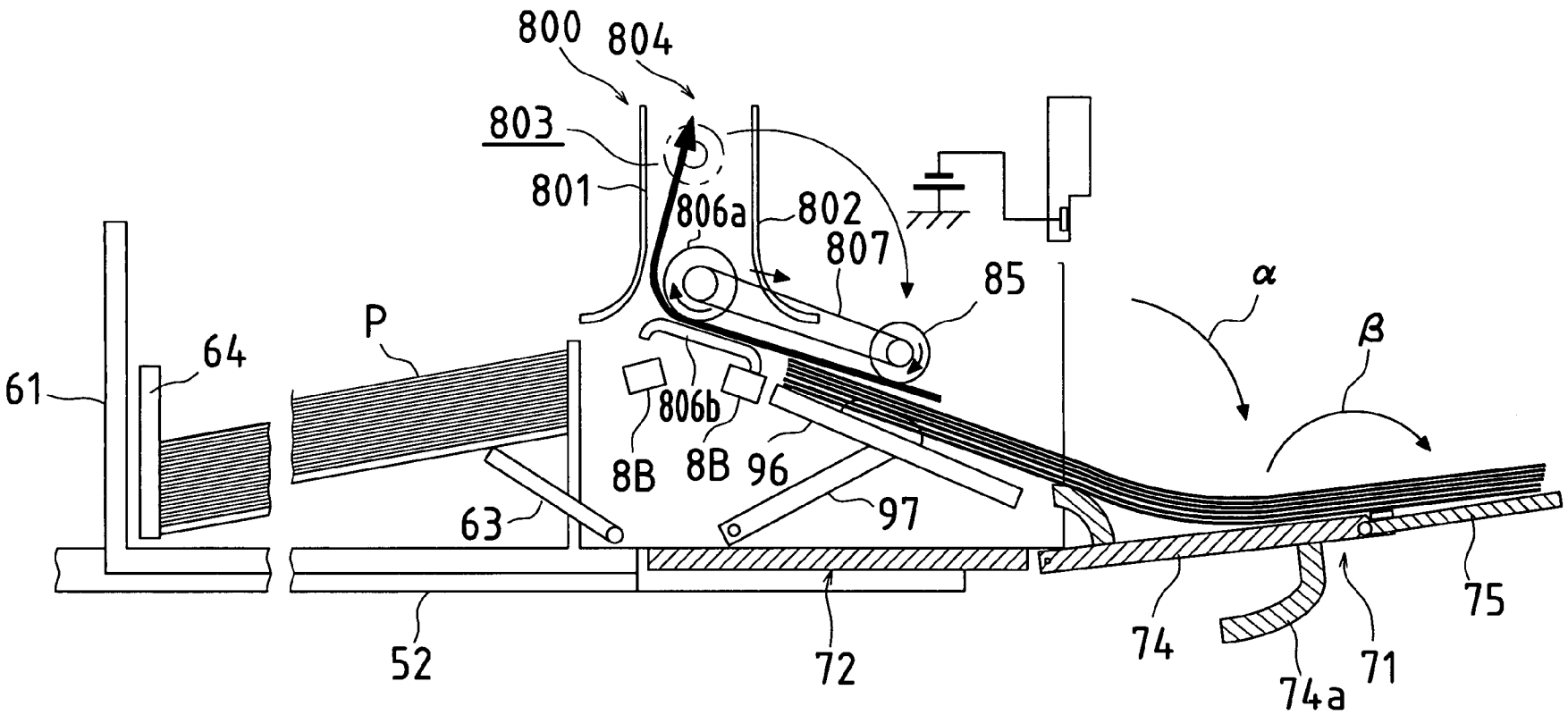
FIG. 22 is a drawing corresponding to FIG. 19 and showing supply of paper from a manual-feed tray.

Conversely, when drive motor 808 is driven in rotational fashion in the other direction, support plate 809 is made to rotate in the other direction (e.g., clockwise as viewed in FIG. 19) about the shaft of separator roller 806*a* such that takeup roller 805 is made to press against the top surface of recording paper P lying on manual-feed tray 71 (the situation existing following conclusion of such rotation being shown in FIG. 22; this being what is referred to in the context of the present invention as the manual-feed-shifted position thereof). At such time, both takeup roller 805 and separator roller 806*a* rotate in clockwise fashion as viewed in FIG. 22 (i.e., in the direction causing takeup and transport of recording paper P). In other words, in accompaniment to driving in rotational fashion in the other direction by the aforementioned drive motor 808, takeup roller 805 presses against recording paper P lying on manual-feed tray 71 and takes up recording paper P from this manual-feed tray 71; and separation of recording paper P being carried out by paper separator mechanism 806, only one sheet of recording paper P is fed from manual-feed tray 71 to feed path 803.

Furthermore, the aforementioned separator plate 806*b* pivots in accompaniment to driving by the aforementioned drive motor 808. Description of the constitution in this regard follows.

As shown in FIG. 20, the central region of separator plate 806*b* is supported by pivot shaft(s) extending in parallel fashion with respect to the drive shaft of the aforementioned separator roller 806*a*, torque limiter(s) 8A equipped with gear(s) G3 being provided on such pivot shaft(s) so as to rotate in integral fashion therewith. Furthermore, gear(s) G4 meshing with gear(s) G3 of such torque limiter(s) 8A is/are provided on the drive shaft of separator roller 806*a* so as to rotate in integral fashion therewith; and in accompaniment to rotation of separator roller 806*a*, motive force is transmitted to pivot shaft(s) of separator plate 806*b* by way of gears G4, G3 and torque limiter(s) 8A. As a result of such transmission of motive force to pivot shaft(s), separator plate 806*b* pivots so as to be inclined in one direction. More specifically, as shown in FIG. 21, when drive motor 808 is driven so as to cause takeup roller 805 to press against the top surface of recording paper P within automatic-feed cassette 61, separator plate 806*b* pivots so as to cause the end of separator plate 806*b* which is nearer to automatic-feed cassette 61 to be inclined such that it is directed downward. Conversely, as shown in FIG. 22, when drive motor 808 is driven so as to cause takeup roller 805 to press against the top surface of recording paper P lying on manual-feed tray 71, separator plate 806*b* pivots so as to cause the end of separator plate 806*b* which is nearer to manual-feed tray 71 to be inclined such that it is directed downward.

Furthermore, the present feed mechanism 800 is provided with a pair of stopper components 8B, 8B for constraining maximum inclinational angle(s) of separator plate 806*b*; and when separator plate 806*b* pivots as described above, upon either tip region thereof's abutting one of the stopper components 8B, torque limiter 8A operates, preventing separator plate 806*b* from pivoting therebeyond despite any rotation of separator roller 806*a*. Furthermore, the position of the aforementioned stopper component 8B is set such that the inclinational angle of separator plate 806*b* when the tip region of separator plate 806*b* is abutting stopper component 8B will be substantially the same as the inclinational angle of an imaginary line drawn at such time from the axis of takeup roller 805 to the axis of separator roller 806*a*. That is, the position thereof is set such that the direction of transport during takeup of recording paper P coincides with an imaginary line drawn extending from the top surface of separator plate 806*b*. This being the case, it is possible to cause recording paper P which has been taken up to be smoothly guided to feed path 803 in parallel fashion with respect to the top surface of separator plate 806*b*. More specifically, as shown in FIG. 21, when recording paper P is taken up from automatic-feed cassette 61, the recording paper P which is taken up is guided by the top surface of separator plate 806*b* and second guide member 802, and is led to feed path 803. On the other hand, as shown in FIG. 22, when recording paper P is taken up from manual-feed tray 71, the recording paper P which is taken up is guided by the top surface of separator plate 806*b* and first guide member 801 so as to be led to feed path 803.

Figure 23:
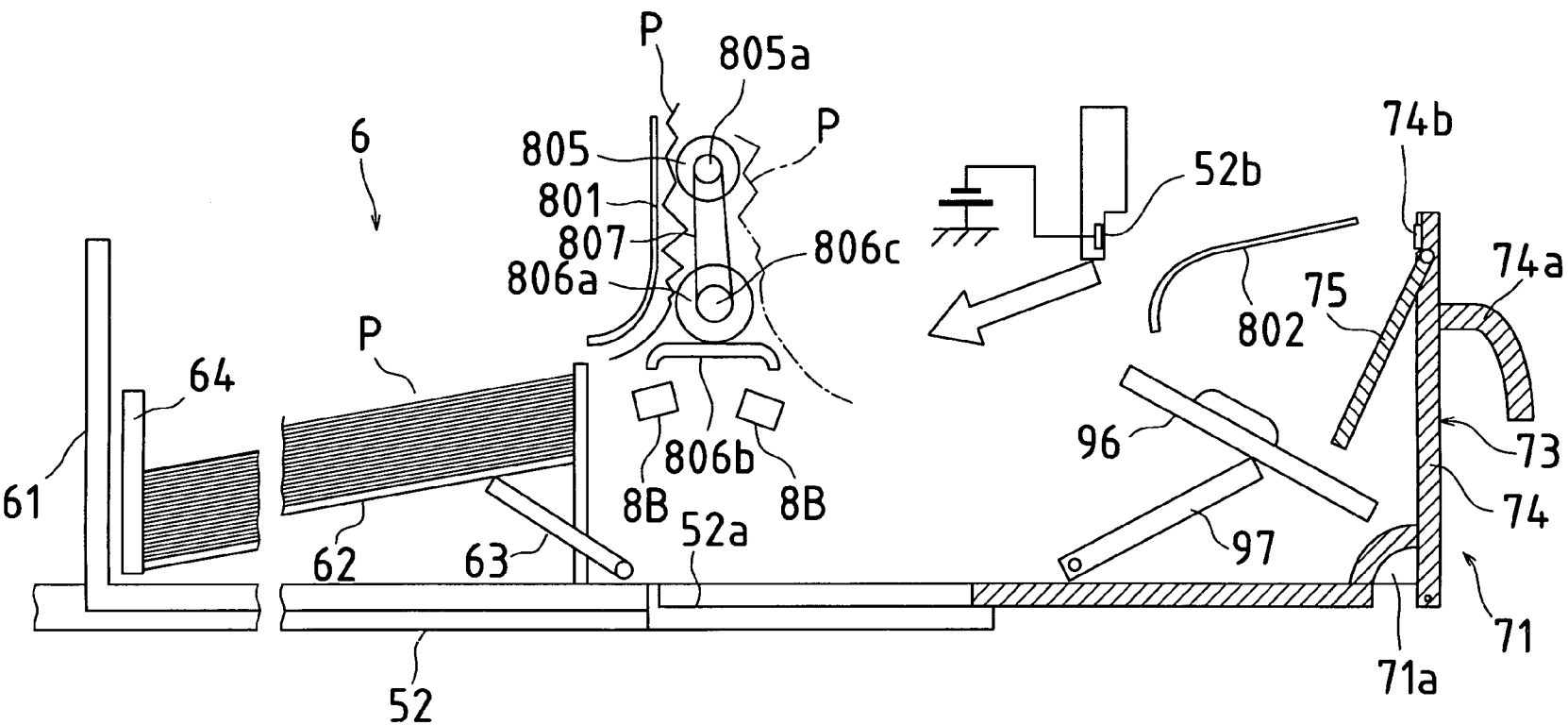
FIG. 23 is a drawing corresponding to FIG. 19 and showing a manual-feed mechanism unit that has been pulled outward at a time when a paper jam has occurred.

Furthermore, whereas the aforementioned first guide member 801 is supported by the aforementioned module casing 52, second guide member 802 is provided in such fashion that it is integral with the aforementioned manual-feed mechanism unit 7. In other words, when manual-feed mechanism unit 7 is pulled outward as indicated at FIG. 23, this second guide member 802 is pulled away from module casing 52 together with manual-feed mechanism unit 7. This being the case, access is opened up to feed path 803 constituted by the space between same and first guide member 801; making it possible to easily carry out procedure(s) for removal of paper in the event of occurrence of paper jam(s) at this feed path 803. Of the recording paper P involved in jams in FIG. 23, that shown with a solid line indicates jamming of recording paper P transported thereto from automatic-feed cassette mechanism unit 6, and that shown with an alternating long and short chain line indicates jamming of recording paper P transported thereto from manual-feed mechanism unit 7.

Furthermore, the aforementioned second guide member 802 is provided with a pivot mechanism, not shown, such that second guide member 802 extends vertically so as to form the aforementioned feed path 803 when, as shown in FIGS. 21 and 22, manual-feed mechanism unit 7 is not pulled outward therefrom; but such that second guide member 802 leans toward manual-feed tray 71, thus enlarging the space within which the user can insert his or her hand during removal of jammed paper (the direction in which the user's hand is inserted being indicated by an arrow at FIG. 23), when, as shown in FIG. 23, manual-feed mechanism unit 7 is pulled outward therefrom.

Feed Operations

Figure 24:
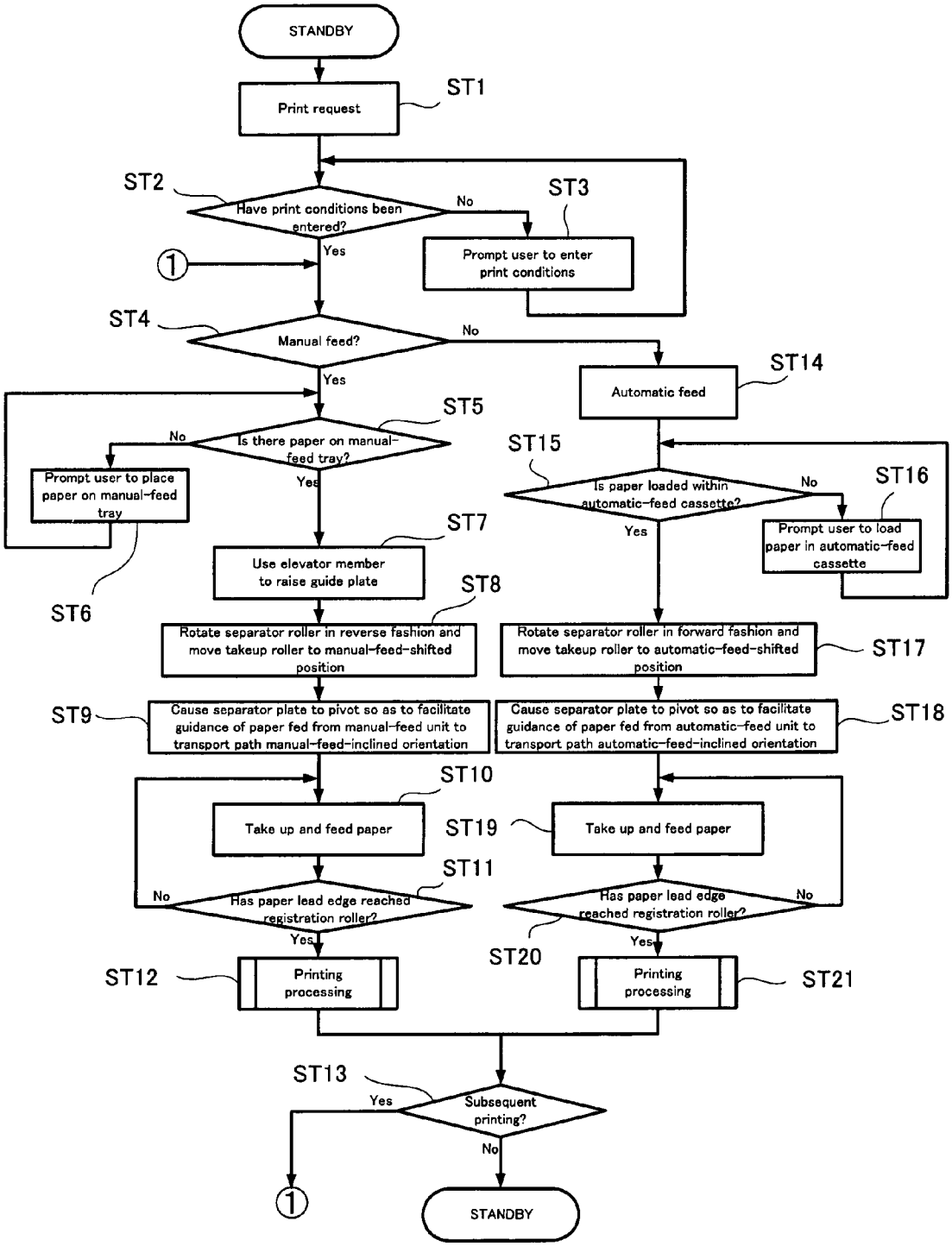
FIG. 24 is a flowchart for explaining paper feed operations carried out by a hybrid paper supply module associated with the third embodiment.
Figure 25:
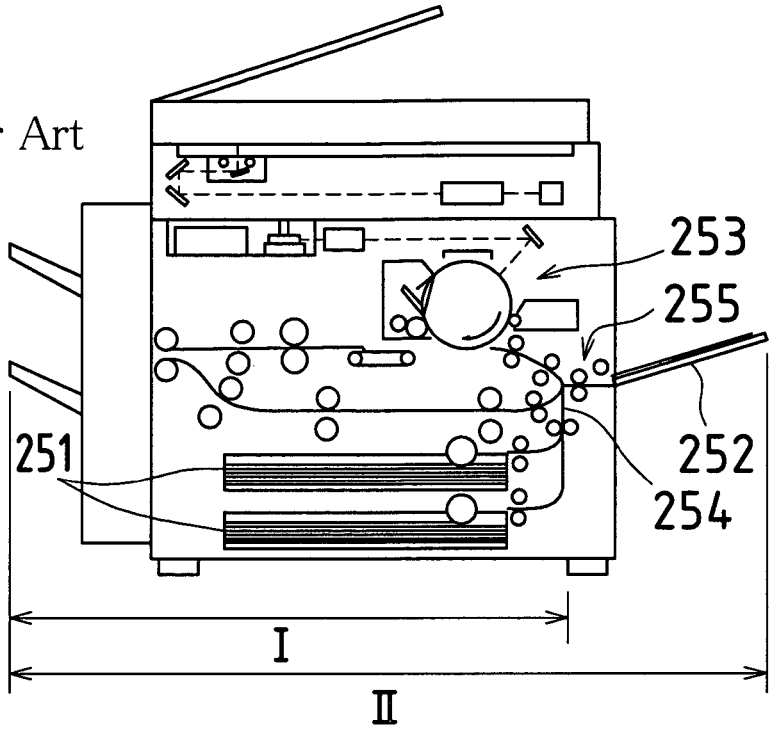
FIG.25 Prior Art
FIG. 25 is a drawing showing in schematic fashion the internal constitution of a typical conventional copier.
Figure 26:
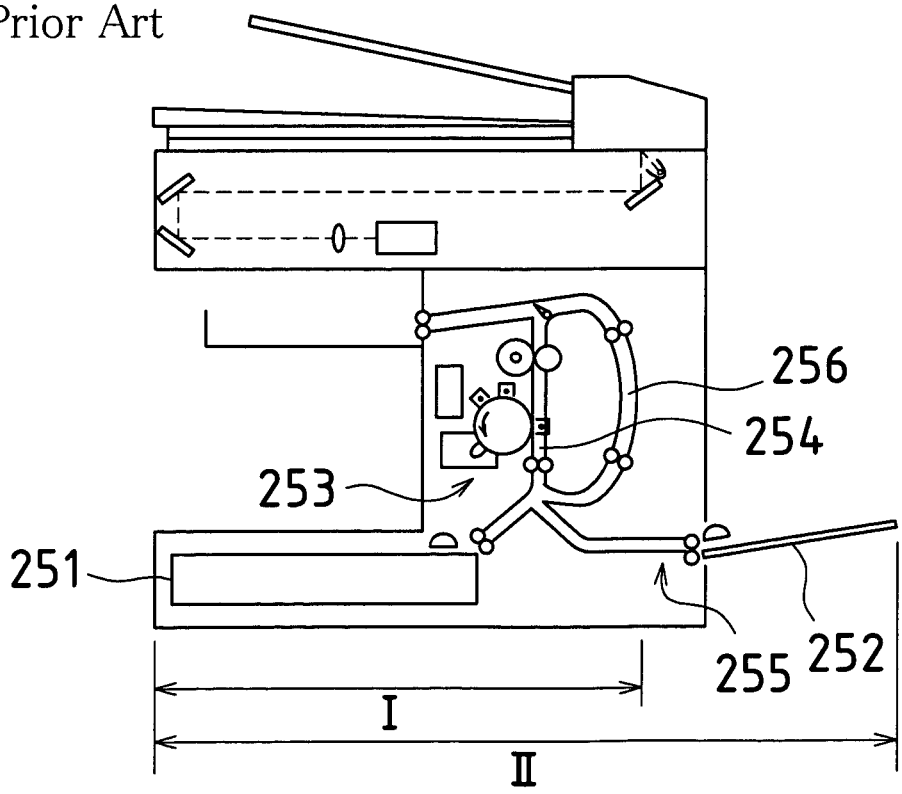
FIG.26 Prior Art
FIG. 26 is a drawing showing in schematic fashion the internal constitution of another conventional copier.

Following the flowchart of FIG. 24, paper feed operations carried out by hybrid paper supply module 5 having the foregoing constitution will next be described.

First, if at step ST1 the user operates a control panel of hybrid device 1 (or operates a host device connected thereto) or there is otherwise a request to carry out printing, then at step ST2 determination is made as to whether print conditions (selection of recording paper P supply source, etc.) have been entered. If such print conditions have not yet been entered (the answer as determined at step ST2 is NO), then processing proceeds to step ST3, at which a message for prompting entry of print conditions is displayed at the control panel.

Furthermore, upon entry of print conditions (i.e., in the event that the answer as determined at step ST2 is YES), processing proceeds to step ST4, at which determination is made as to whether the paper supply source at the foregoing print conditions is manual-feed mechanism unit 7. If the result of this determination is YES, then processing proceeds to step ST5, at which determination is made as to whether the foregoing manual-feed tray 71 is open and recording paper P has been placed on manual-feed tray 71. If the result of this determination is NO, then processing proceeds to step ST6, at which a message for prompting placement of recording paper P on manual-feed tray 71 (i.e., replenishment of paper) is displayed at the control panel.

If the answer as determined at the foregoing step ST5 is YES, then processing proceeds to step ST7, at which lift plate (elevator member) 97 is actuated, causing guide plate 96 to pivot upward. Thereafter, at step ST8, the aforementioned drive motor 808 is driven, as a result of which separator roller 806*a* and takeup roller 805 are made to rotate; and furthermore, pivoting action of the aforementioned support plate 809 causes takeup roller 805 to press against recording paper P lying on manual-feed tray 71 (i.e., takeup roller 805 moves to the manual-feed-shifted position thereof). In accompaniment to this action, as shown in FIG. 22, separator plate 806*b* pivots (step ST9) so as to cause the end thereof which is nearer to manual-feed tray 71 to be inclined such that it is directed downward (i.e., it assumes what is referred to in the context of the present invention as the manual-feed-inclined orientation thereof). With the apparatus in this state, recording paper P is taken up from manual-feed tray 71; and separation of recording paper P being carried out by paper separator mechanism 806, only one sheet of recording paper P is fed from manual-feed tray 71 to feed path 803 (step ST10).

Moreover, at step ST11, determination is made as to whether the lead edge (downstream edge) of the recording paper P fed to this feed path 803 has arrived at registration roller(s) 51; and if it has arrived at registration roller(s) 51, then at step ST12 printing processing is carried out, and after image forming has at printing unit 3 been carried out on recording paper P, operations are carried out for discharge thereof to discharge tray 35.

After printing operations have thus been carried out on a single sheet of recording paper P, determination is made at step ST13 as to whether there is subsequent printing to be carried out (i.e., whether subsequent print information exists); the operations at steps ST4 through ST13 being carried out in repeated fashion until subsequent print information does not exist. In addition, when subsequent print information no longer exists, hybrid device 1 enters a standby state. Upon entering this standby state, drive motor 808 is driven in a direction opposite to the direction in which it was driven during the operation at the foregoing step ST8, and support plate 809 is returned to its initial position such that it assumes the state indicated in FIG. 19 (i.e., takeup roller 805 stands straight up such that it does not contact recording paper P; this being what is referred to in the context of the present invention as the neutral position thereof). Furthermore, separator plate 806*b* returns to its neutral orientation between the aforementioned automatic-feed-inclined orientation and manual-feed-inclined orientation. This return of separator plate 806*b* to its neutral orientation is such that it is concluded before belt 807 spanning takeup roller 805 and separator roller 806*a* completes one full circuit.

Conversely, if the answer as determined at step ST4 is NO, then at step ST14 it is determined that the paper supply source selected pursuant to the print conditions is automatic-feed cassette mechanism unit 6, and processing proceeds to the operations at step ST15 and therebelow.

First, at step ST15, determination is made as to whether recording paper P is loaded within automatic-feed cassette 61. If the result of this determination is NO, then processing proceeds to step ST16, at which a message for prompting loading of recording paper P within automatic-feed cassette 61 (i.e., replenishment of paper) is displayed at the control panel.

If the answer as determined at the foregoing step ST15 is YES, then processing proceeds to step ST17, at which the aforementioned drive motor 808 is driven, as a result of which separator roller 806*a* and takeup roller 805 are made to rotate; and furthermore, pivoting action of the aforementioned support plate 809 causes takeup roller 805 to press against recording paper P within automatic-feed cassette 61 (i.e., takeup roller 805 moves to the automatic-feed-shifted position thereof). In accompaniment to this action, as shown in FIG. 21, separator plate 806*b* pivots (step ST18) so as to cause the end thereof which is nearer to automatic-feed cassette 61 to be inclined such that it is directed downward (i.e., it assumes what is referred to in the context of the present invention as the automatic-feed-inclined orientation thereof). With the apparatus in this state, recording paper P is taken up from automatic-feed cassette 61; and separation of recording paper P being carried out by paper separator mechanism 806, only one sheet of recording paper P is fed from automatic-feed cassette 61 to feed path 803 (step ST19).

Moreover, at step ST20, determination is made as to whether the lead edge (downstream edge) of the recording paper P fed to this feed path 803 has arrived at registration roller(s) 51; and if it has arrived at registration roller(s) 51, then at step ST21 printing processing is carried out, and after image forming has at printing unit 3 been carried out on recording paper P, operations are carried out for discharge thereof to discharge tray 35.

After printing operations have thus been carried out on a single sheet of recording paper P, determination is made at step ST13 as to whether there is subsequent printing to be carried out (i.e., whether subsequent print information exists); the operations at steps ST4, ST14 through ST21, and ST13 being carried out in repeated fashion until subsequent print information does not exist. In addition, when subsequent print information no longer exists, hybrid device 1 enters a standby state. Upon entering this standby state, as was the case previously, drive motor 808 is driven in a direction opposite to the direction in which it was driven during the operation at the foregoing step ST17, and support plate 809 is returned to its initial position such that it assumes the state indicated in FIG. 19 (i.e., takeup roller 805 stands straight up such that it does not contact recording paper P).

Benefits of Embodiment

As has been described above, the present embodiment being equipped with feed mechanism 800 permitting takeup of recording paper P from either automatic-feed cassette mechanism unit 6 or manual-feed mechanism unit 7, it is no longer necessary to provide a separate takeup mechanism at each of the mechanism units 6, 7. This being the case, it is possible to reduce the component parts count of hybrid paper supply module 5, as a result of which it is possible to achieve reduction in the amount of space required for installation of hybrid device 1.

Furthermore, in the present embodiment, automatic-feed cassette mechanism unit 6 and manual-feed mechanism unit 7 together constitute a single integral hybrid paper supply module 5. This being the case, it is possible for manual-feed mechanism unit 7 to be arranged such that it is stacked vertically with respect to main transport path 36 and flipping transport path 37 which extend so as to be directed toward printing unit 3 of hybrid device 1, as a result of which it is possible to shorten dimension(s) of hybrid device 1—also making it possible to achieve reduction in the amount of space required for installation.

Furthermore, because this hybrid paper supply module 5 makes it possible to cause the path along which recording paper P taken up from automatic-feed cassette mechanism unit 6 is transported and the path along which recording paper P taken up from manual-feed mechanism unit 7 is transported to be shared at the interior of module 5, it is possible to decrease overall path length. This being the case, the length of the overall paper transport path of the apparatus can be shortened, the number of locations at which paper jams can occur can be reduced, and image forming operations at the apparatus can be carried out in stable fashion.

Other Embodiments

Whereas in the foregoing embodiments the present invention has been described in terms of an example in which it is applied to a multifunction image forming apparatus (hybrid device) 1 combining the functions of copier, printer, and facsimile machine, the present invention is not limited thereto but may also be applied to an image forming apparatus provided with any one function, and to other image forming apparatuses as well.

Furthermore, whereas manual-feed tray 71 of manual-feed mechanism unit 7 was of folding type and permitted adjustment of length in two stages; the present invention is not limited thereto, it being possible for the structure to be of pullout type such that adjustment of length is permitted, and/or it is also possible to adopt a constitution in which length is adjustable in three or more stages.

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A hybrid paper supply module comprising:

at least one automatic-feed cassette mechanism units for containing one or more recording media for recording an image at least one image forming unit of at least one image forming apparatus at least one manual-feed mechanism units permitting the placement therein or thereon of one or more of said recording media by one or more users;

wherein said at least one automatic-feed cassette mechanism unit and said at least one manual-feed mechanism unit comprises a single module; and further comprises, at least one common feed mechanism selectively permitting one or more of said recording media to be fed from either at said at least one of the automatic-feed cassette mechanism unit or said at least one manual-feed mechanism unit;

said at least one common feed mechanism being arranged so as to permit switching between, a first transport mode wherein one or more of said recording media is fed from said at least one automatic-feed cassette mechanism unit and is transported to-said at least one of the image forming unit, a second transport mode wherein one or more of said recording media is fed up from said at least one manual-feed mechanism unit and is transported to said at least one of the image forming unit, and a third transport mode wherein one or more of said recording media id fed from said at least one manual-feed mechanism unit and is delivered to said at least one automatic-feed cassette mechanism unit.

2. A hybrid paper supply module according to claim 1 wherein said at least one automatic-feed cassette mechanism unit and said at least one manual-feed mechanism unit respectively include one or more paper feed mechanisms and one or more paper separator mechanisms for permitting the feed of only a single sheet of said recording media.

3. A hybrid paper supply module according to claim 1 and further comprising:

at least one first transport paths for transporting one or more of said recording media fed from said at least one automatic-feed cassette mechanism unit; and at least one second transport paths for transporting one or more of said recording media fed from said at least one manual-feed mechanism unit; and at least one common transport paths wherein said at least one first transport path and said at least one second transport paths mutually intersect and extend toward said at least one image forming unit.

4. A hybrid paper supply module according to claim 3 wherein:

said at least one manual-feed mechanism unit includes one or more manual-feed trays for holding one or more of said recording media placed thereat by one or more users; and wherein said at least one of said manual-feed trays includes multiple leaves arranged such that when not in use said manual feed tray can be folded so as to permit storage thereof at side of said hybrid paper supply module.

5. A hybrid paper supply module according to claim 4 wherein;

said at least one of the manual-feed tray, when stored, comprises one side wall of the hybrid paper supply module; and when deployed permit the holding of one or more of said recording media, and permits access to one or more recording medium transport paths.

6. A hybrid paper supply module according to claim 4 wherein;

said at least one manual-feed tray is configured so as to permit extension in multiple stages when in one or more deployed states thereby permitting one or more recording media to be placed thereat.

7. A hybrid paper supply module according to claim 4 wherein:

said at least one manual-feed tray includes one or more guide members having one or more placement locations for constraining said one or more recording media placed thereat by abutting against one or more side edges extending in one or more transport directions of said recording media; said wherein at least one of the said guide members is supported so as to permit sliding movement thereof in or on said at least one manual-feed tray.

8. A hybrid paper supply module according to claim 4 wherein:

said at least one manual-feed mechanism unit is slidably moveable within said module so as to provide access to one or more of said recording media transport paths; and in the event that one or more of said recording media becomes jammed in one or more of said recording medium transport paths, sliding movement of said at least one manual-feed mechanism unit provides access to at least one of said recording medium transport paths for providing removal of said jammed recording medium therefrom.

9. A hybrid paper supply module according to claim 1 wherein said at least one common feed mechanism comprises:

one or more takeup rollers operably moveable between one or more automatic-feed-shifted positions for feeding said one or more of said recording media from at least one automatic-feed cassette mechanism unit and one or more manual-feed-shifted positions for feeding said one or more recording media from said at least one manual-feed mechanism unit;

one or more separator mechanisms for separating said one or more of said recording media fed by at least one of said the takeup rollers; and one or more transport paths guiding at least one of said recording media toward said at least one image forming unit.

10. A hybrid paper supply module according to claim 1 or 9 wherein recording medium transport operations during said third transport mode are carried out during an absence of image forming operation.

11. A hybrid paper supply module according to claim 1 or 9 wherein recording medium transport operations during the said third transport mode are one carried out only if at least one of said recording medium placed in or on at said least one manual-feed mechanism unit is the same size as said at least one size of said recording medium placed in or on said at least one automatic-feed cassette mechanism unit.

12. A hybrid paper supply module according to claim 1 or 9 wherein:

said at least one automatic-feed cassette mechanism unit and said at least one manual-feed mechanism unit are arranged so as to be mutually adjacent and substantially horizontal; and wherein recording medium transport operations during said third transport mode include a slew transport mode wherein one or more of said recording media fed from said at least one manual-feed mechanism unit or is transported horizontally, without flipping, toward said at least one automatic-feed cassette mechanism unit.

13. A hybrid paper supply module according to claim 12 wherein:

said at least one of the separator mechanisms includes one or more separator rollers and one or more separator plates, and wherein at least one of the separator plates comes in contact with at least one of the separator rollers; and during said slew transport mode, at least one of the separator plates is oriented so as to be substantially parallel to an imaginary line drawn connecting said at least one manual-feed mechanism unit and said at least one automatic-feed cassette mechanism unit, and wherein one or more of said recording media fed from said at least one manual-feed mechanism unit is transported horizontally to said at least one automatic-feed cassette mechanism unit.

14. A hybrid paper supply module according to claim 1 or 9 wherein:

said at least one automatic-feed cassette mechanism unit and said at least one manual-feed mechanism unit are arranged so as to be mutually adjacent substantially horizontal; and wherein recording medium transport operations during said third transport mode includes a switchback transport mode which is carried out when one or more of said recording media fed from said at least one manual-feed mechanism unit is delivered, with flipping, to said at least one automatic-feed cassette mechanism unit.

15. A hybrid paper supply module according to claim 14 wherein:

said at least one of the separator mechanism includes one or more separator rollers and one or more separator plates, and wherein at least one of the separator plates comes in contact with at least one of said separator rollers; and during said switchback transport mode, at least one of said separator plates is first oriented so as to guide, one or more of said recording media fed from said at least one manual-feed mechanism unit, to said at least one transport paths extending toward said at least one image forming unit one or more of said recording media is fed from said at least one manual-feed mechanism unit and is guided to at least one of said transport paths, and thereafter, with at least one of said separator plates oriented so as to guide said one or more of said recording media present in said at least one transport path to said at least one the automatic-feed cassette mechanism unit, and, one or more of said recording media is transported or from at said at least one transport paths to said at least one automatic-feed cassette mechanism unit.

16. A hybrid paper supply module according to claim 15 wherein:

during said switchback transport mode, with at least one of said takeup rollers in at least one manual-feed-shifted position for feeding one or more of said recording media from said at least one manual-feed mechanism unit, and with at least one separator plate in at least one manual-feed-inclined orientations for guiding said one or more recording media toward said one or more transport paths from said at least one manual-feed mechanism unit, said one or more recording media fed from said at least one manual-feed mechanism unit is first guided to said at least one of said transport paths, and thereafter, with at least one of said separator rollers rotating in a reverse direction, and with at least one of said separator drive plates in an automatic-feed-inclined orientations for guiding one or more of said recording media from at least one of said transport paths toward said at least one automatic-feed cassette mechanism unit, one or more of said recording media is transported from said at least one transport paths to said at least one of the automatic-feed cassette mechanism unit.

17. A hybrid paper supply module according to claim 16 wherein:

during said switchback transport mode, when at least one recording medium of said one or more recording medium is transported from said at least the transport path to said at least one automatic-feed cassette mechanism unit, movement of an upstream edge of said at least one recording medium as it is carried along with at least one outside circumferential surface of at least one of said separator rollers while at least one of said separator rollers is rotating, causes said at least one of the recording medium or media to be fed into a region between at least one of the separator rollers and at least one of the separator or plates and to be transported toward said at least one automatic-feed cassette mechanism unit from said at least one transport path.

18. A hybrid paper supply module according to claim 1 or 9 wherein:

recording medium transport operations during said third transport mode is such that in said slew transport mode, one or more of said recording media is selectively fed from said at least one manual-feed mechanism unit without flipping, to said at least one automatic-feed cassette mechanism unit, or in said switchback transport mode, one or more of said recording media is selectively fed from said at least one manual-feed mechanism unit, with flipping, to said at least one automatic-feed cassette mechanism unit, and if during execution of recording medium transport operations in accordance with said third transport mode, it is desired that image formation should be carried out on more than one surface of said one or more recording media placed in or on at said least one manual-feed mechanism unit when transported toward said at least one image forming unit pursuant to at said second transport mode, then said one or more recording media is delivered in said switchback transport mode from said at least one manual-feed mechanism unit to said automatic-feed cassette mechanism unit, but if it is desired that image formation should not be carried out on more than one surface of said one or more recording media placed in or on said at least one manual-feed mechanism unit when transported toward said at least one image forming unit pursuant to said second transport mode, then said one or more recording media is delivered in said slew transport mode from said at least one manual-feed mechanism unit to said at least one automatic-feed cassette mechanism unit.

19. A hybrid paper supply module according to claim 1 wherein:

said at least one common feed mechanism includes one or more takeup rollers moveable between one or more automatic-feed-shifted positions for feeding one or more of said recording media from said at least one automatic-feed cassette mechanism unit and between one or more manual-feed-shifted positions for feeding one or more of said recording media from said at least one manual-feed mechanism unit;

one or more separator mechanisms for separating one or more of said recording media being fed by at least one of said takeup rollers; and one or more transport paths for guiding at least one of said recording media to said at least one image forming unit.

20. A hybrid paper supply module according to claim 19 wherein:

at least one of said one or more takeup rollers and at least one of said one or more separator mechanisms receive drive power from at least one common drive source for carrying out recording medium feed operations and recording medium separation operations; and wherein at least one drive direction of said at least one common drive source is changeable, so as to permit switching between a plurality of feed mechanism units from which one or more of said recording media is fed, depending upon whether one or more of said recording media is to be fed from said at least one automatic-feed cassette mechanism unit or whether one or more of said recording media is to be fed from said at least one manual-feed mechanism unit.

21. A hybrid paper supply module according to claim 19 or 20 wherein:

at least one of said separator mechanisms includes one or more separator rollers and one or more separator plates and wherein, at least one of said separator plates contacts at least one of said separator or rollers;

at least one of said takeup rollers and at least one of said separator rollers are mutually connected so as to permit transmission of motive force by means of one or more belts; and wherein, in absence of image forming, at least one of said takeup rollers remains in at least one neutral positions between at least one of said automatic-feed-shifted positions and at least one of said manual-feed-shifted positions; but during image forming, at least one of said takeup or rollers moves from said at least one neutral position to said at least one automatic-feed-shifted position in the event that said at least one separator roller is driven in one rotational direction, but at least one of the takeup rollers moves from said at least one neutral position to said at least one of the manual-feed-shifted position positions in the event that said at least one separator roller is driven in rotational fashion in an opposite rotational direction.

22. A hybrid paper supply module according to claim 21 wherein said at least one separator plate is arranged so as to permit one or more changeable angles of inclination so that, when feeding one or more of said recording media from said at least one automatic-feed cassette mechanism unit, one or more automatic-feed-inclined orientations is assumed for guiding one or more of said recording media toward one or more of said transport paths from said at least one automatic-feed cassette mechanism unit; but when feeding one or more of said recording media from said at least one manual-feed mechanism unit, one or more manual-feed-inclined orientations is assumed for guiding one or more of said recording media toward one or more of said transport paths from said at least one manual-feed mechanism unit.

23. A hybrid paper supply module according to claim 22 further comprising:

one or more stopper elements, located at or near at least one of said separator plates, for maintaining said at least one separator plate in either one of said automatic-feed-inclined orientations or one of said manual-feed-inclined or orientations.

24. A hybrid paper supply module according to claim 21 wherein:

following termination of said image forming operations, in order to cause at least one of the takeup rollers to move and return to said at least one neutral position, at least one drive sources produces motion of at least one of said takeup rollers, and is driven in a direction opposite to said at least one direction that said at least one of said takeup rollers was driven during initiation of said image forming operations.

25. A hybrid paper supply module according to claim 24 wherein:

following termination of said image forming operations, and substantially concurrently with the movement and return of said at least one of said feed rollers to said at least one neutral position, at least one of said separator plates returns to said one neutral orientation between said at least one automatic-feed-inclined orientation for guiding one or more of said recording media toward said one or more transport paths from said at least one automatic-feed cassette mechanism unit and said at least one manual-feed-inclined orientation for guiding one or more of said recording media toward one or more of said transport paths from at least one manual-feed mechanism unit; and following termination of said image forming operations, at least one of said separator plates returns to said at least one neutral orientation before at least one drive belt spanning at least one of said takeup rollers and at least one of said feed rollers completes one full circuit of operation.

26. An image forming apparatus equipped with one or more hybrid paper supply modules according to claim 1 wherein image formation is carried out on one or more recording media fed by at least one common takeup mechanism from either at least one of the automatic-feed cassette mechanism unit or at least one manual-feed mechanism unit and supplied to at least one image forming unit.

* * * * *